US010556645B1

(12) United States Patent
Levin

(10) Patent No.: US 10,556,645 B1
(45) Date of Patent: Feb. 11, 2020

(54) BOAT CHAIR CONFIGURED FOR CONVERSION BETWEEN MULTIPLE USE AND STORAGE POSITIONS, A COMBINATION BOAT CHAIR AND BOAT, AND/OR A METHOD OF USE THEREOF

(71) Applicant: Eric Martin Levin, Severna Park, MD (US)

(72) Inventor: Eric Martin Levin, Severna Park, MD (US)

( * ) Notice: Subject to any disclaimer, the term of this patent is extended or adjusted under 35 U.S.C. 154(b) by 10 days.

(21) Appl. No.: 15/880,406

(22) Filed: Jan. 25, 2018

(51) Int. Cl.
*B63B 29/04* (2006.01)
*A47C 7/58* (2006.01)

(52) U.S. Cl.
CPC ..... *B63B 29/04* (2013.01); *A47C 7/58* (2013.01); *B63B 2029/043* (2013.01)

(58) Field of Classification Search
CPC .. A47C 1/03; A47C 7/54; A47C 7/543; A47C 7/546; A47C 3/26; B63B 2029/043
See application file for complete search history.

(56) References Cited

U.S. PATENT DOCUMENTS 4,926,783 A 5/1990 Lathers
5,171,063 A * 12/1992 Stidd ..... B60N 2/0717 297/344.1
5,697,318 A 12/1997 Kobayashi
6,283,059 B1 9/2001 Scully, Jr.
6,527,341 B1 3/2003 Martin
6,880,482 B2 4/2005 Huse
7,066,548 B2 6/2006 Butler
7,107,927 B2 9/2006 Hopper
7,137,351 B2 * 11/2006 Picou ..... B63B 29/04 114/363
7,367,616 B2 5/2008 Summerford
9,021,975 B1 5/2015 Fodor
2005/0179288 A1 * 8/2005 Lizaso ..... A47C 1/12 297/250.1
2010/0037814 A1 2/2010 Sahr
2015/0274263 A1 * 10/2015 Nutz ..... B60N 2/1605 114/363

* cited by examiner

*Primary Examiner* — Andrew Polay
(74) *Attorney, Agent, or Firm* — Garcia-Zamor IP Law; Ruy M. Garcia-Zamor

(57) ABSTRACT

A boat chair configured such that it may be converted between several storage and/or use configurations which may be detachably affixed to and removed from a boat. The boat chair may be configured such that one or more of the storage configurations may allow for the boat chair to be more easily transported and/or store. The boat chair may further be configured such that the use configurations may allow for customized position and/or use of the boat chair on a boat.

17 Claims, 38 Drawing Sheets

BOAT CHAIR CONFIGURED FOR CONVERSION BETWEEN MULTIPLE USE AND STORAGE POSITIONS, A COMBINATION BOAT CHAIR AND BOAT, AND/OR A METHOD OF USE THEREOF

BACKGROUND

The present invention is generally directed to ships and chairs and, more specifically, boat component and attachments. More specifically still, the invention is directed toward boat chairs which may be selectively removed and attached from a boat, and which may be transitionable between several preferred configurations.

Boat chairs are designed to maintain single shape. Such configurations may make use difficult, as chairs suitable for use while fishing may be uncomfortable for lounging and sun bathing. Such chairs may also be difficult to store, as the shape of boat chairs is generally not conducive to compact storage. Additionally, many known boat chairs may include portions which must be stored separately, requiring additional space. Such limitations may restrict the usefulness of boats, and require consumers to purchase multiple boats for multiple purposes.

It may be advantageous to provide a boat chair that is at least one of: easily portable; may be converted between multiple storage and/or use configurations; may be selectively and detachably affixed to multiple portions of existing boat structures; may include configurations which may be adapted to multiple uses; may form a compact and easily storable storage configuration; and/or that is efficient to manufacture. It may further be advantageous to provide a boat configured for use with such boat chairs.

SUMMARY

Briefly speaking, one aspect of the present invention is directed to a boat chair that is detachably installable on a boat. The boat chair includes a chair body which is moveable between a first compact configuration and a second open configuration. The chair body includes a back support structure and a seat support structure which are pivotally connected together by at least one of a hinge or a locking mechanism. The locking mechanism is configured to secure an angular position of the back support structure relative to the seat support structure and to secure the chair body in either of the first compact configuration and the second open configuration. A post is detachably engageable with the seat support structure such that the chair body can be detachably installed on the boat. No part of the chair body is formed by a bulkhead structure of the boat, a boat cushion, nor boat decking.

In a separate aspect, the present invention is directed to a boat chair that is detachably installable on a boat. The boat chair includes a chair body which is moveable between a first compact configuration and a second open configuration. The chair body includes a back support structure and a seat support structure which are pivotally connected together by at least one of a hinge formed by two elliptical hinges.

In a separate aspect, the present invention is directed to a boat chair that is detachably installable on a boat. The boat chair includes a chair body which is moveable between a first compact configuration and a second open configuration. The chair body includes a back support structure and a seat support structure which are pivotally connected together by at least one of a hinge or a locking mechanism. The boat chair has a post which is stored inside the seat support structure when not needed.

In a separate aspect, the present invention is directed to a boat chair that is detachably installable on a boat. The boat chair includes a chair body which is moveable between a first compact configuration and a second open configuration such that the boat chair can be configured to support upright sitting, reclined sitting/laying, and serve as a table or worktable.

In a separate aspect, the present invention is directed to a boat chair that is detachably installable on a boat. The boat chair includes a chair body which is moveable between a first compact configuration and a second open configuration.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

The figure also demonstrates that the post 124 may be retained in the cavity by a post-holder extension 132 protruding into the cavity 120. In this preferred embodiment, the post 124 is hollow to allow it to slip over the post-holder extension 132 and to be held over it by friction.

Figure 27:
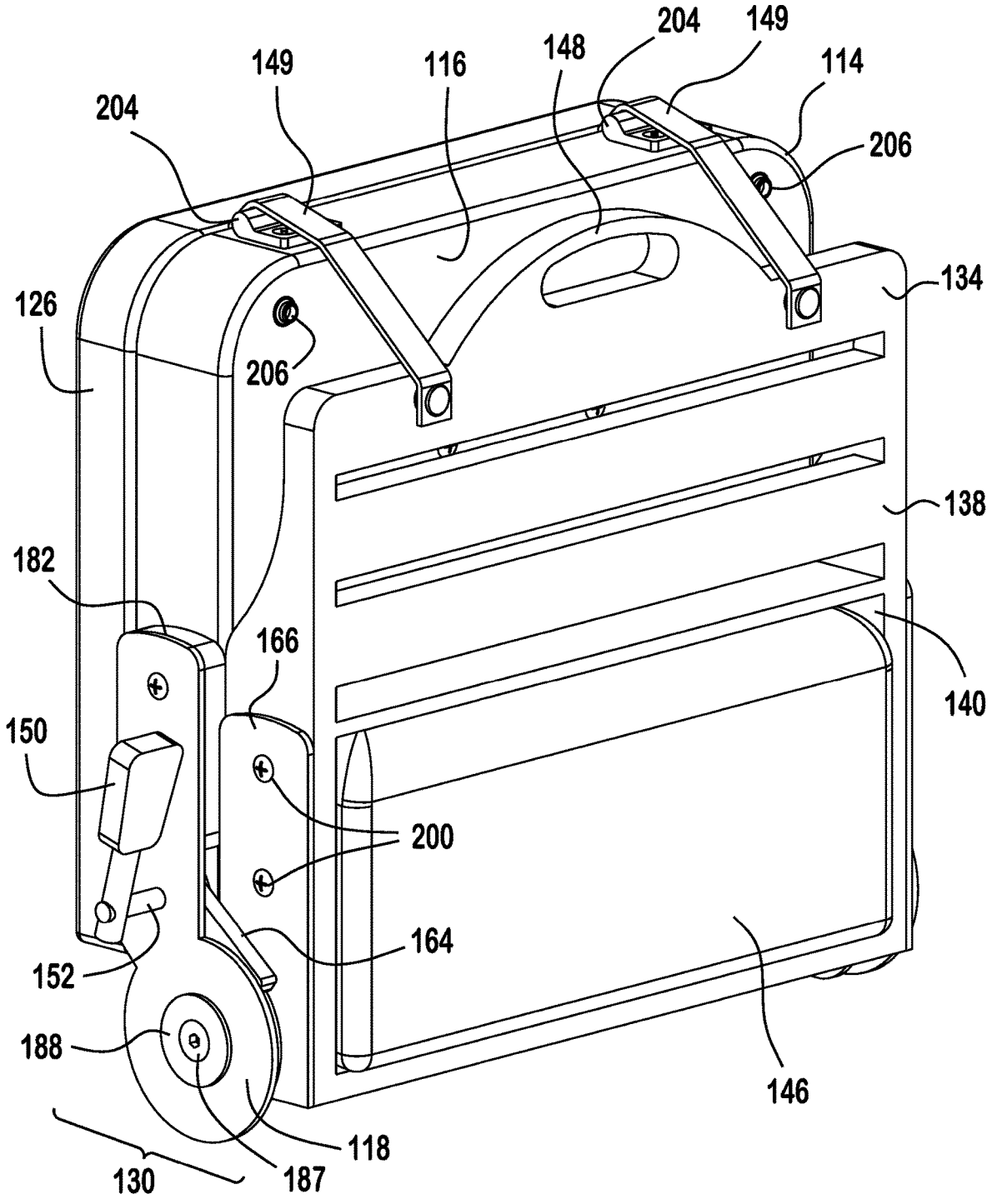
FIG. 27 is a front perspective view of a preferred embodiment of the boat chair 110, demonstrating the general preferred embodiment of the chair body 112, including a seat support structure 114 and a back support structure 134 conjoined by a locking mechanism 130. In such embodiments, the locking mechanism 130 may also form a pivot axis about which the back support structure 134 might pivot. The seat support structure 114 includes an inner seat face 116 and outer seat face 118, and the back support structure 134 includes an inner back face 136 and an outer back face 138. In the preferred transport configuration, also called the first compact position, the inner seat face 116 and inner back face 136 are preferably positioned against another.
Figure 28:
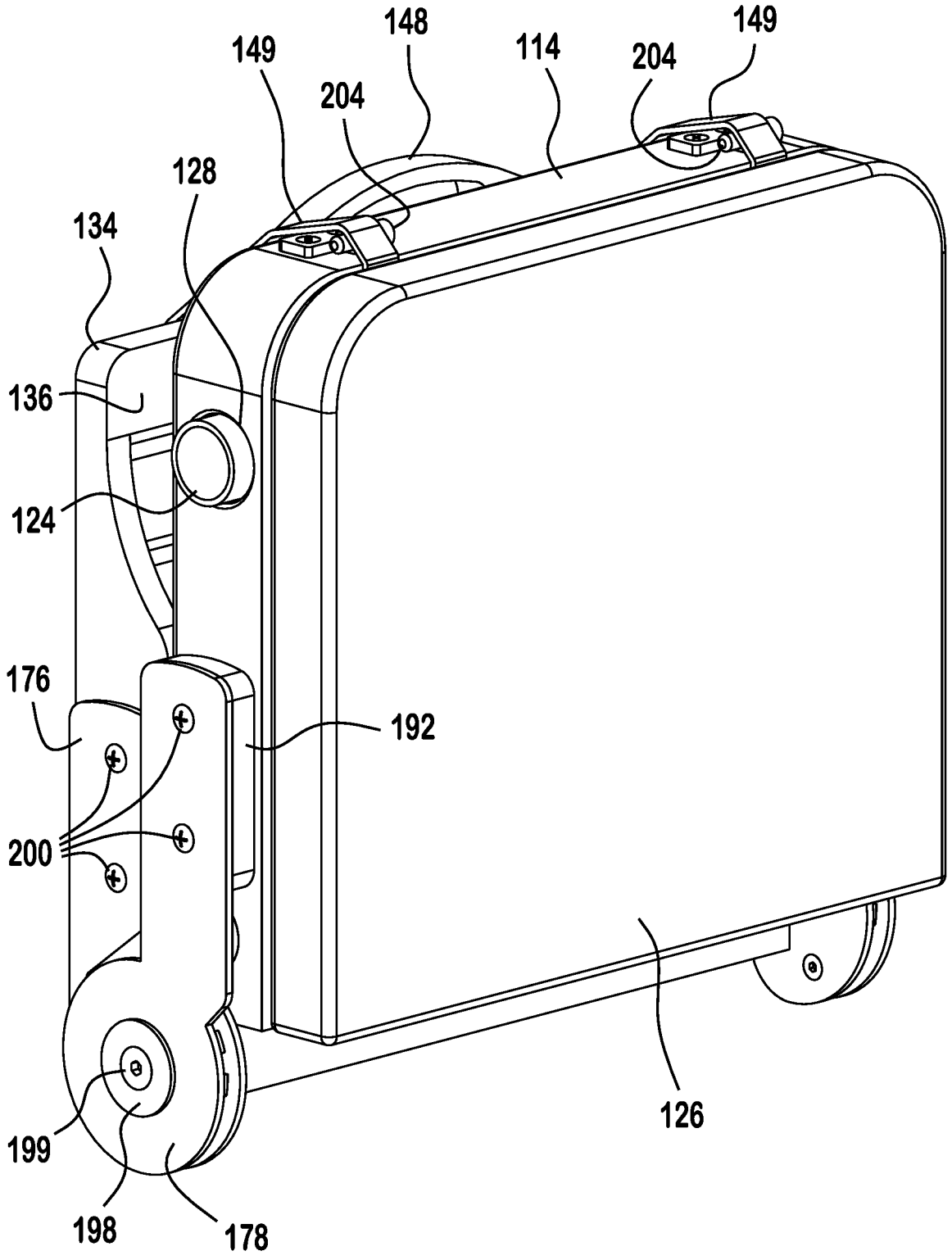
FIG. 28 is rear perspective view of the boat chair 110 of FIG. 27, demonstrating that the seat cushion 126 covers the outer seat face 118 of the seat support structure 114 when the boat chair 110 is in the first compact position. In such a position, the post 124 may be inserted through the bore 128 to be placed generally within the cavity 120.
Figure 29:
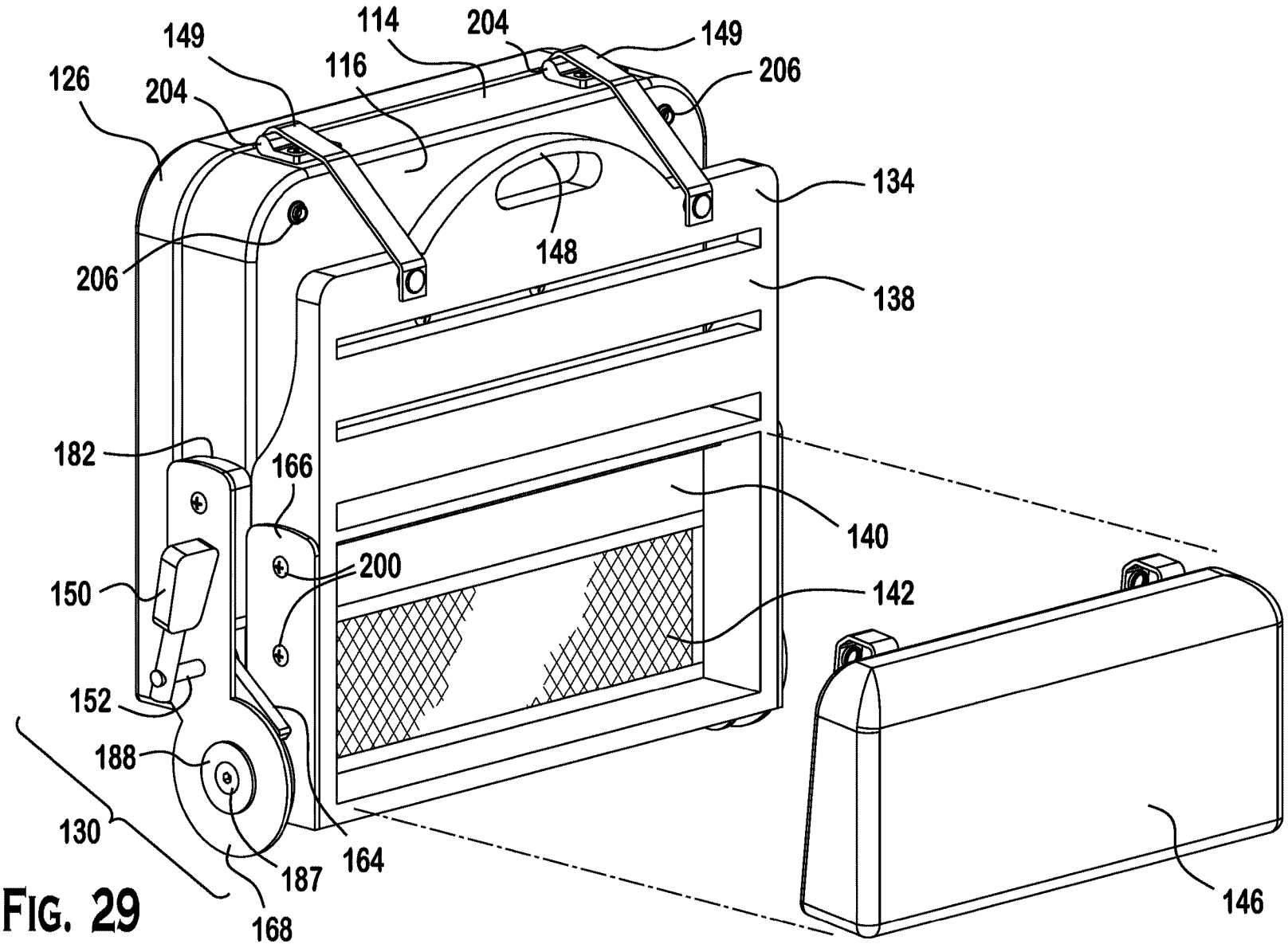
FIG. 29 is an alternative view of a FIG. 27, demonstrating that, when the boat chair 110 is in the first compact configuration, the back rest cushion 146 may be stored in a chamber 140 formed by the outer back face 138, and that a storage compartment 142 may be included in the chamber 140 to allow for the storage of personal items during use or storage. The figure also demonstrates the preferred positioning of the handle 148 formed by the outer back face 138 when the boat chair 110 is in the first compact position.
Figure 30:
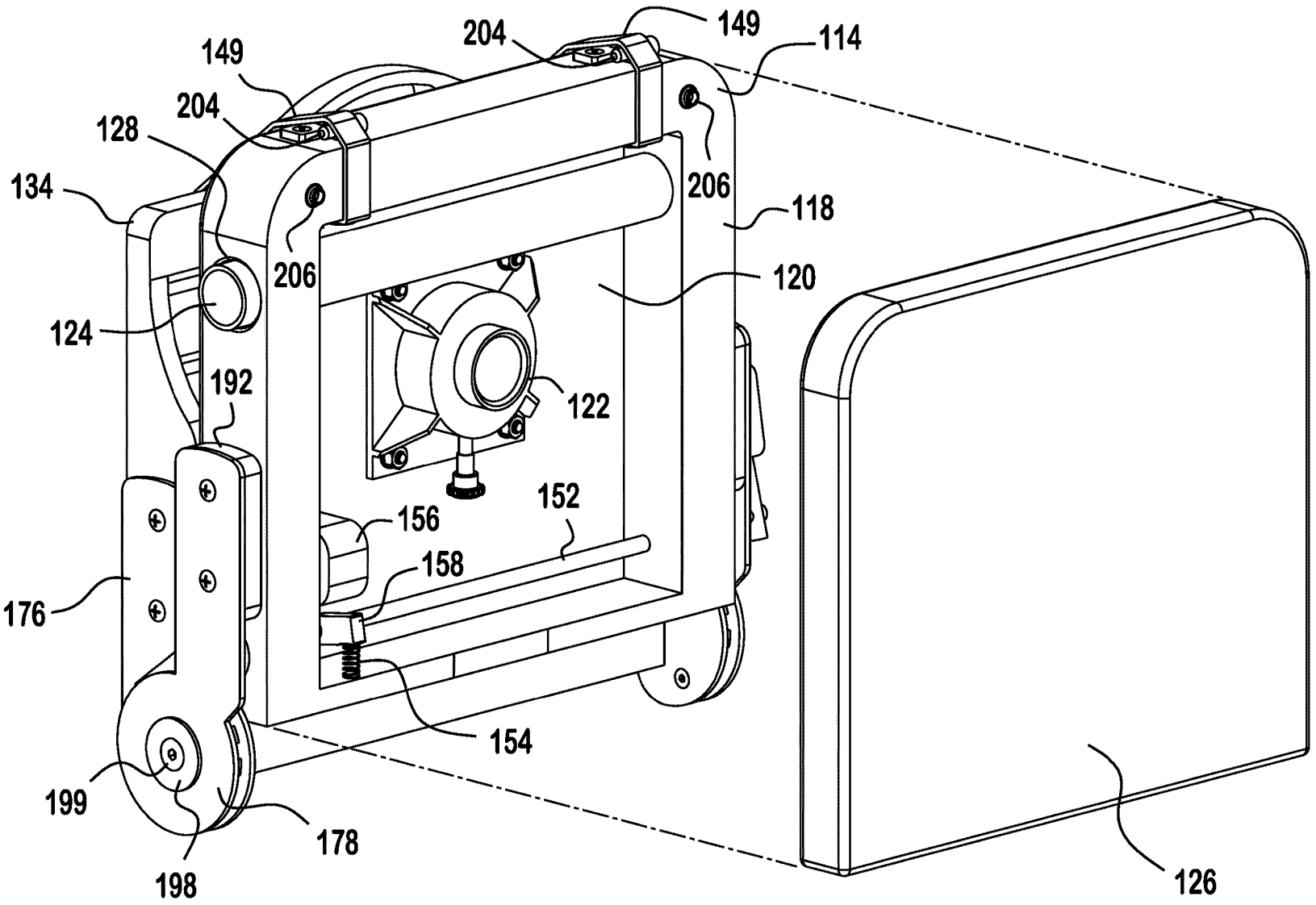
FIG. 30 is an alternate view of FIG. 28, demonstrating that the seat cushion 126 may cover the cavity 120 formed from the outer seat face 118 when the boat chair 110 is in the first compact position. The seat cushion 126 may be retained over the cavity 120 by snaps 206. The figure also demonstrates that the cavity 120 further includes a pedestal 122 into which the post 124 may be inserted when the boat chair 110 is in the second open configuration. The cavity 120 also contains a portion of the actuating rod 152, which may turn when activated by either of the first lever 150 or the second lever 151, a pivot arm 158 positioned on the actuating rod 152 to be acted upon by the biasing member 154 (such as a spring) to bias the position of the actuating rod 152, and a pivot stop 156 to prevent over rotating of the actuating rod 152 by preventing unwanted movement of the pivot arm 158.
Figure 31:
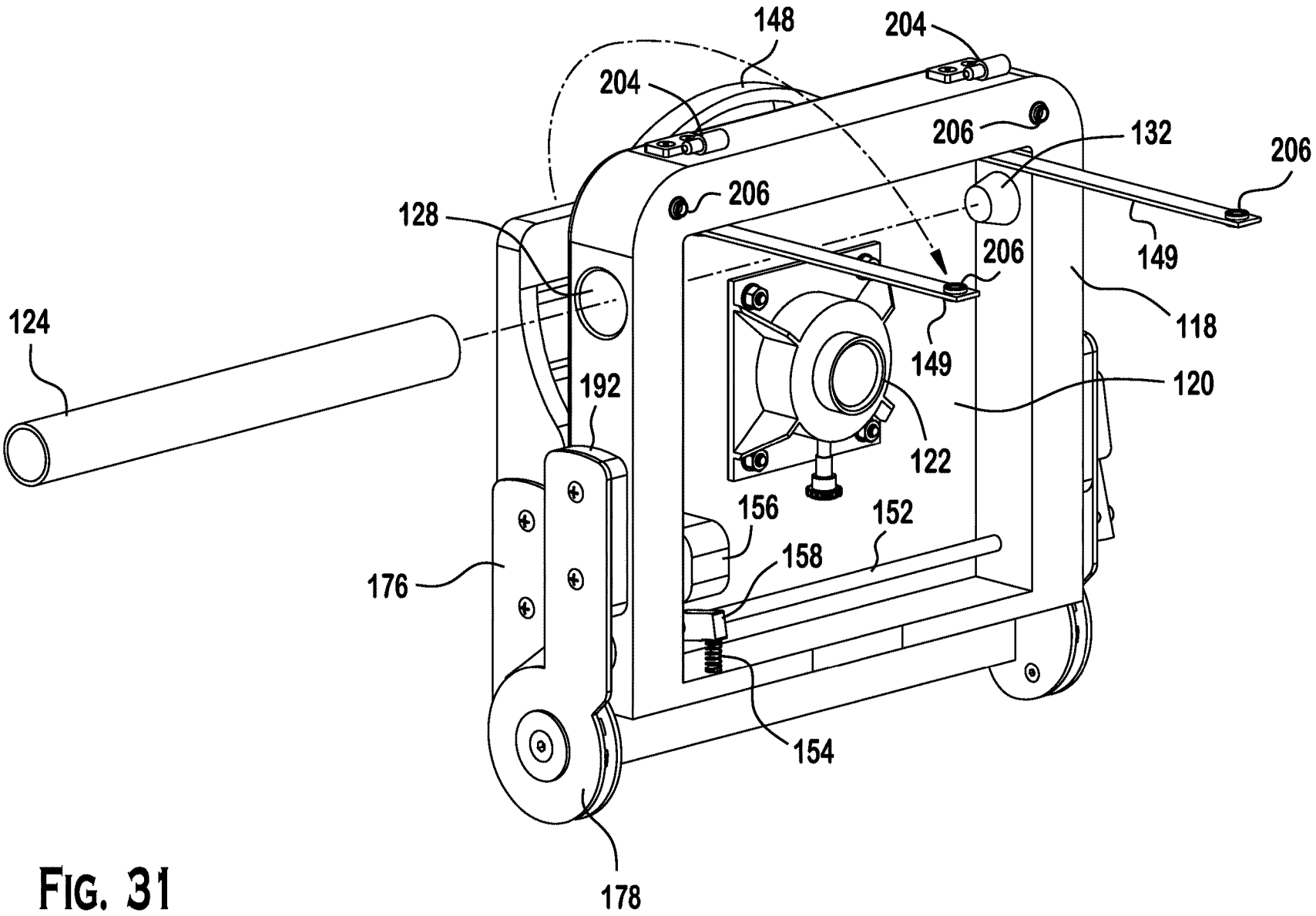
FIG. 31 is an alternate view of FIG. 28, demonstrating that straps 149 are preferably attached to the seat support structure 114 within the cavity 120. The straps 149 may then extend over the seat support structure 114 and back support structure 134 to fasten on the outer back face 138 with snaps 206 positioned thereon to keep the boat seat 110 in the first collapsed configuration.
Figure 32:
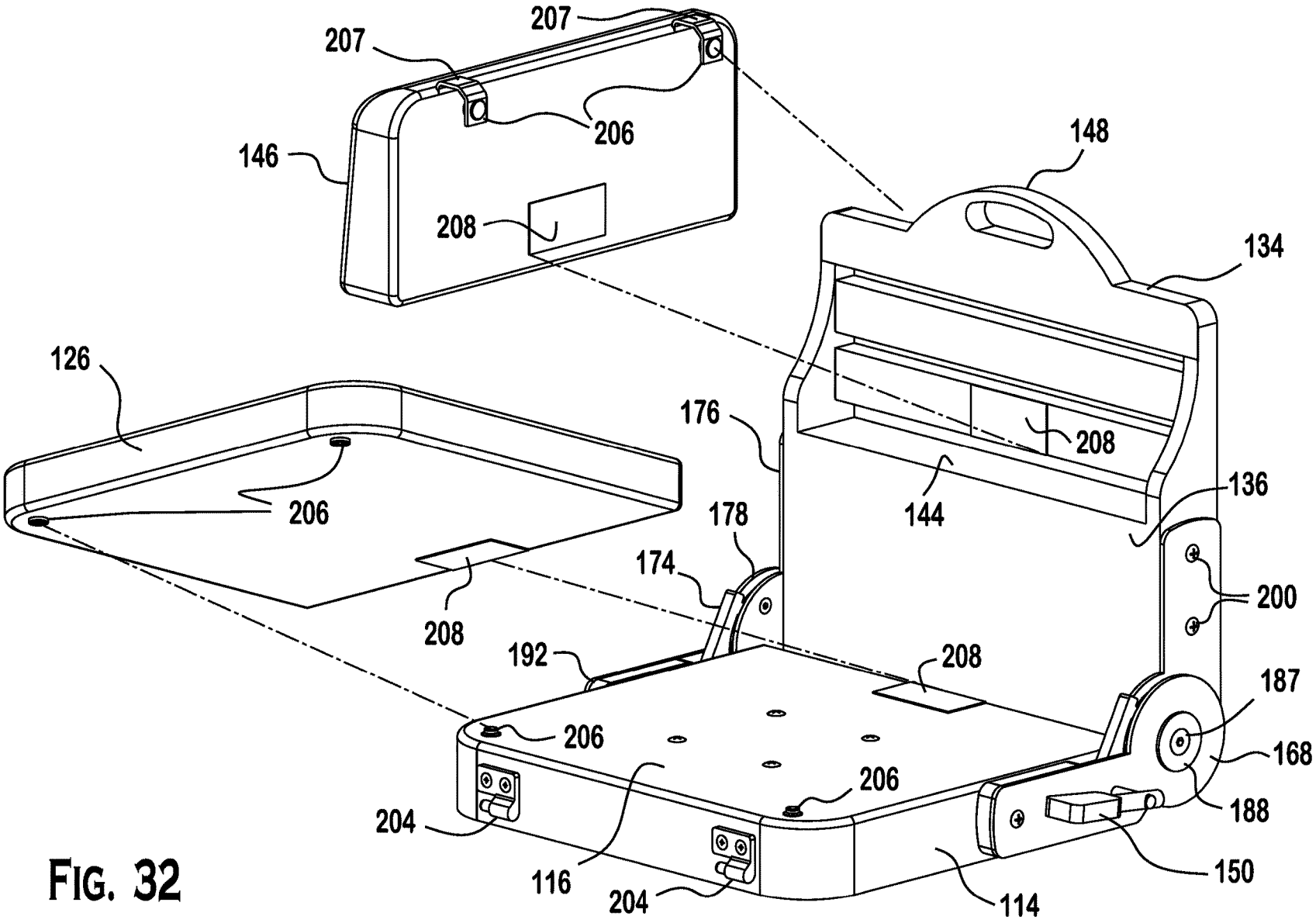

FIG. 32 is perspective view of the boat chair of FIG. 27, with the boat chair in the second open configuration. This figure demonstrates the preferred shape of the inner seat face 116, including snaps 206 and hook-and-loop fastener 208 onto which the seat cushion 126 may be affixed. The figure also demonstrates the preferred shape of the inner back face 136, including a shelf 144 onto which the back rest cushion 146 may be placed and hook-and-loop fastener 208 which may hold the back rest cushion 146 thereto. The back rest cushion 146 may include snaps 206 on snap extensions 207, which will allow the backrest cushion 146 to be held on the inner back face 136 but attached to the snaps 206 on the outer back face 138.

Figure 33:
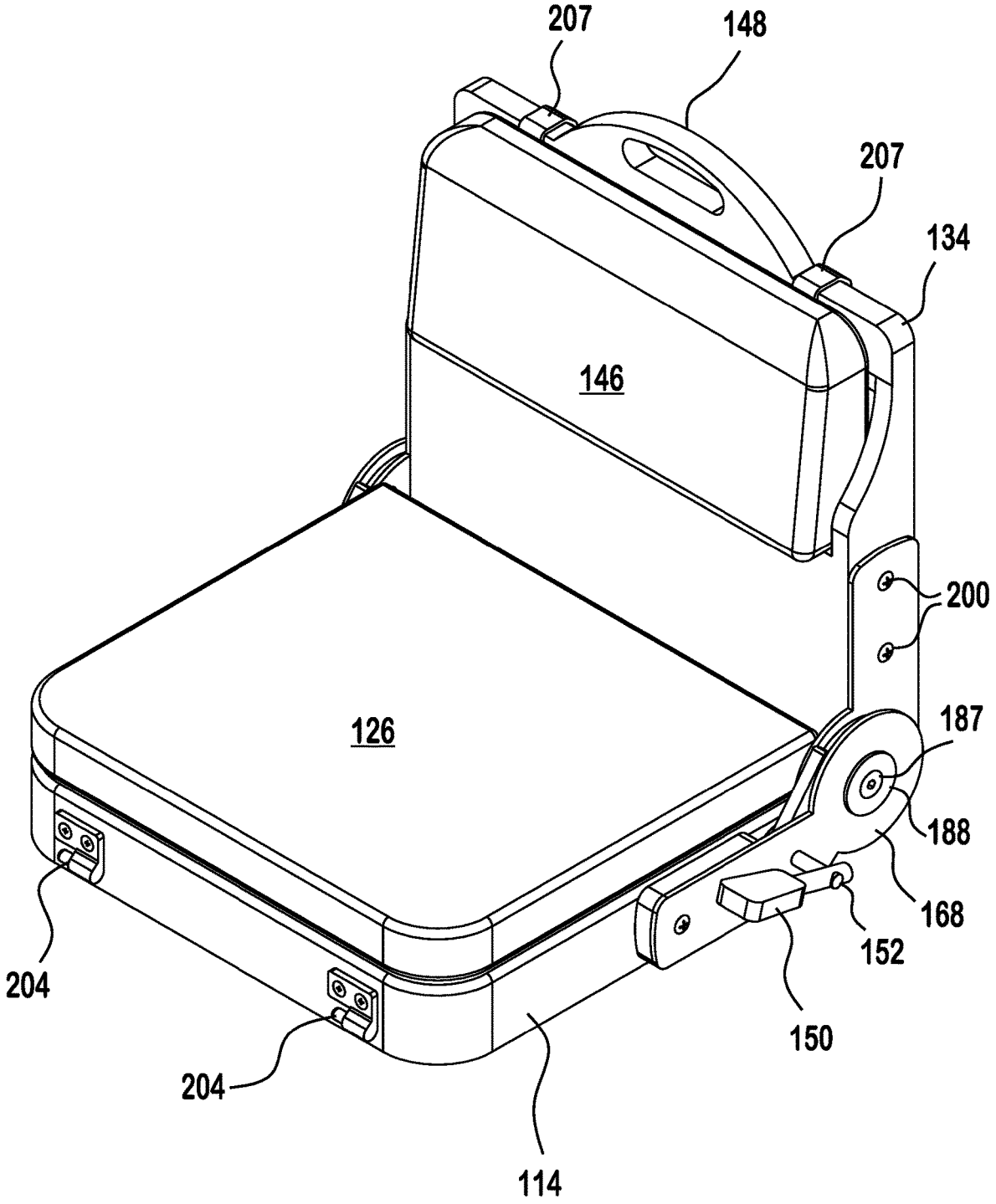

FIG. 33 is an alternate view of FIG. 32, demonstrating the preferred appearance of the boat chair 110 with the seat cushion 126 attached to the inner seat face 116 and the back rest cushion 146 attached to the inner back face 136. The second open configuration may include several angular position of the back support structure 134 in relation to the seat support structure 114. These positions may be adjusted using one of either the first lever 150 or second lever 151 positioned on either or both lateral sides of the boat chair 110. In such embodiments, the locking mechanism 130 may form a pivot axis about which the back support structure 134 might pivot.

Figure 34:
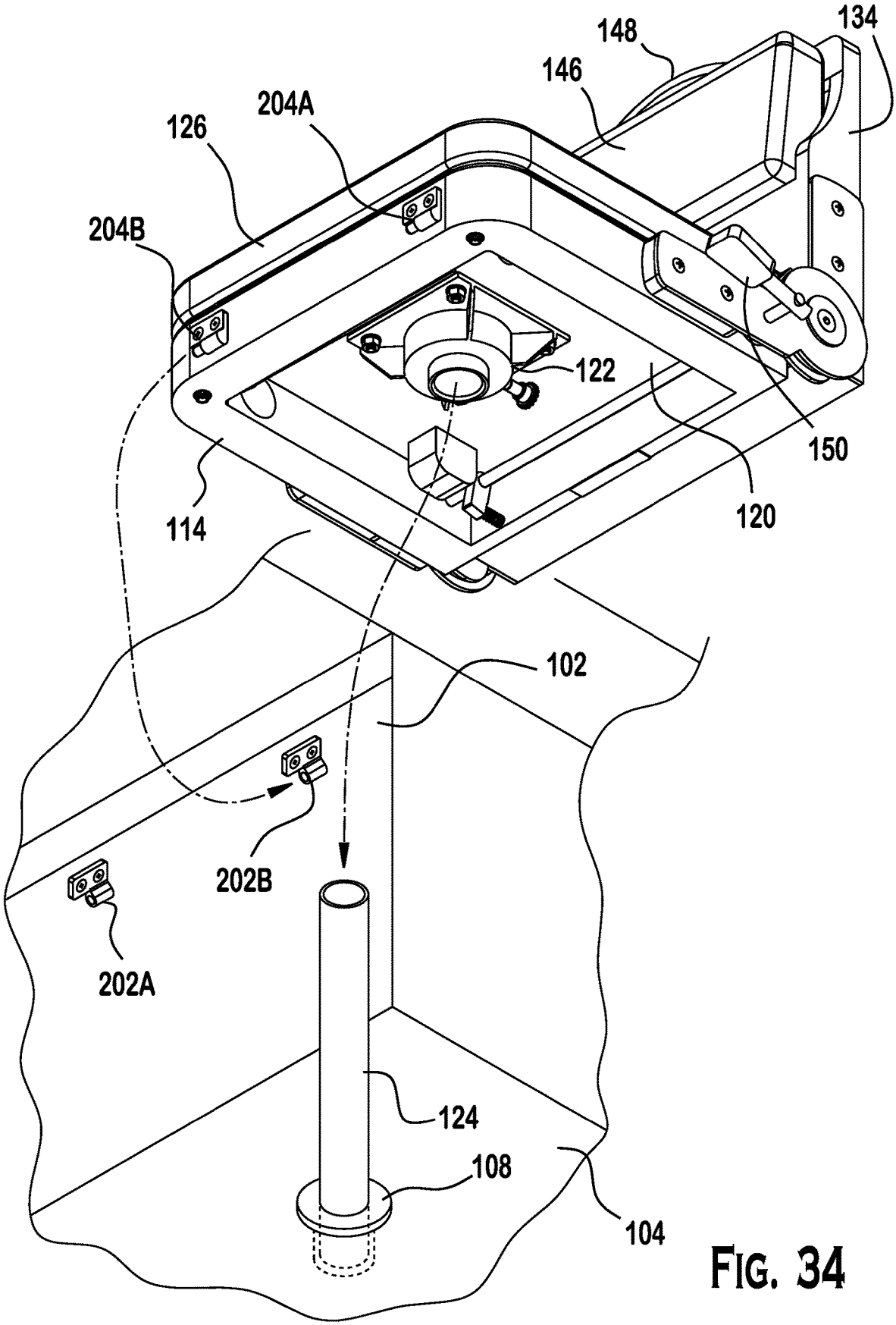

FIG. 34 is a partially broken away perspective view of the boat chair 110 and boat 100, showing one preferred embodiment for attaching the boat chair 110 to the boat 100. The figure shows that the post 124 may be placed into a mounting mechanism 108 on the boat 100, preferably located in the boat decking 104. The boat seat 110 may then be lowered onto the post 124 such that the post 124 is partially inserted into the pedestal 122. The boat chair 110 may then pivot about the post 124 until the seat connectors 204A and 204B connect with their respective fixed connectors 202A and 202B positioned on the bulkhead structure 102 of the boat 100.

Figure 35:
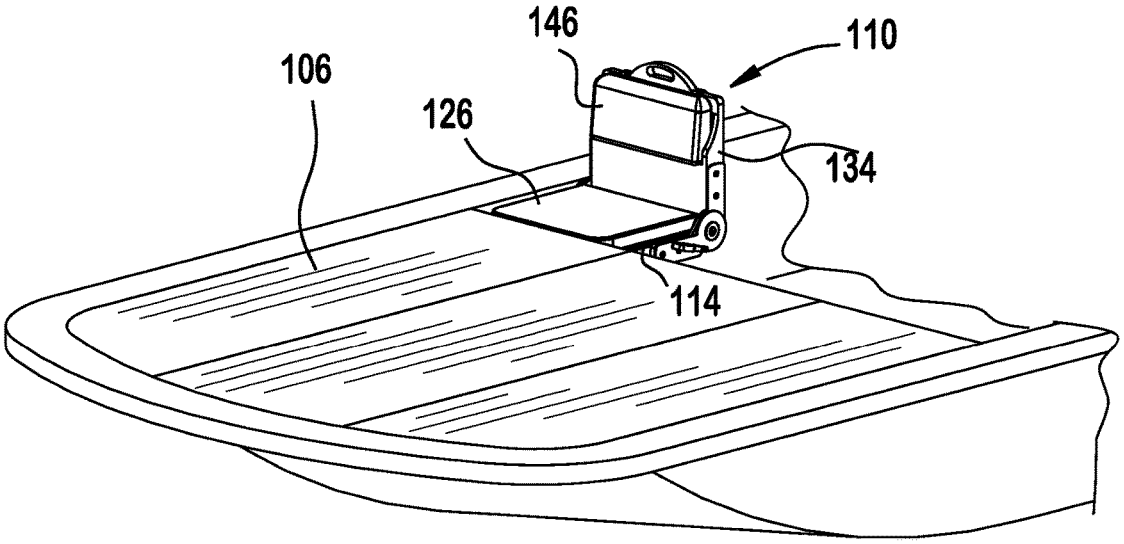

FIG. 35 is a partially broken away perspective view of the boat 100 and boat chair 110 of FIG. 34, showing a preferred position of the boat chair 110 proximate to the bulkhead structure 102 of the boat 100, including the prow and bulwarks of the boat 100. The figure shows the back support structure 134 in an approximate 90 degree angle in relation to the seat support structure 114, with the seat support structure 114 generally of the same height as the bulkhead structure 102 comprising the prow, which may be covered in boat cushions 106.

Figure 36:
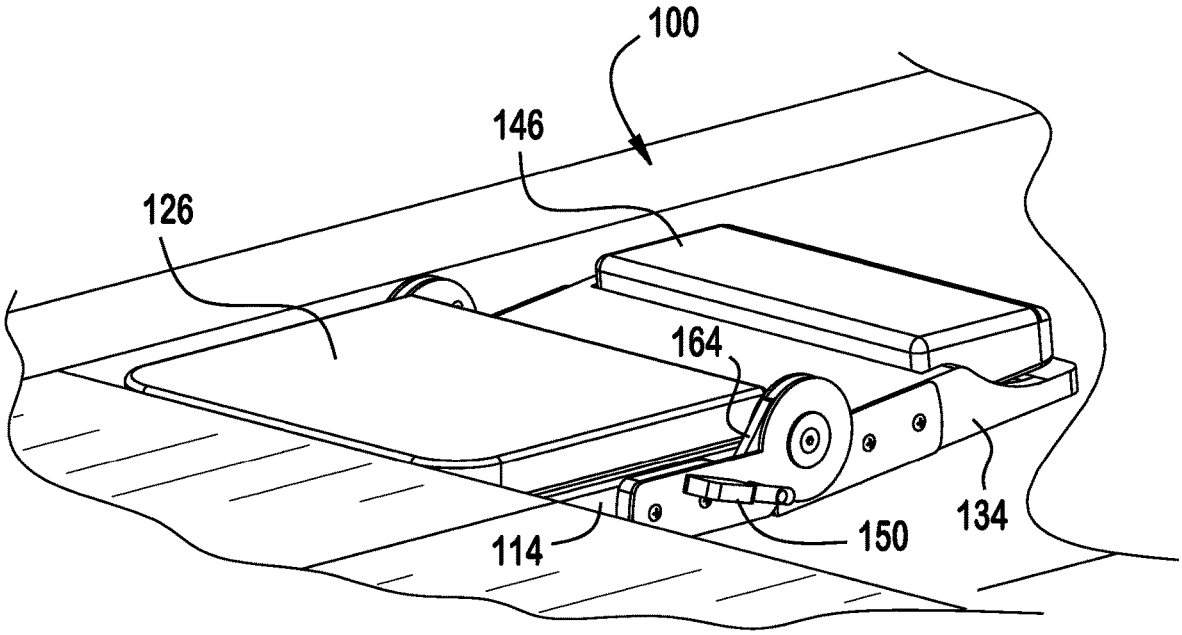

FIG. 36 is a partially broken away perspective view of the boat 100 and boat chair 110 of FIG. 34, showing the back support structure 134 in an approximate 180 degree angle in relation to the seat support structure 114, with the seat support structure 114 generally of the same height as the bulkhead structure 102 comprising the prow, which may be covered in boat cushions 106. This configurations may allow a person to fully recline on the boat seat 110 and prow. In an alternate preferred configuration, the seat cushion 126 and back rest cushion 146 may be removed to allow the boat chair 110 to function as a table.

Figure 37:
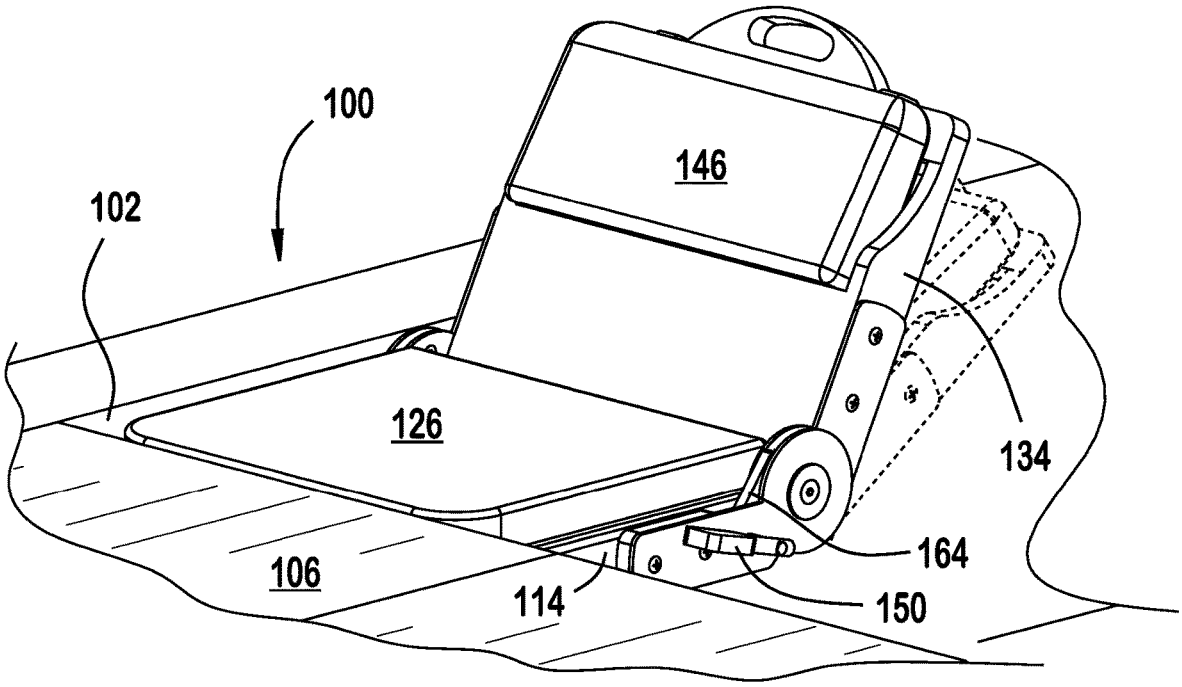

FIG. 37 is a partially broken away perspective view of the boat 100 and boat chair 110 of FIG. 36, showing the back support structure 134 raising from the approximate 180 degree angle to an intermediate position between 90 degrees and 180 degrees in relation to the seat support structure 114 through the activation of the lever 150. This allows for customizability of the position of the back support structure 134 in relation to the seat support structure 114.

Figure 38:
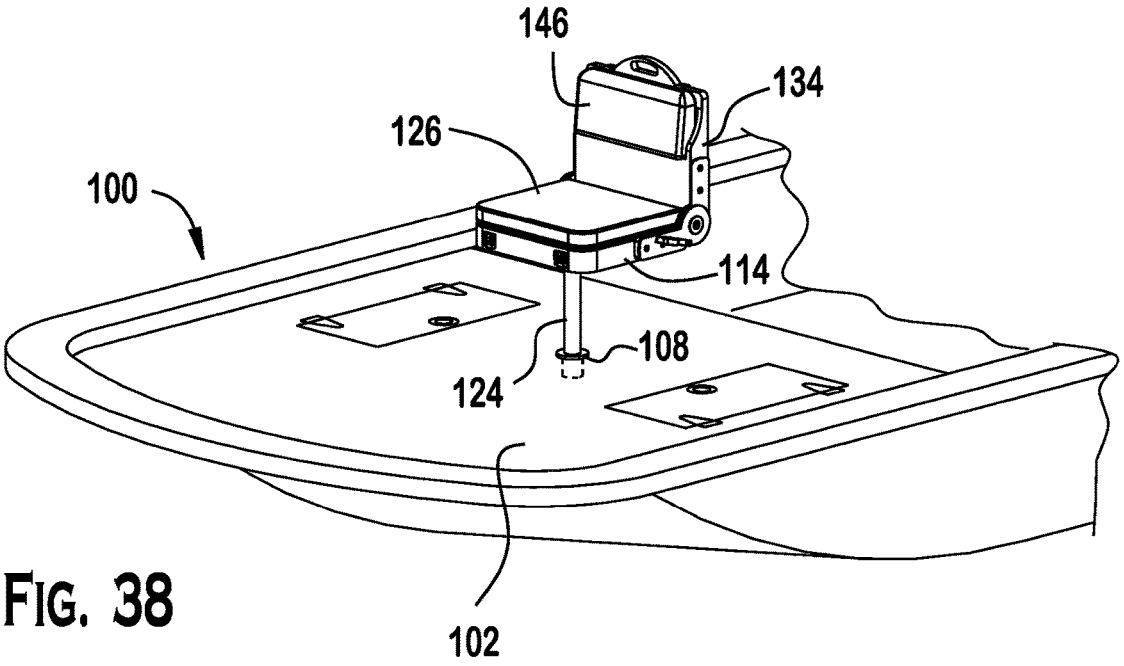

FIG. 38 is a partially broken away perspective view of the boat 100 and boat chair 110 showing that the post 124 may be place into a mounting mechanism 108 located on the bow of the boat 100. The boat seat 110 may then be lowered onto the post 124 such that the post 124 is partially inserted into the pedestal 122. In such a configuration, the boat chair 110 may be more useful for fishing.

Figure 39A:
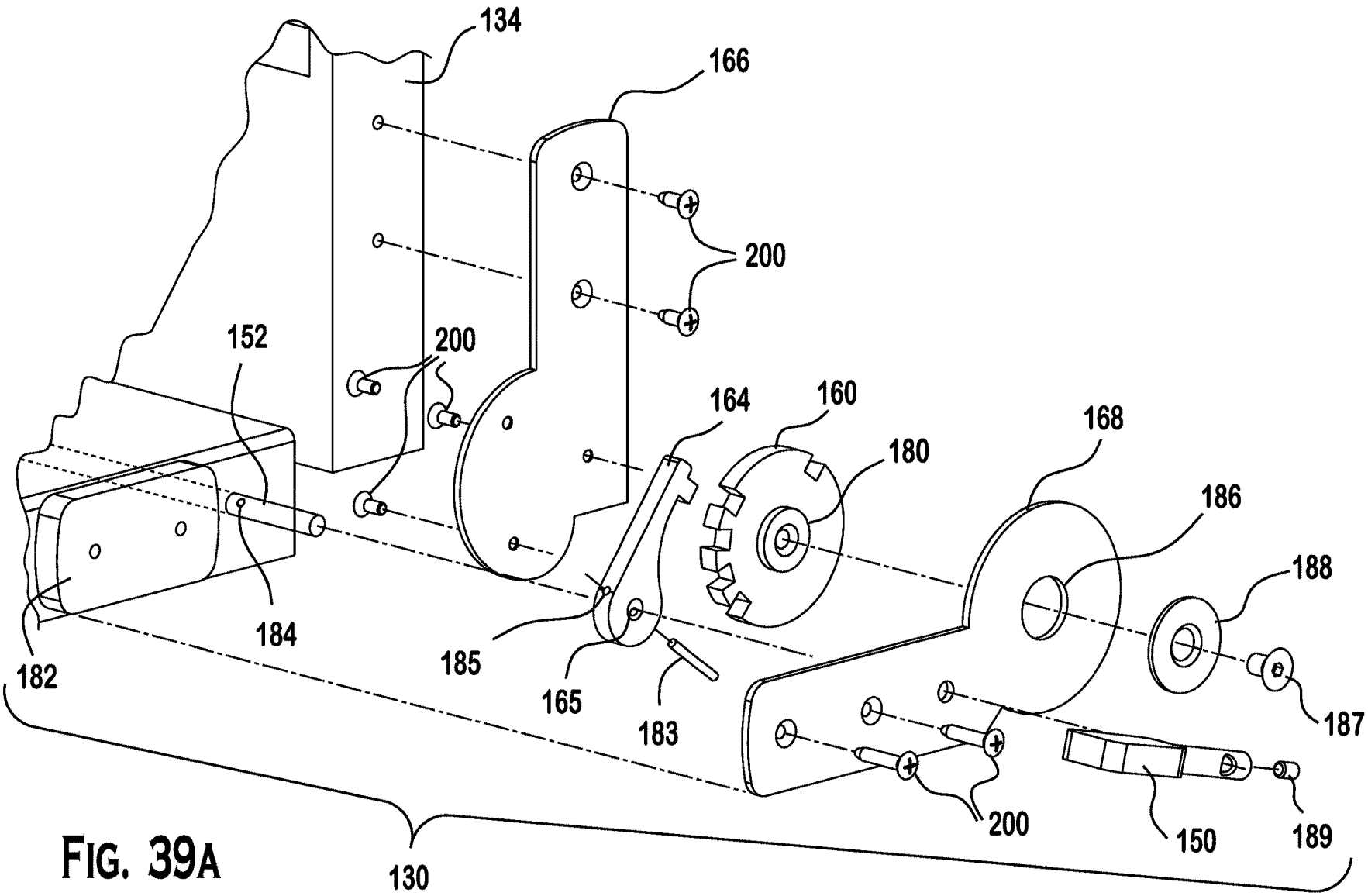

FIG. 39A is an exploded view of a portion of a preferred embodiment of the locking mechanism 130, showing a preferred embodiment of the locking mechanism 130 which may include the depicted components along the right side of the outer back face 138. In such an embodiment, the locking mechanism 130 may form a pivot axis about which the back support structure 134 may pivot. The locking mechanism 130 may include a first mounting brace 166 affixed to the back support structure 134 using a plurality of fasteners 200. Fasteners 200 may also affix the first indexing disc 160 to the first mounting brace 166. The first indexing disc 160 preferably forms a first plurality of notches 162 and a first boss 180, a raised portion of the first indexing disc 160. A first hinge plate 168 may be placed against the first indexing disc 160 such that the first boss 180 may be fit into the first plate aperture 186 and held therein, while still being allowed to rotate, by a first retaining washer 188 and a first rivet 187. A portion of the actuating rod 152 preferably extends out of the seat support structure 114. This portion of the actuating rod 152 may be inserted through a first catch arm aperture 165 in the first catch arm 164 and held therein by a first pin 183, which may be inserted through both the first catch arm pin hole 185 and first actuating rod pin hole 184. The first pin 183 ensures that the first catch arm 164 rotates within the actuating rod 153. The first catch arm 164 is configured to lock into anyone of the first plurality of notches 162 in the first indexing disc 160. The actuating rod 152 preferably extends through the first catch arm aperture 165 to allow it to also pass through the first hinge plate 168 and end within the first lever 150. The first lever 150 may be held in a fixed position on the actuating rod 152 by a first lever locating pin 189, allowing rotating of the first lever 150 to rotate both the actuating rod 152 and the first catch arm 164 at the same time. This allows the locking action to be controlled via the lever. The first hinge plate 168 be affixed to a first mounting boss 182 on the seat support structure 114, holding the first hinge plate 168 thereto and enclosing the locking mechanism. Those of ordinary skill in the art will appreciate from this disclosure that a mirror image mechanism may include in the place of or in addition to the one picture herein on the opposite side of the boat seat 110 without exceeding the scope of this disclosure. Such a mirror image mechanism is shown in FIG. 39B.

Figure 39B:
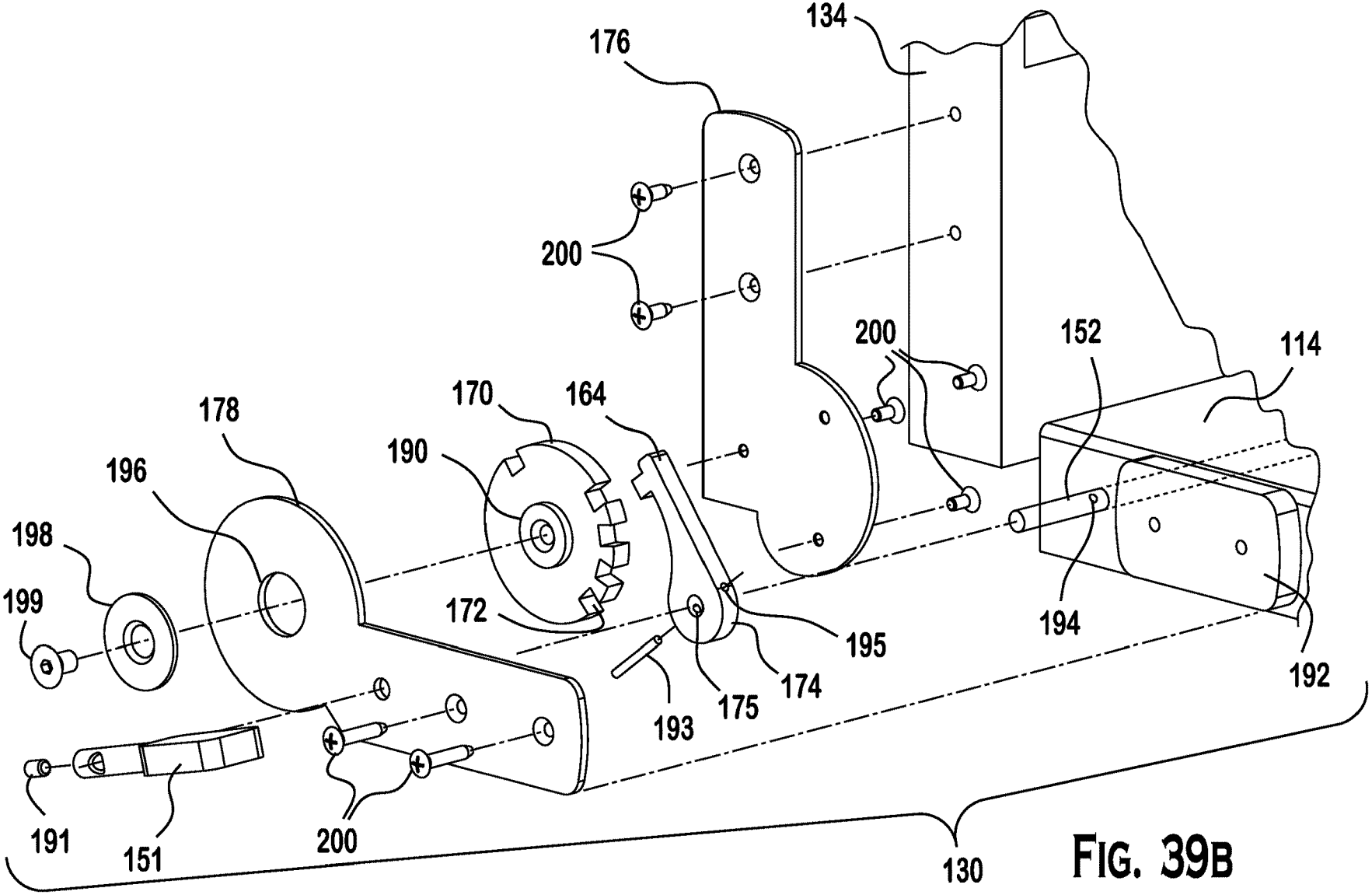

FIG. 39B is an exploded view of a portion of a preferred embodiment of the locking mechanism 130, showing a preferred embodiment of the locking mechanism 130 which may include the depicted components along the left side of the outer back face 138. In such an embodiment, the locking mechanism 130 may form a pivot axis about which the back support structure 134 may pivot. The locking mechanism 130 may include a second mounting brace 176 affixed to the back support structure 134 using a plurality of fasteners 200. Fasteners 200 may also affix the second indexing disc 170 to the second mounting brace 176. The second indexing disc 170 preferably forms a second plurality of notches 172 and a second boss 190, a raised portion of the second indexing disc 170. A second hinge plate 178 may be placed against the second indexing disc 170 such that the second boss 190 may be fit into the second plate aperture 196 and held therein, while still being allowed to rotate, by a second retaining washer 198 and a second rivet 199. A portion of the actuating rod 152 preferably extends out of the seat support structure 114. This portion of the actuating rod 152 may be inserted through a second catch arm aperture 175 in the second catch arm 174 and held therein by a second pin 193, which may be inserted through both the second catch arm pin hole 195 and second actuating rod pin hole 194. The second pin 193 ensures that the second catch arm 174 rotates within the actuating rod 153. The second catch arm 174 is configured to lock into any one of the second plurality of notches 172 in the second indexing disc 170. The actuating rod 152 preferably extends through the second catch arm aperture 175 to allow it to also pass through the second hinge plate 178 and end within the second lever 151. The second lever 151 may be held in a fixed position on the actuating rod 152 by a second lever locating pin 191, allowing rotation of the second lever 151 to rotate both the actuating rod 152 and the second catch arm 174 at the same time. This allows the locking action to be controlled via the second lever 151. The second hinge plate 178 be affixed to a second mounting boss 192 on the seat support structure 114, holding the second hinge plate 178 thereto and enclosing the locking mechanism 130. Those of ordinary skill in the art will appreciate from this disclosure that a mirror image mechanism may include in the place of or in addition to the one picture herein on the opposite side of the boat seat 110 without exceeding the scope of this disclosure. Such a mirror image mechanism is shown in FIG. 39A.

Figure 40:
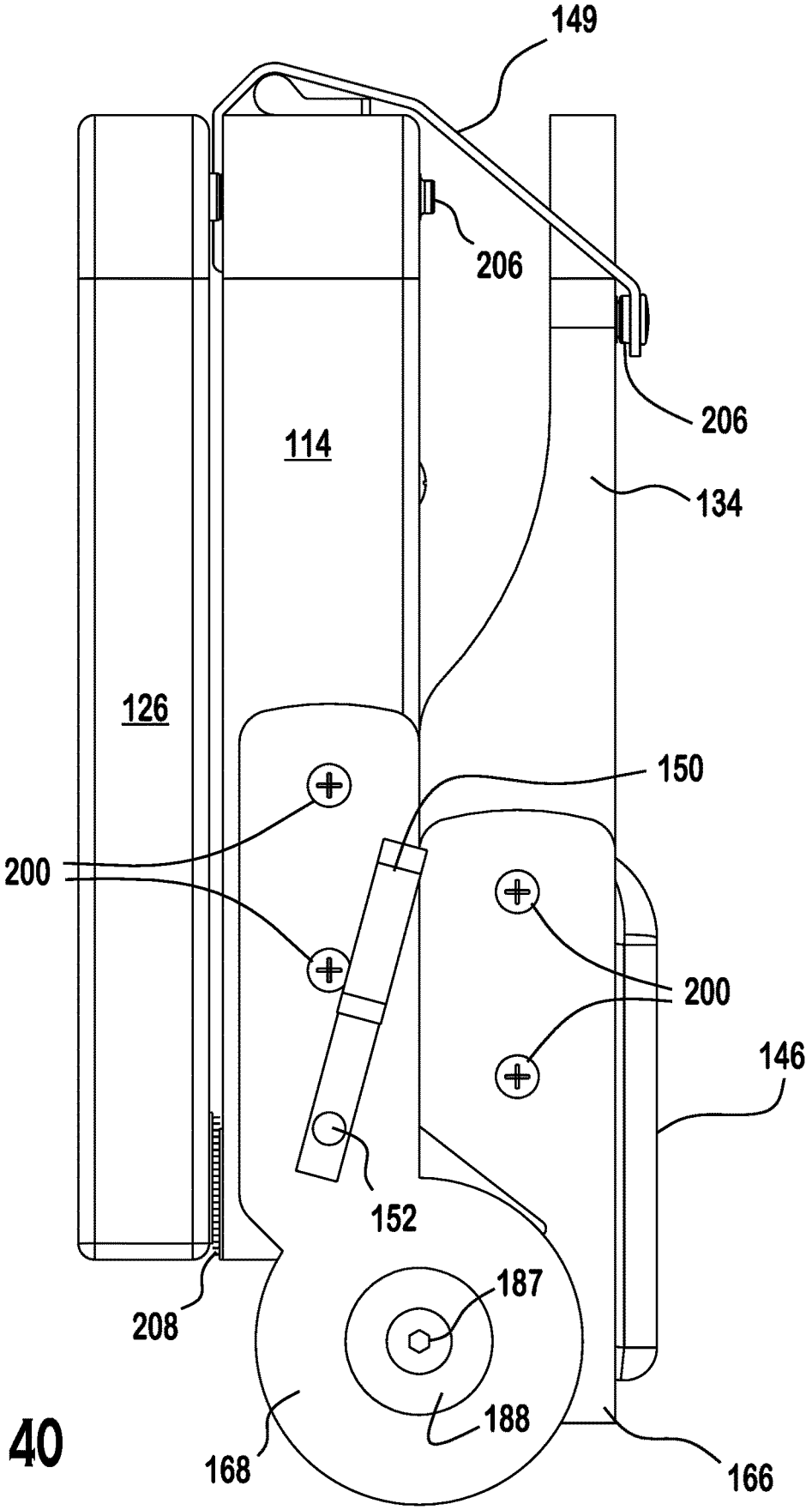

FIG. 40 is a right side elevational view of the boat chair 110 of FIG. 27 of the boat chair 110 in the first compact configuration. The figure demonstrates the positioning of the first mounting brace 166 and first hinge plate 168 when the boat chair 110 is in the first compact configuration. In such a configuration, the first catch arm 164 is in the first notch of the first plurality of notches 162A (as in FIG. 44) to hold boat chair 110 in the first compact configuration.

Figure 41:
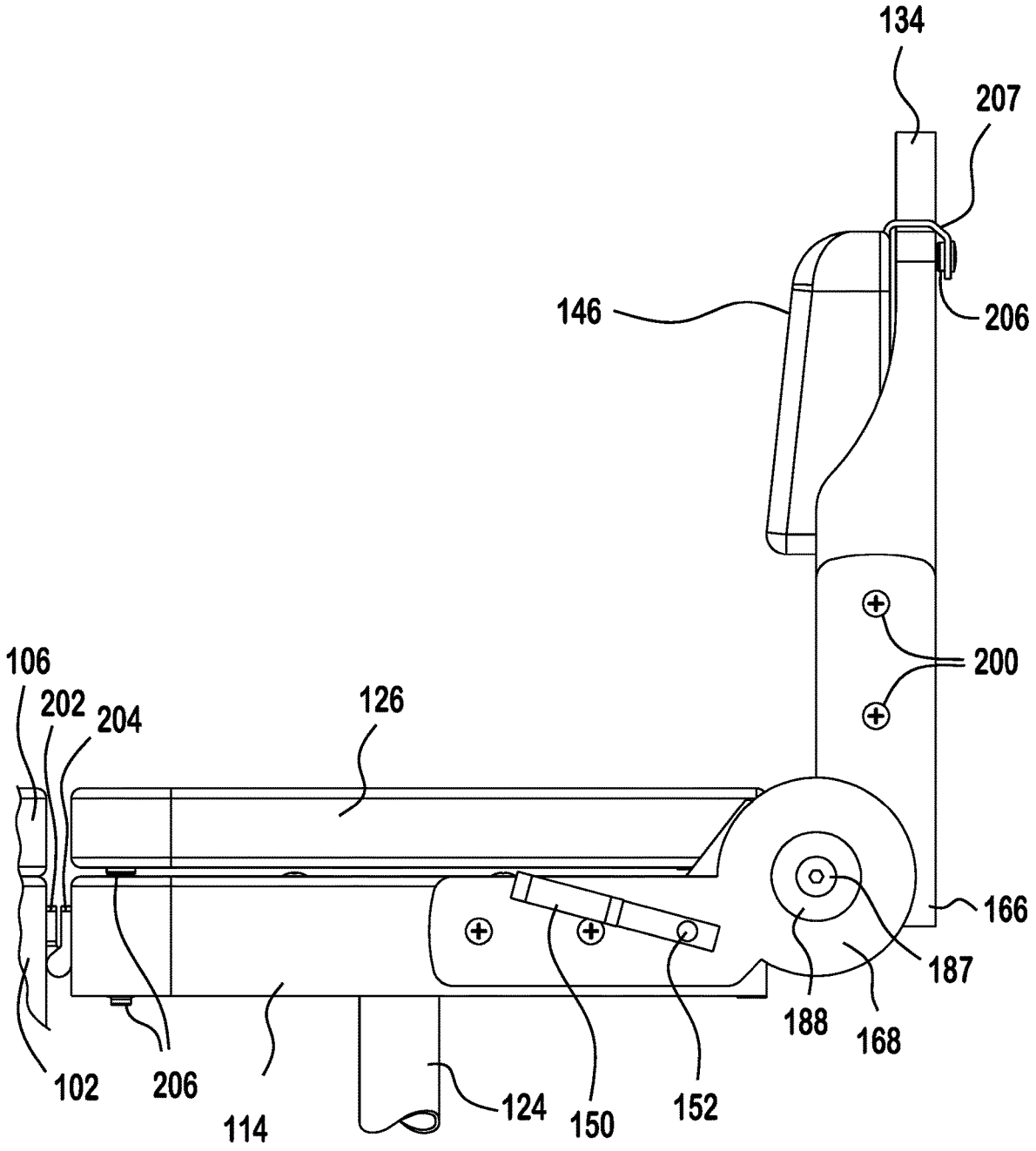

FIG. 41 is a partial right side elevational view of the boat chair 110 of FIG. 27 in the second open configuration when attached to a boat 100. The figure shows the boat chair 100 when the first catch arm 164 is in the second of the first plurality of notches 162B (as in FIG. 45) to hold the back support structure 134 in a roughly 90 degree position in relation to the seat support structure 114.

Figure 42:
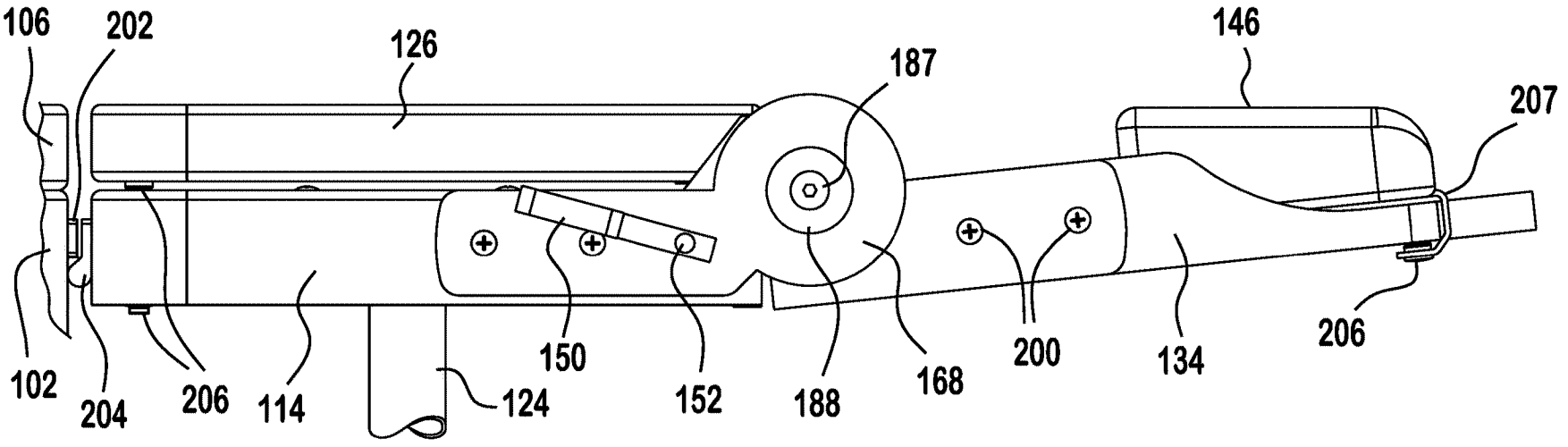

FIG. 42 is a partial right side elevational view of the boat chair 110 of FIG. 27 in the second open configuration when attached to a boat 100. The figure shows the boat chair 100 when the first catch arm 164 is in the fifth of the first plurality of notches 162E (as in FIG. 48) to hold the back support structure 134 in a roughly 174 degree position in relation to the seat support structure 114.

Figure 43:
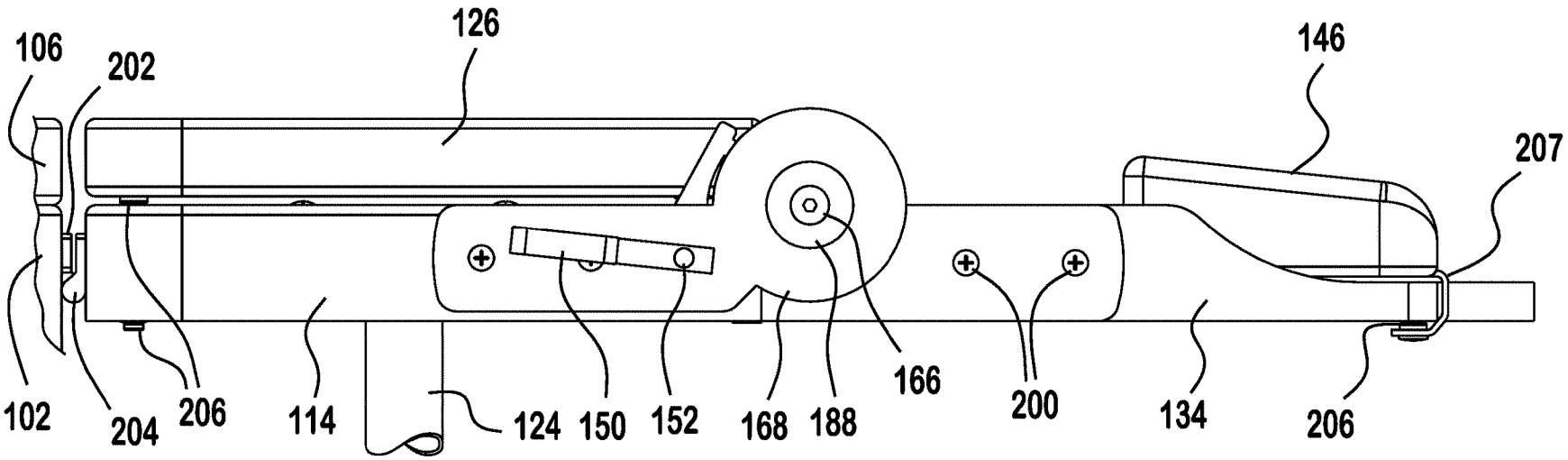

FIG. 43 is a partial right side elevational view of the boat chair 110 of FIG. 27 in the second open configuration when attached to a boat 100. The figure shows the boat chair 100 when the first catch arm 164 has been pushed past the fifth of the first plurality of notches 162E (as in FIG. 49) to hold the back support structure 134 in a full 180 degree position in relation to the seat support structure 114.

Figure 44:
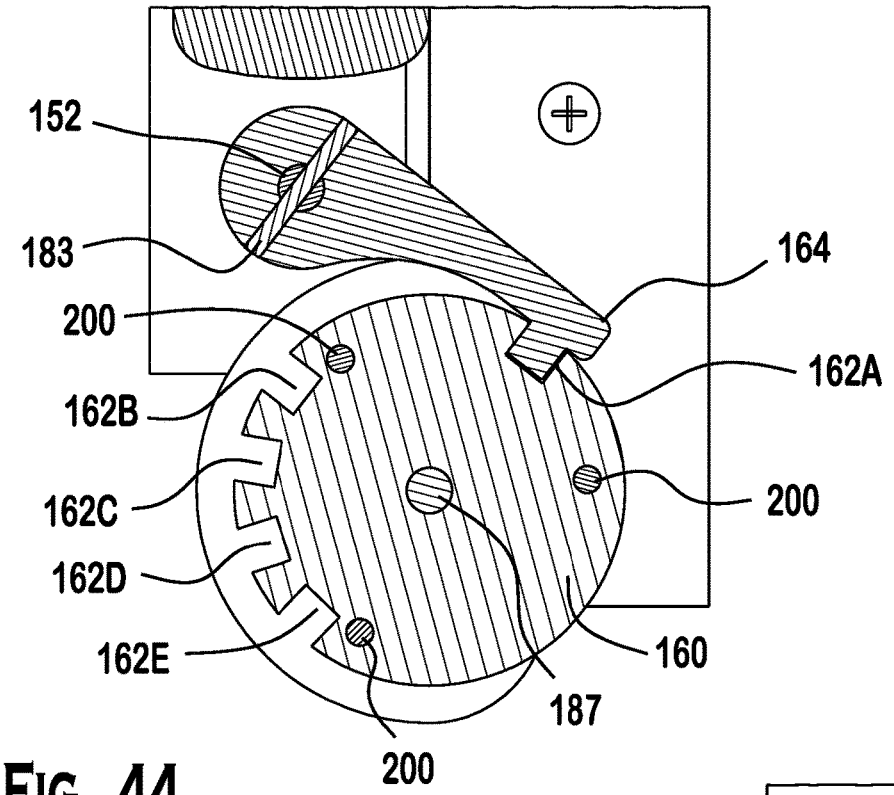

FIG. 44 is a cross sectional view of the boat chair 110 of FIG. 27 in the first compact configuration. The figure demonstrates how the first catch arm 164 may sit in the first notch of the first plurality of notches 162A to hold boat chair 110 in the first compact configuration.

Figure 45:
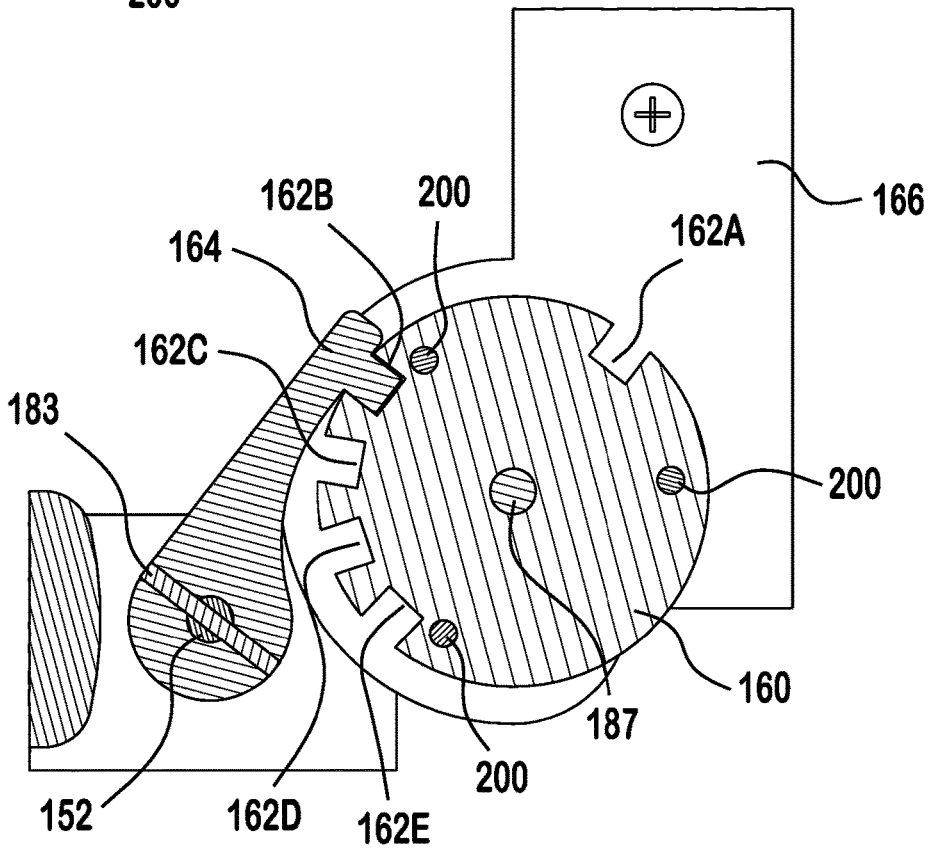

FIG. 45 is a cross sectional view of the boat chair 110 of FIG. 27 in the second open configuration when attached to a boat 100. The figure shows the boat chair 100 when the first catch arm 164 is in the second of the first plurality of notches 162B to hold the back support structure 134 in a roughly 90 degree position in relation to the seat support structure 114.

Figure 46:
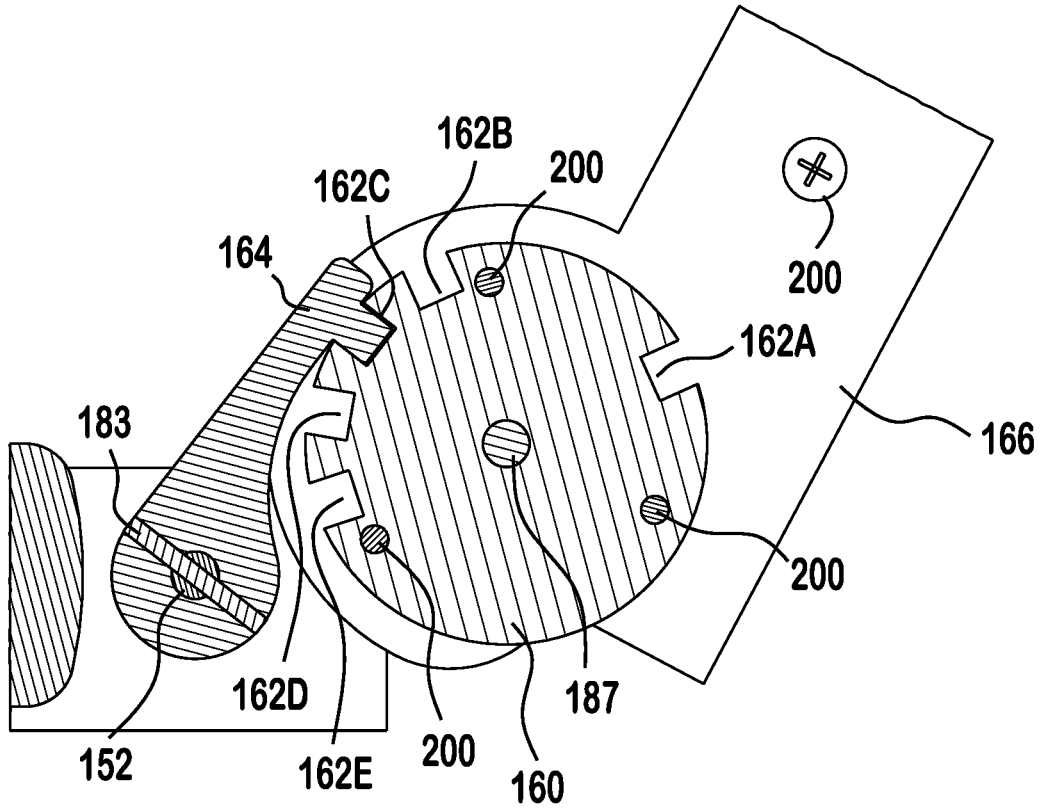

FIG. 46 is a cross sectional view of the boat chair 110 of FIG. 27 in the second open configuration when attached to a boat 100. The figure shows the boat chair 100 when the first catch arm 164 is in the third of the first plurality of notches 162C to hold the back support structure 134 in a roughly 118 degree position in relation to the seat support structure 114.

Figure 47:
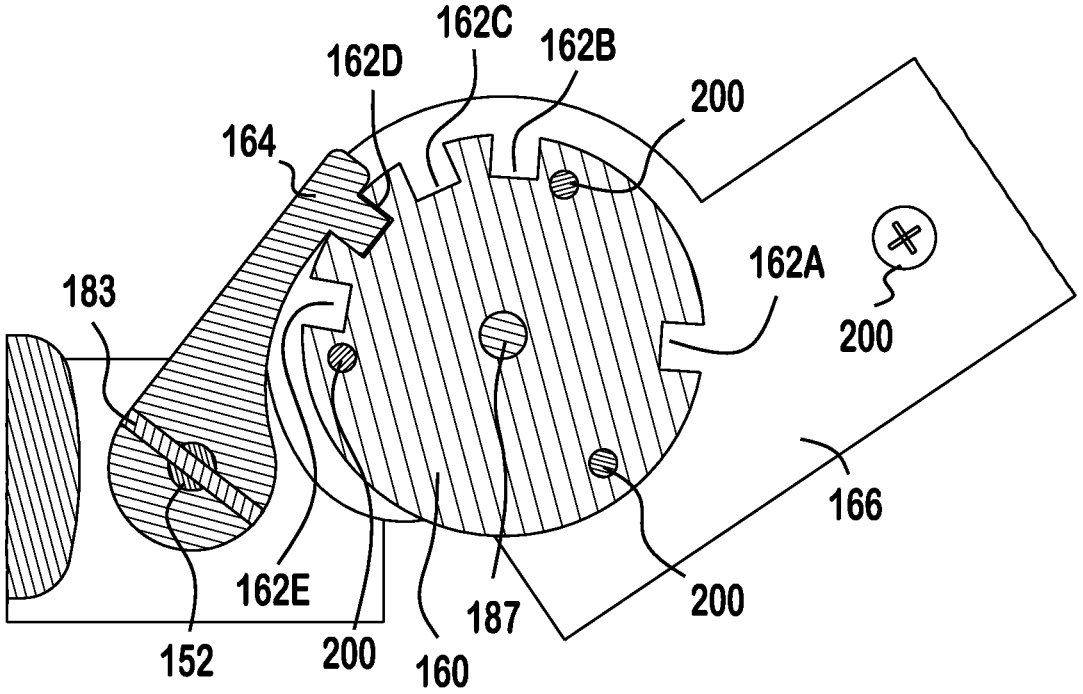

FIG. 47 is a cross sectional view of the boat chair 110 of FIG. 27 in the second open configuration when attached to a boat 100. The figure shows the boat chair 100 when the first catch arm 164 is in the fourth of the first plurality of notches 162D to hold the back support structure 134 in a roughly 146 degree position in relation to the seat support structure 114.

Figure 48:
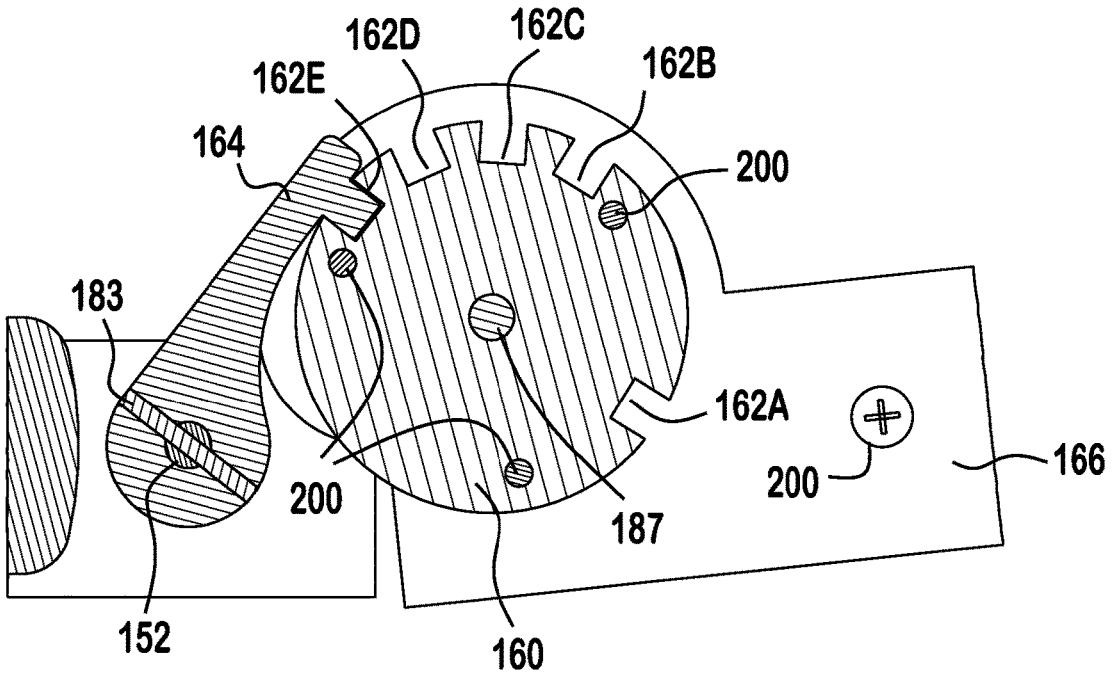

FIG. 48 is a cross sectional view of the boat chair 110 of FIG. 27 in the second open configuration when attached to a boat 100. The figure shows the boat chair 100 when the first catch arm 164 is in the fifth of the first plurality of notches 162E to hold the back support structure 134 in a roughly 174 degree position in relation to the seat support structure 114.

Figure 49:
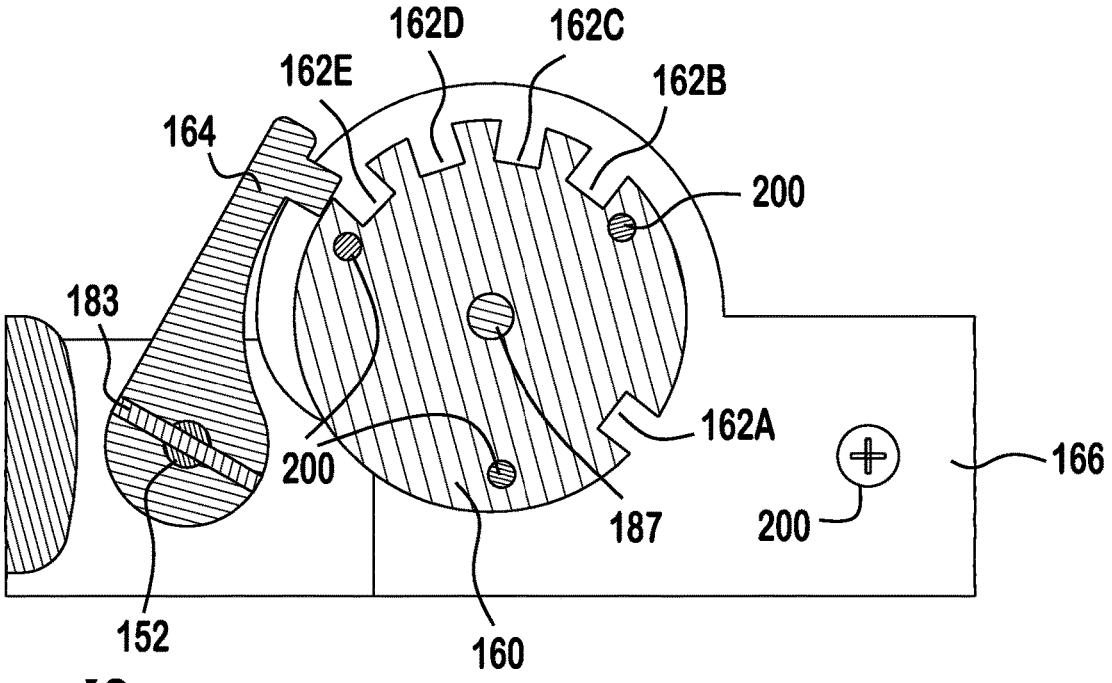

FIG. 49 is a cross sectional view of the boat chair 110 of FIG. 27 in the second open configuration when attached to a boat 100. The figure shows the boat chair 100 when the first catch arm 164 has been pushed past the fifth of the first plurality of notches 162E, placing the back support structure 134 in a full 180 degree position in relation to the seat support structure 114.

Figure 50:
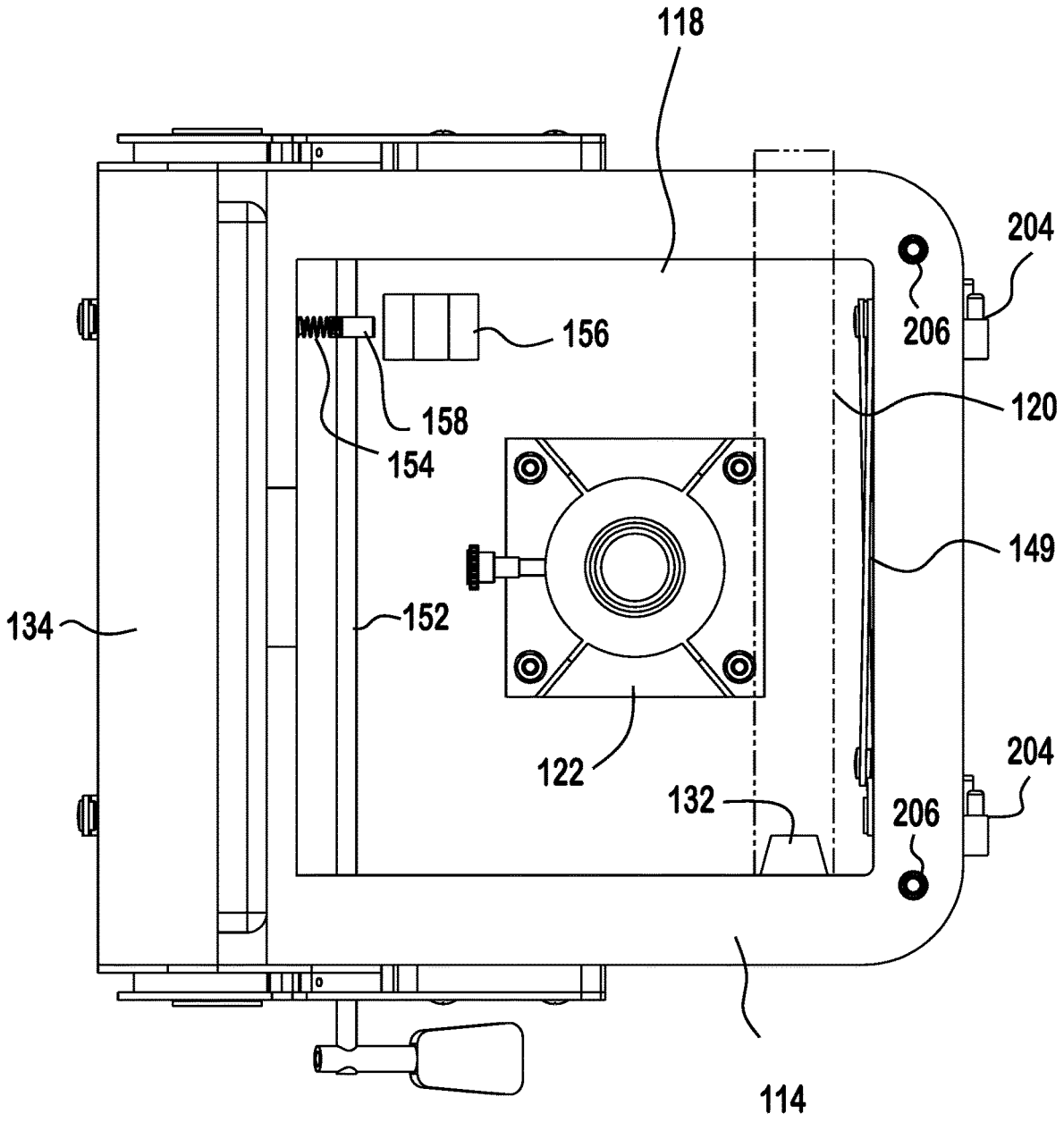

FIG. 50 is a bottom side elevational view of the boat chair 110 of FIG. 27 with the post 124 removed from the cavity 120, demonstrating the preferred position of the post 124 in the cavity 120 using broken lines.

Figure 51:
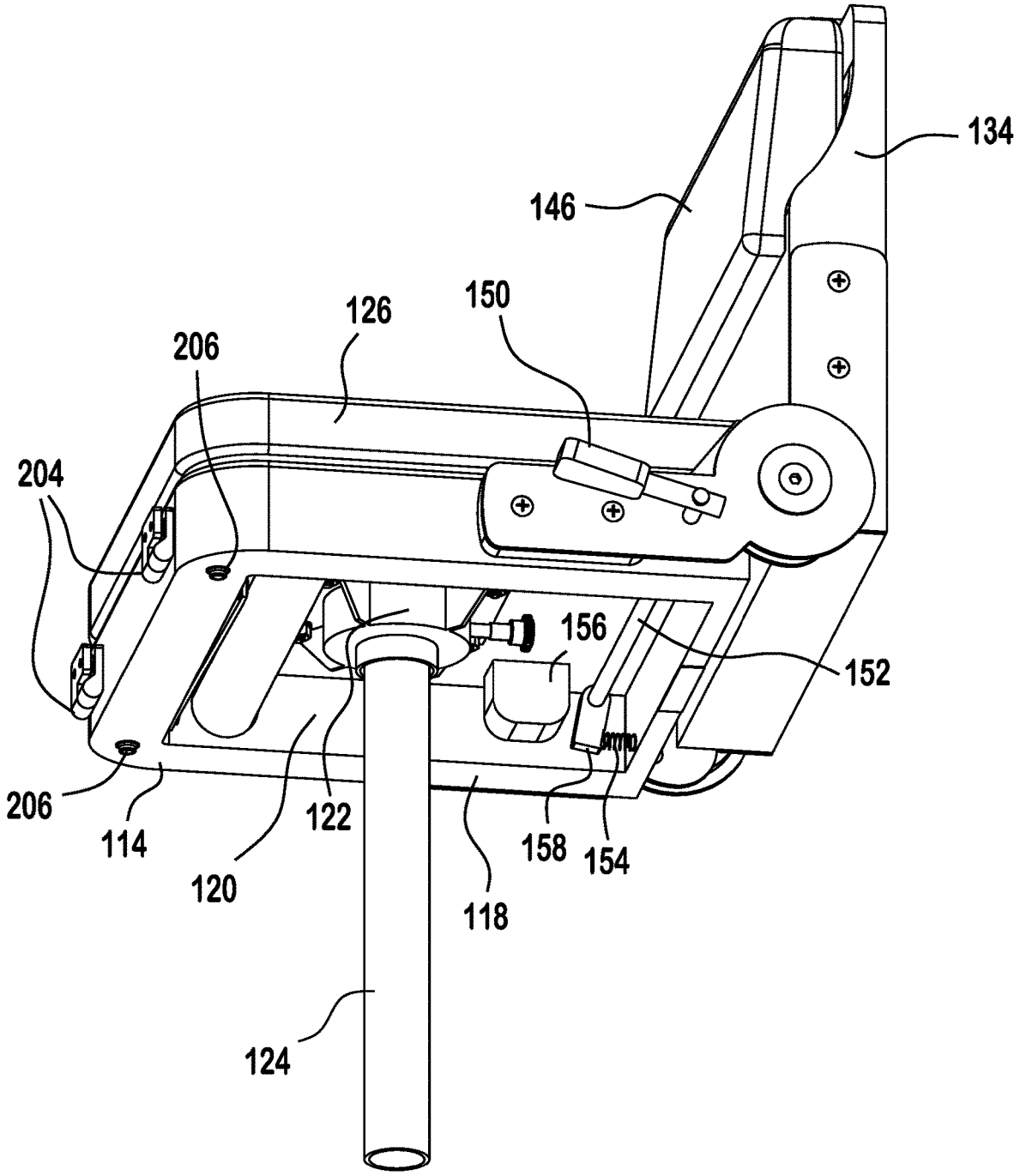

FIG. 51 is a bottom left side elevational view of the boat chair 110 of FIG. 27 with a post 124A attached to the pedestal 122 and a second post 124B in the cavity 120. The figure provides a better view of the preferred positioning of the post 124 in the pedestal 122 and in the cavity 120.

Figure 52:
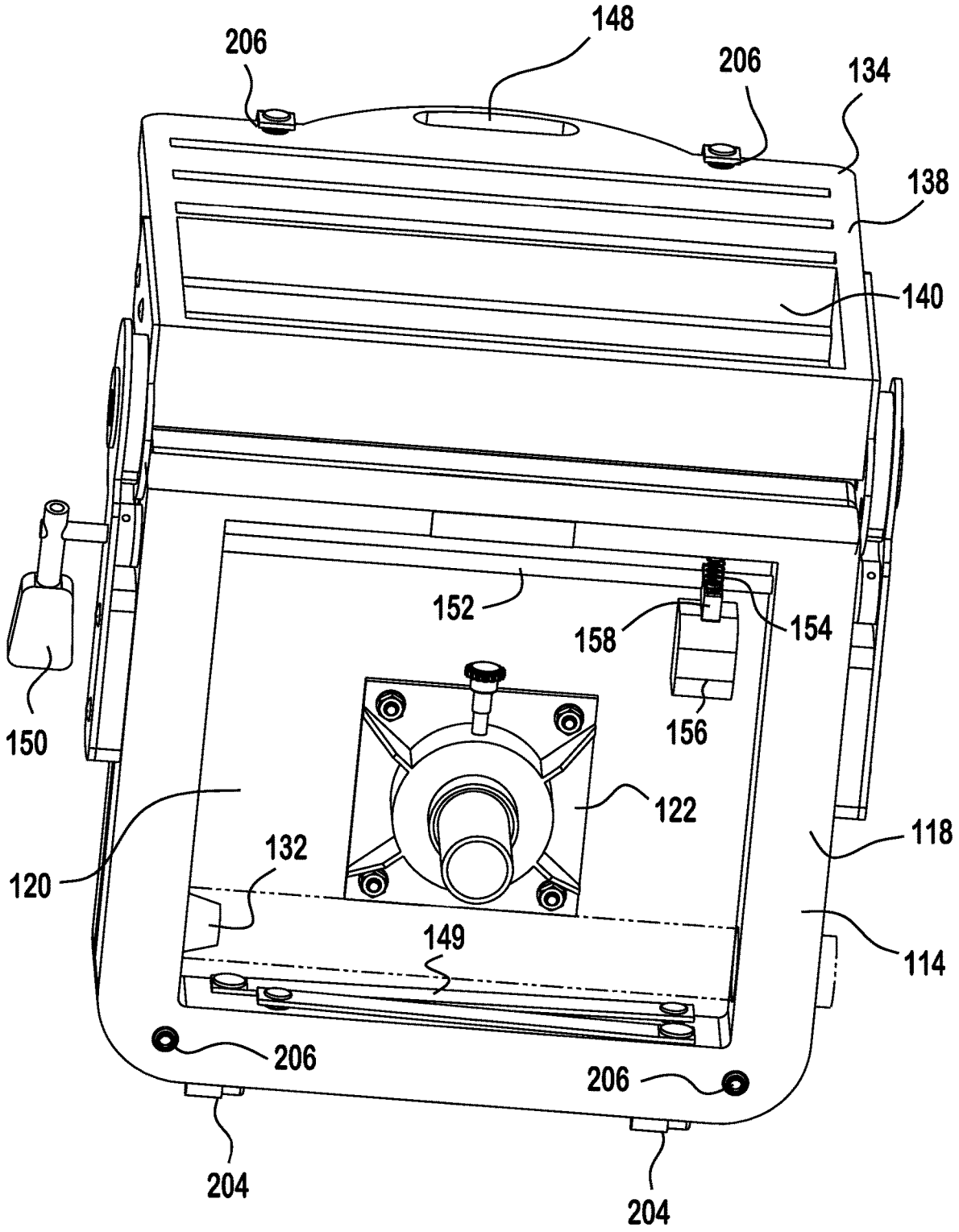

FIG. 52 is bottom rear side elevational view of a preferred embodiment of the boat chair 110, wherein the boat chair 110 has only a first lever 150 on the left side of the boat chair 110.

Figure 53:
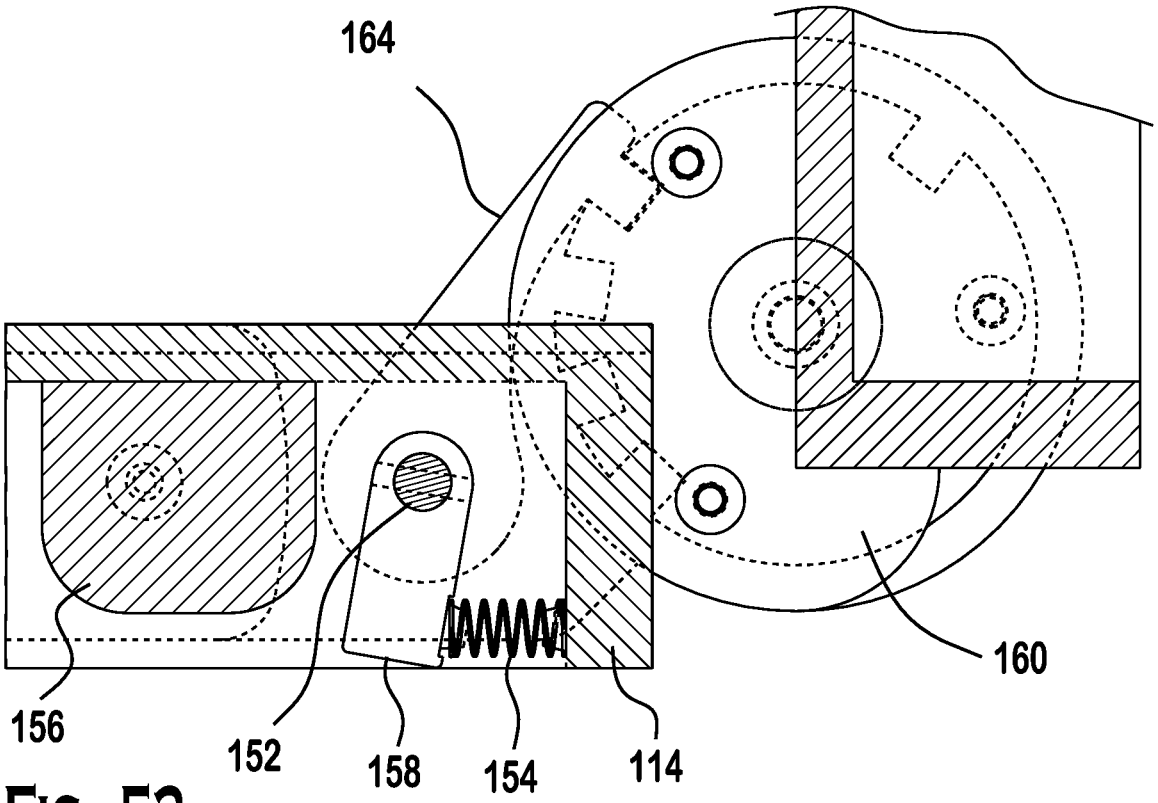

FIG. 53 is a schematic view of a preferred embodiment of the boat chair 110, demonstrating the preferred positioning of the actuating rod 152, biasing member 154 and pivot stop 156 in the cavity 120. The biasing member 154 may keep the first catch arm 164 from moving from the preferred one of the first plurality of notches 162 in the first indexing disc 160.

Figure 54:
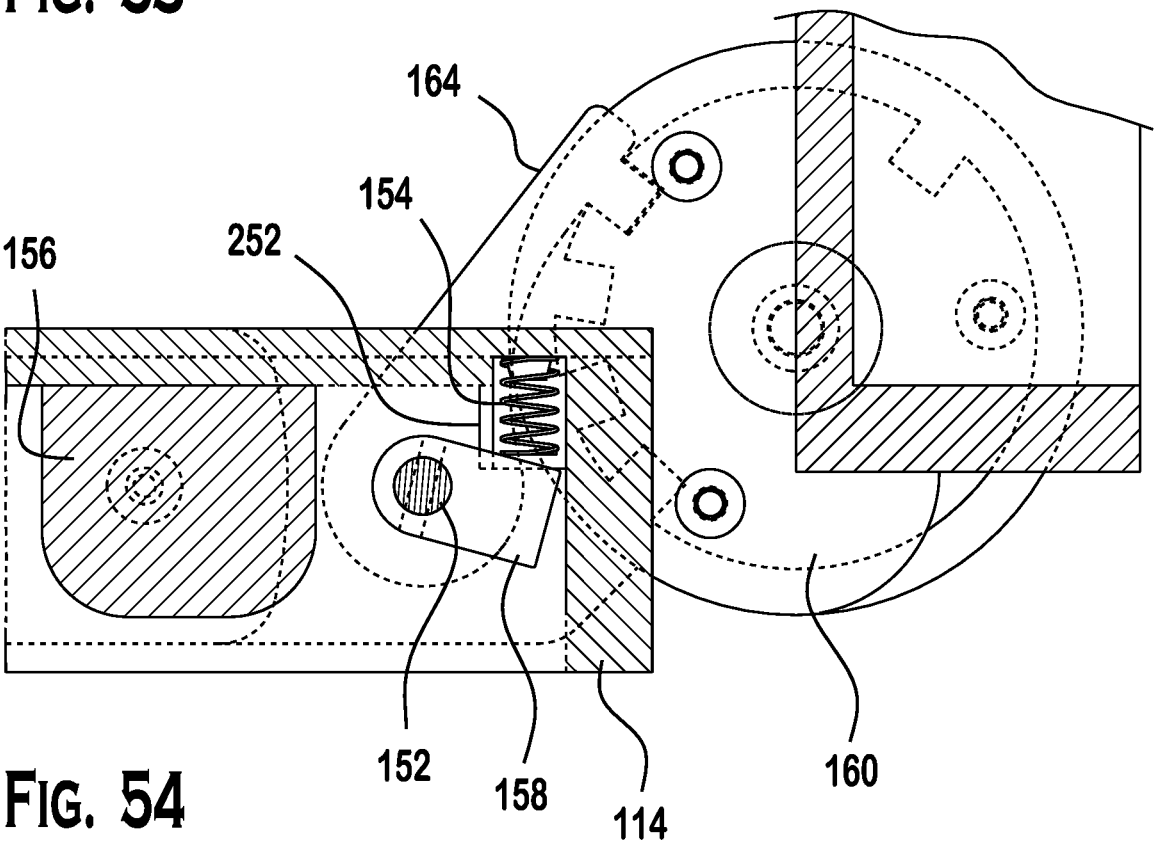

FIG. 54 is a schematic view of an alternate preferred embodiment of the boat chair 110, demonstrating a preferred positioning of the actuating rod 152, biasing member 154 and pivot stop 156 in the cavity 120. In such an embodiment, the biasing member 154 may be held within a biasing member housing 252. The biasing member housing 252 may prevent the biasing member 154 from bending in either lateral direction, but may still allow the pivot arm 158 to contact the biasing member 154 when the actuating rod 152 is turned.

DETAILED DESCRIPTION OF THE PREFERRED EMBODIMENT

Certain terminology is used in the following description for convenience only and is not limiting. The words "right," "left," "up," and "down" designate the directions as they would be understood by a person sitting in the boat chair. The words "outer" and "inner" refer to directions away from and toward, respectively, the geometric center of the boat chair when it is in a first compact position. "Lateral ends" refers to opposite ends of a component along a geometric horizontal axis of the part. The terms "touching" or "contacting" when used in connection with two surfaces is defined as meaning "being positioned anywhere between actual touching of two surfaces to being in facing orientation and within one inch apart." Additionally, the words "a" and "one" are defined as including one or more of the referenced item unless specifically stated otherwise. The terminology includes the words above specifically mentioned, derivatives thereof, and words of similar import.

Figure 1:
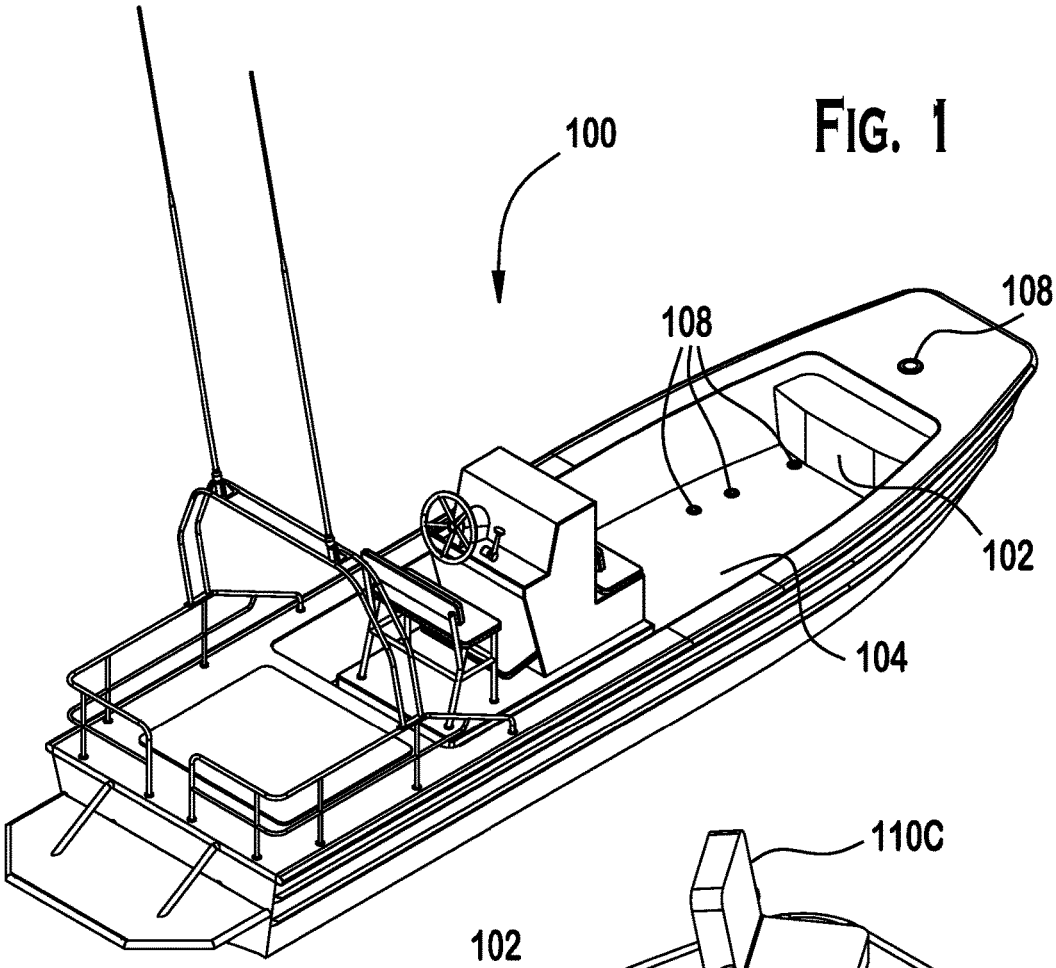
FIG. 1 is a front perspective view of a boat 100 configured for use with the boat chair 110. The figure demonstrates the relative position of the boat decking 104 in relation to the bulkhead structure 102 of the boat 100, and shows the mounting mechanisms 108 which may be included on the boat decking 104.
Figure 2:
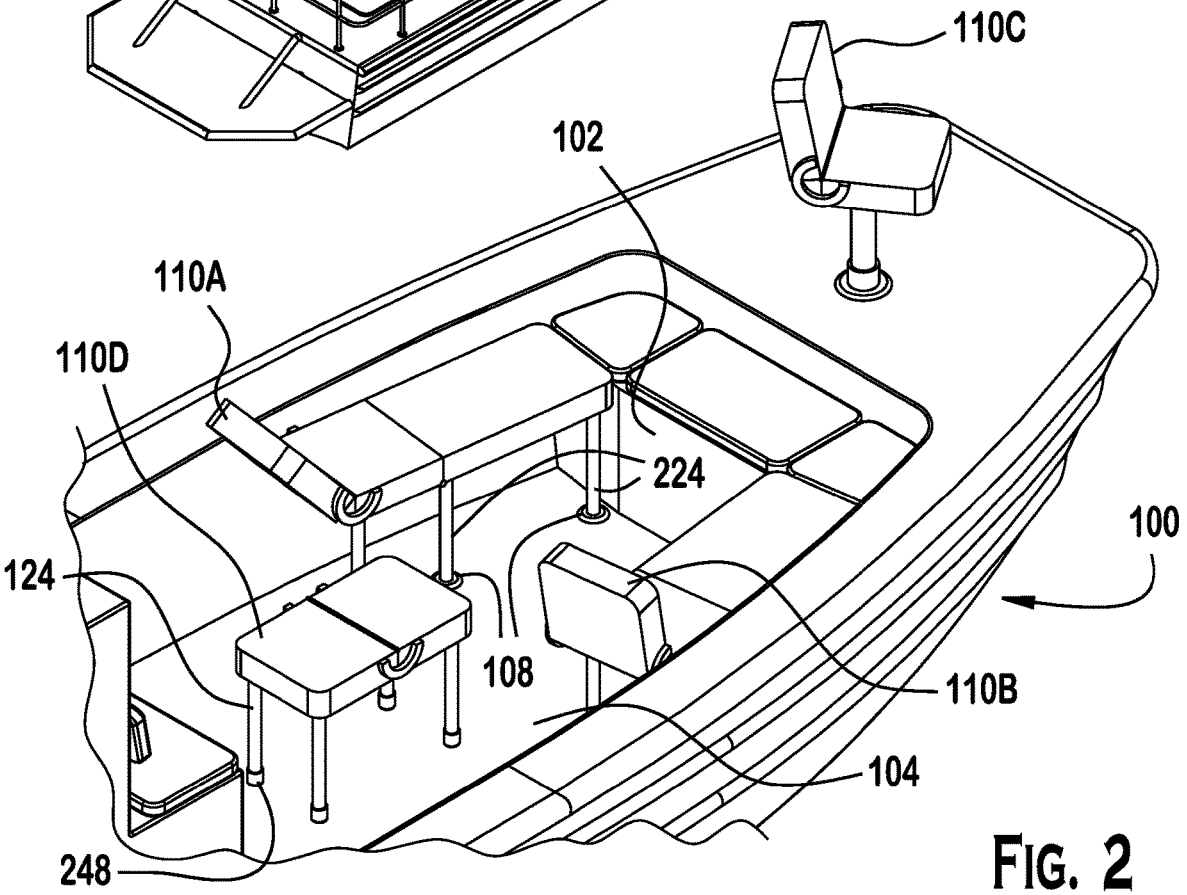
FIG. 2 is a partial front perspective view of a boat 100 configured for use with the boat chair 110, with two boat chairs 110A and 110B of one preferred embodiment being held at a position along the boat cushion 106, a third boat chair 110C of another preferred embodiment free standing on the bow of the boat (to better facilitate fishing), and a fourth boat chair 110D of a further preferred embodiment fully reclined in the 180 degree position to function as a table. It can be seen that the preferred embodiment of 110D may include four posts 124 which may each end in a post foot attachment. The post feet 248 may allow this or other embodiments of the boat chair 110D to be used on the boat 100 without being attached thereto.

Referring to FIGS. 1-54, wherein like numerals indicate like elements throughout, there are shown preferred embodiments of a boat chair 110, with the term "boat chair" being understood to mean an article for sitting, resting, or otherwise holding the bodies of humans or animals while on vehicles. While the term boat chair is used herein, it is not meant to be limiting, as those of ordinary skill in the art will appreciate from this disclosure that the invention may be used to make tables, chairs, couches, sofas, recliners, seat backs, and more to be used anywhere, including on boats, trains, cars, in homes or public spaces, and the like without exceeding the scope of this disclosure.

In some of the figures, preferred embodiments of the boat chair 110 are shown in connection with a boat 100. Generally speaking, boat may refer to any vessel for use or partial use on water or mud. This may include ships, sailboats, trawlers, catamarans, skiffs, shrimping and fishing vessels, bass boats, deep-sea fishing boats, crabbing and shrimping boats, pontoon boats, hovercrafts, glass bottom boats, yachts, sail boats, and more. The invention is neither limited to recreational nor commercial watercraft of any kind. The boat 100 may include boat decking 104, understood in the industry to mean the portion of a boat 100 which persons generally walk or stand. The boat 100 may also include a bulkhead structure 102, which may include, but is not limited to, any and all of: raised decking at the bow, stern, or forecastle of the ship; bulwarks, sidewalls, gunwales, cabin structures; live wells and fishing structures; and other permanent or semi-permanent seating. The boat 100 may also include a boat cushion 106 which may include and all cushions which may temporarily attached, permanently attached, kept, and/or used on a boat.

Generally, the boat chair 110 preferably comprises a chair body 112 which includes a seat support structure 114 and a back support structure 134 joined by a locking member 130 and possibly also a hinge. In some embodiments, the locking mechanism 130 may also define a pivot axis about which the back support structure 134 might pivot. In other embodiments, the seat support structure 114 and a back support structure 134 may be connected by both a first hinge 228 and a locking mechanism 130. In many preferred embodiments, the height of the boat chair 110 relative to the boat decking 104 or bulkhead structure 102 of the boat is significant. For example, in many embodiments the height of the top of the seat support structure should be generally horizontally aligned with the adjacent boat decking or boat structure.

Referring to FIGS. 1-2, 15, and 34-38 the boat chair 110 is preferably detachably installable on a boat 100, as discussed above. It is preferred that the boat chair 110 include a post 124 which is detachably engageable with the seat support structure 114 such that the chair body 112 can be detachably installed on a boat 100. In some embodiments a hollow post adjustment sleeve 224 may be detachably connected to the chair body 112, with the diameter of the post adjustment sleeve 224 being suitably wide such that the post 124 may be fully inserted therein. The post 124 may then be slid into the post adjustment sleeve 224 and a post adjustment tab 226 may engage holes or other portions of the post adjustment sleeve 224 to lock the length of the post 124 (to set the height of the boat chair 110 relative to the boat decking 104) at a desired point. Those of ordinary skill in the art will appreciate from this disclosure that any suitable means may be provided for adjusting the length of the post 124 (including pneumatics) without exceeding the scope of this disclosure.

In some embodiments, multiple chair bodies 112 may be attached to one another to provide larger seating surfaces. For example, two or three chair bodies 112 may be attached to posts 124 next to one another to create a chair body 112 which might seat multiple people with independently adjustable back support structures 134. Multiple chair bodies 112 may also be provided in 180 degree flat configurations to create a large bench or shelf for diverse uses.

It is preferred that no part of the chair body 112 is formed by a bulkhead structure 102 of the boat 100, a boat cushion 106, nor boat decking 104. Rather, it is preferred that the boat chair 110 is connected to the boat 100 through one of, or a combination of, one or more posts 124 engaging mounting mechanisms 108 on the boat 100 or seat connectors 204 disposed on the seat support structure 114 and configured to engage at least one of (1) the bulkhead structure 102 of the boat 100, and (2) fixed connectors 202 located on the bulkhead structure 102 of the boat 100. The seat connector 204 engaging the bulkhead structure 102 and/or the fixed connector 202 may provide additional support for a person seated on the boat chair 110, and may assist in preventing the boat chair 110 from pivoting about the post 124 or post adjustment sleeve 224 when undesired.

Figure 3:
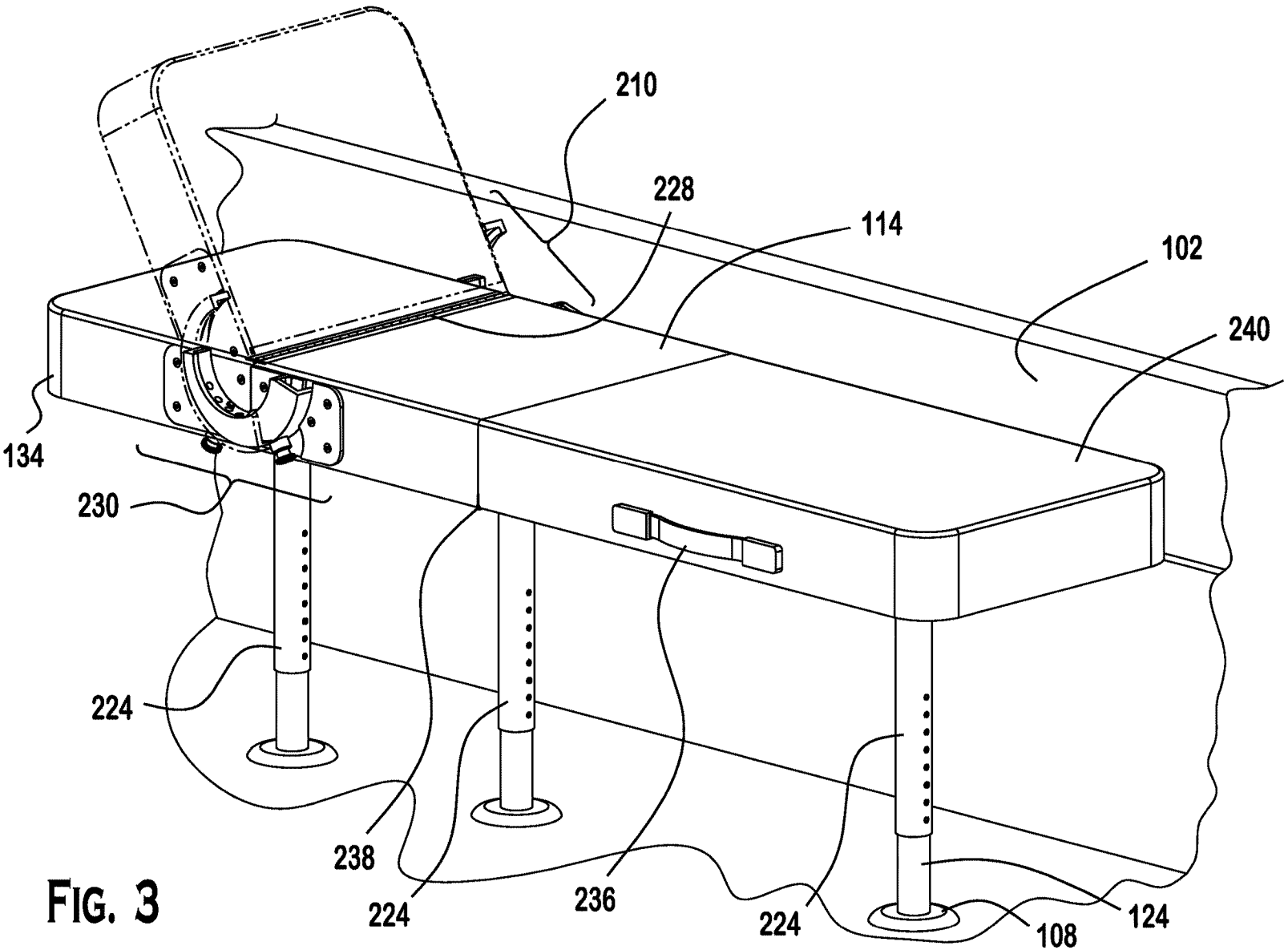
FIG. 3 is a partial perspective view of a boat chair 110 of a preferred embodiment. The figure shows that, in some in preferred embodiments, the boat chair 110 forms a chair body 112 which includes a back support structure 134 and seat support structure 114, connected to one another by a first elliptical hinge 210, a second elliptical hinge 230, and a first hinge 228. The boat seat 110 may also include a leg support structure 240 attached to the seat support structure 114 by a second hinge 238 and attached to the boat by one or more posts 124.
Figure 4:
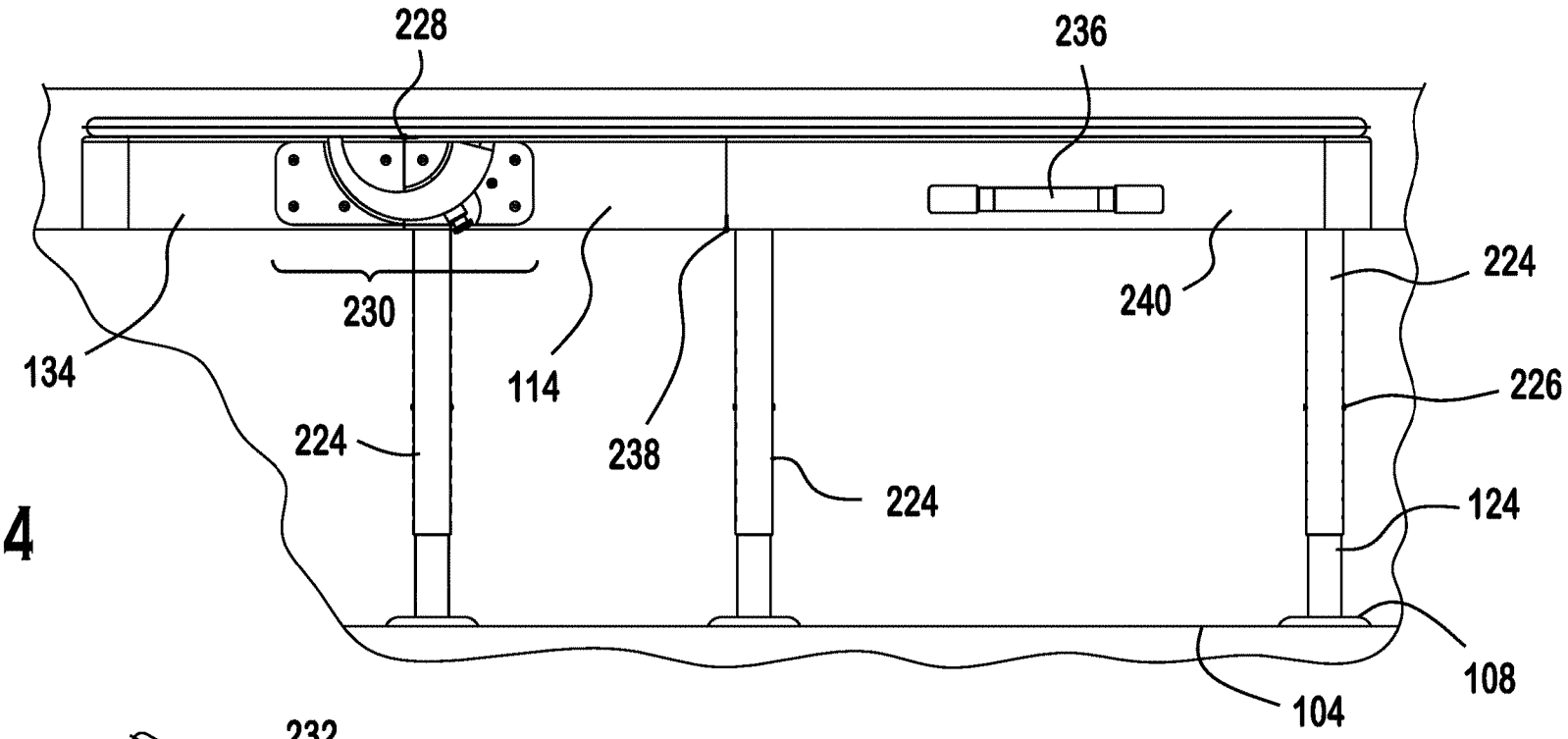
FIG. 4 is a partial right side view of the boat chair 110 of FIG. 3, wherein the boat chair 110 is in the second open configuration and the back support structure 134 has been placed at 180 degrees in relation to the seat support structure 144. As can be seen, the second outer elliptical hinge body 232 covers a great deal of the second inner elliptical hinge body 234 (and similarly, the first outer elliptical hinge body 212 covers a great deal of the first inner elliptical hinge body 214) when the boat chair 110 is in this configuration.
Figure 5:
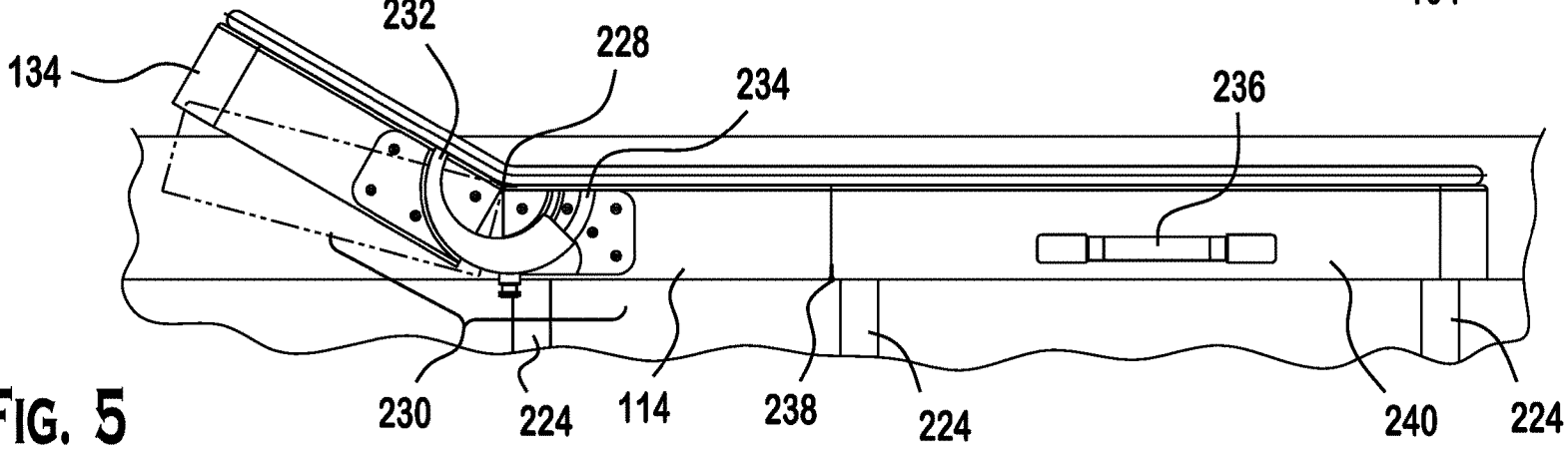
FIG. 5 is an alternate view of FIG. 4, with the back support structure 134 raised slightly from the 180 degree position, demonstrating how the second outer elliptical hinge body 232 recedes from covering the second inner elliptical hinge body 234 (and similarly, the first outer elliptical hinge body 212 recedes from covering the first inner elliptical hinge body 214) as the back support structure 134 is raised.
Figure 6:
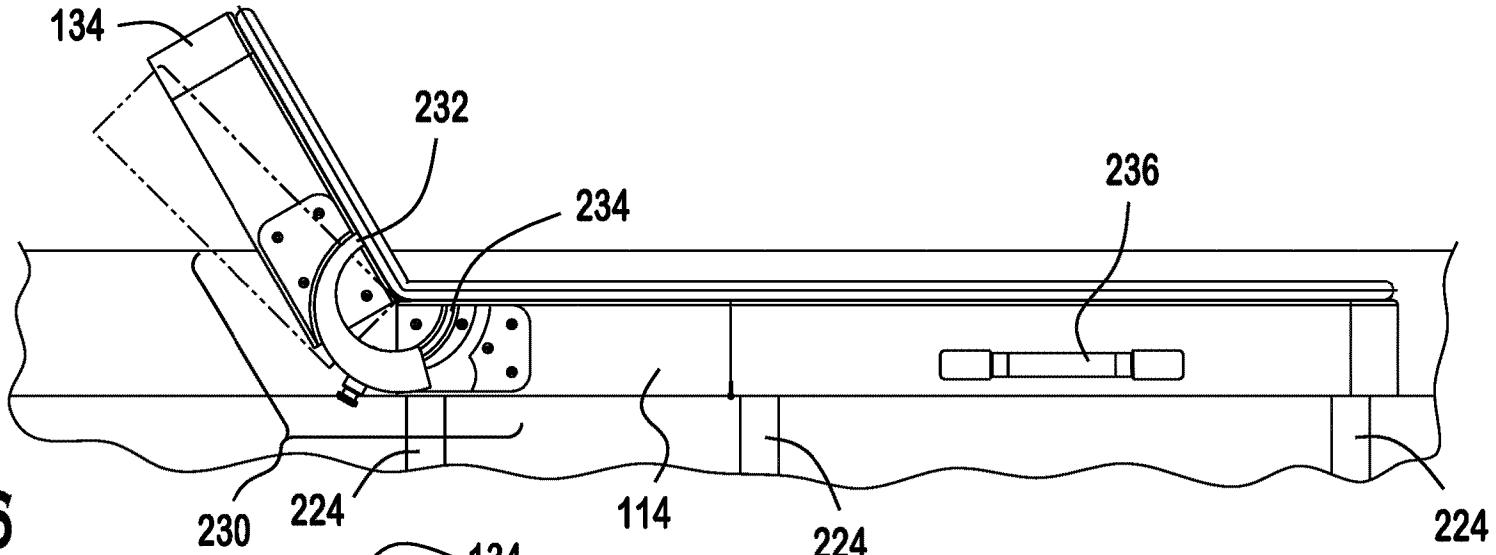
FIG. 6 is an additional alternate view of FIG. 4, with the back support structure 134 further raised from the 180 degree position, demonstrating how the second outer elliptical hinge body 232 continues to recede from covering the second inner elliptical hinge body 234 (and similarly, the first outer elliptical hinge body 212 continues to recede from covering the first inner elliptical hinge body 214) as the back support structure 134 is raised.
Figure 7:
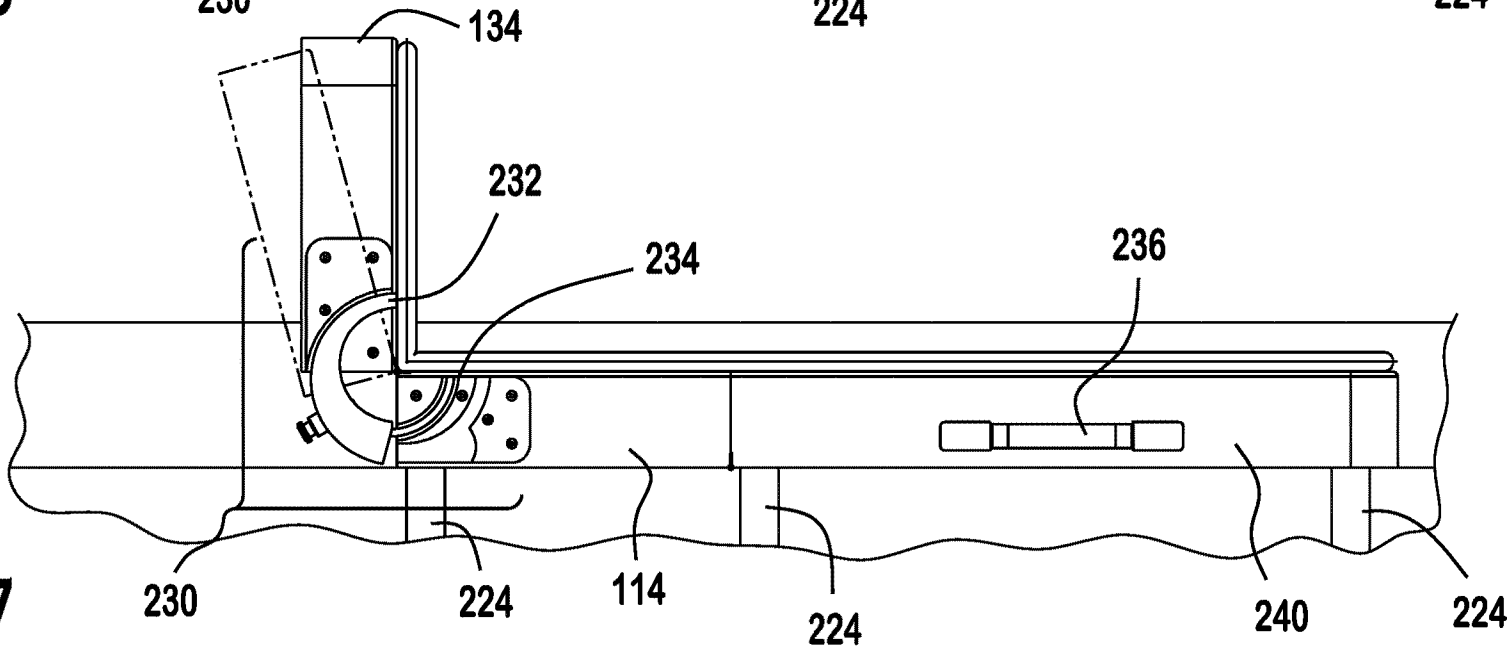
FIG. 7 is an additional alternate view of FIG. 4, with the back support structure 134 raised into a 90 degree position in relation to the seat support structure 114, demonstrating the bending of the first hinge 228.
Figure 8:
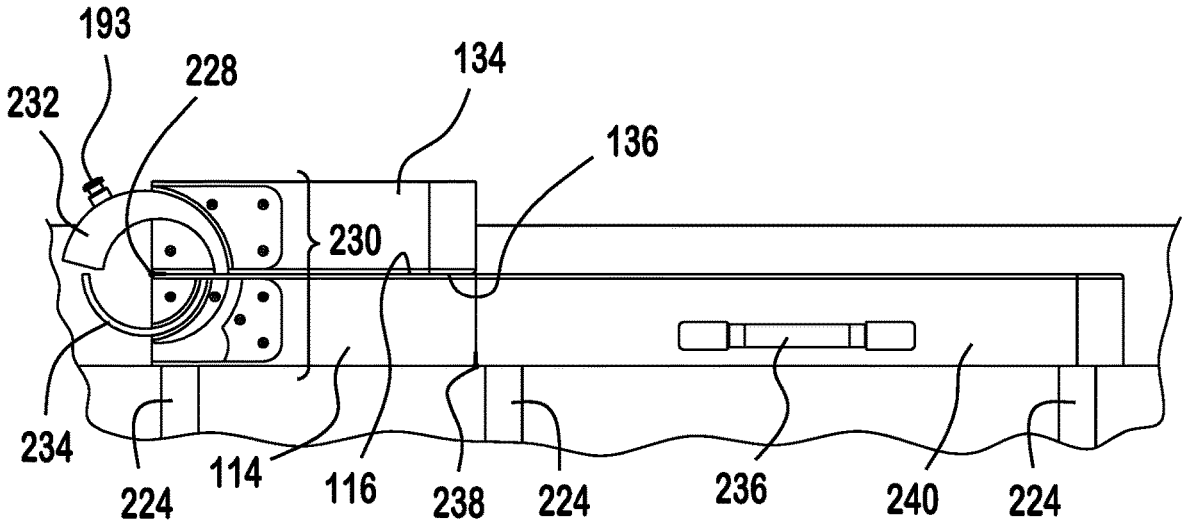
FIG. 8 is an additional alternate view of FIG. 4, with the back support structure 134 fully forward toward the seat support structure 114 such that the inner back face 136 is against the inner seat face 116. In such a position, the chamber 140 may face generally upward, and the second inner elliptical hinge body 234 may be fully removed from the second outer elliptical hinge body 232 (and similarly, the first inner elliptical hinge body 214 may be fully removed from the first outer elliptical hinge body 212).
Figure 9:
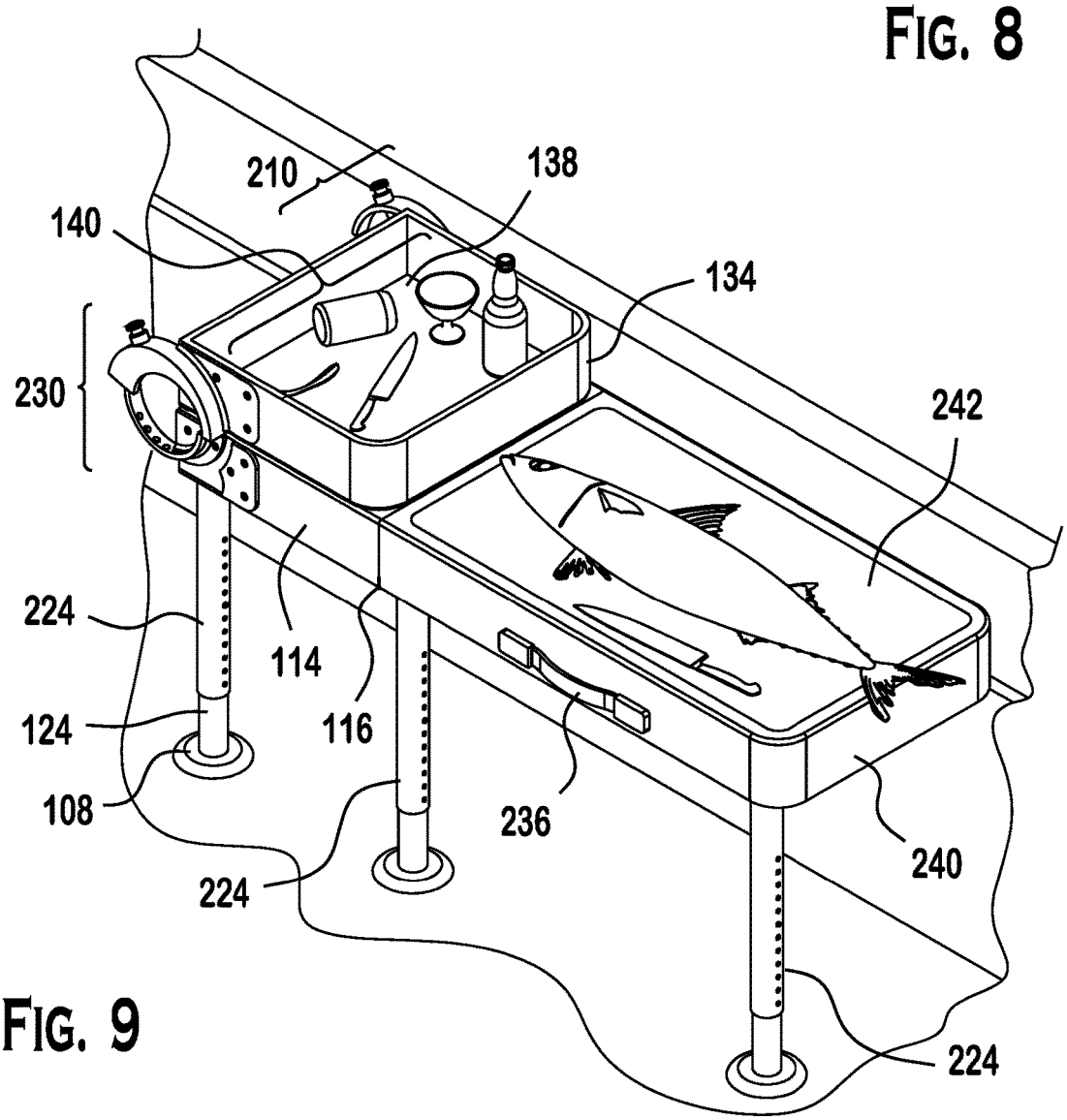
FIG. 9 is a partial top perspective view of a boat 100 with the boat chair 110 of FIG. 8 attached thereto. The figure demonstrates how such a configuration may be beneficial, with the inner leg face 242 being used as a cleaning table and the outer back face 138 and chamber 140 being used as a tray for holding utensils, beverages and refreshments, and other useful implements.
Figure 10:
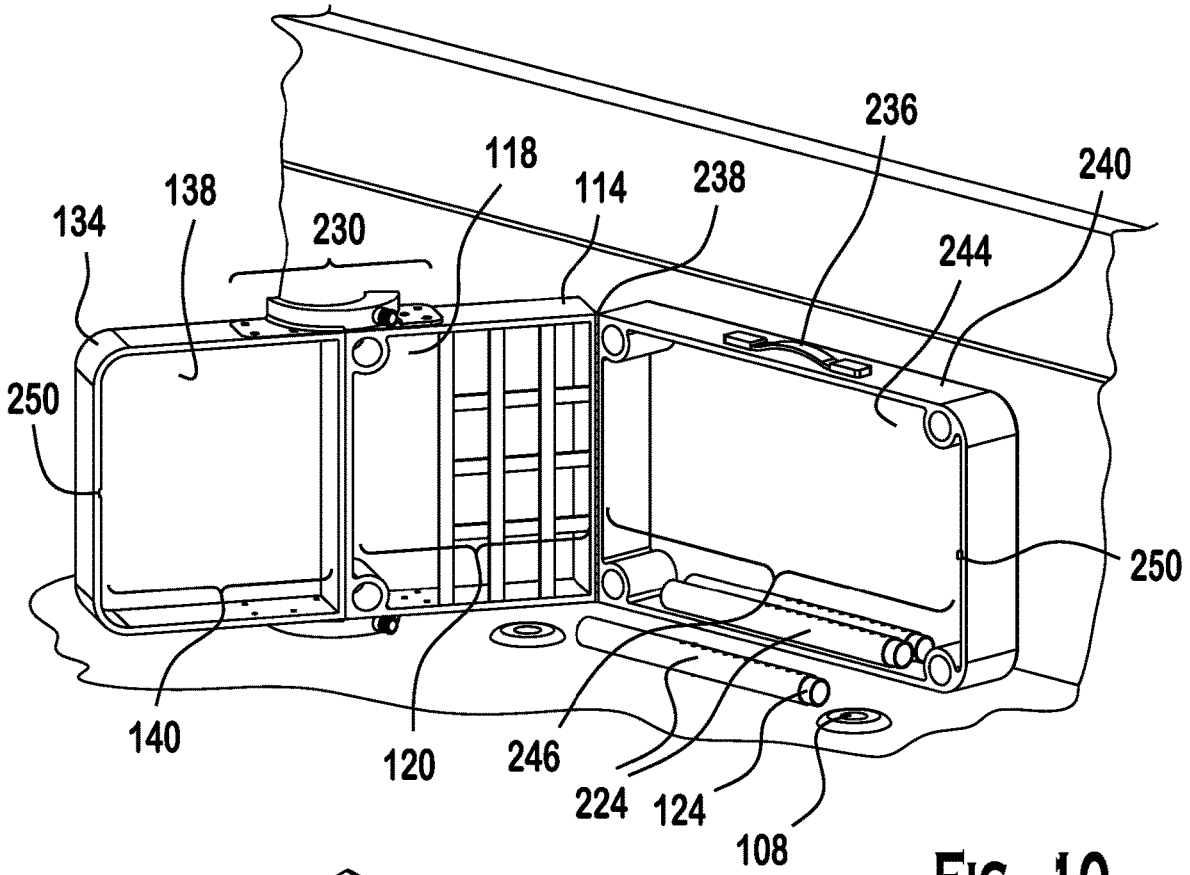
FIG. 10 is perspective view of the boat chair 110 of FIG. 3, showing the boat chair 110 being converted into the first compact configuration. Preferably, the back support structure 134 would be moved into a 180 degree angle in relation to the seat support structure 114 and locked therein using the first adjustment screw 216 and second adjustment screw 218, inserted through the first elliptical hinge 210 and second elliptical hinge 230 respectively. The post 124, or posts, may be placed in the compartment 246, and the second hinge 238 may allow the leg support structure 240 to pivot toward the seat support structure 114 and back support structure 134. A full pivot would allow the outer seat face 118, outer back face 138, and outer leg face 244 to close against one another and create a sealed compartment.
Figure 11:
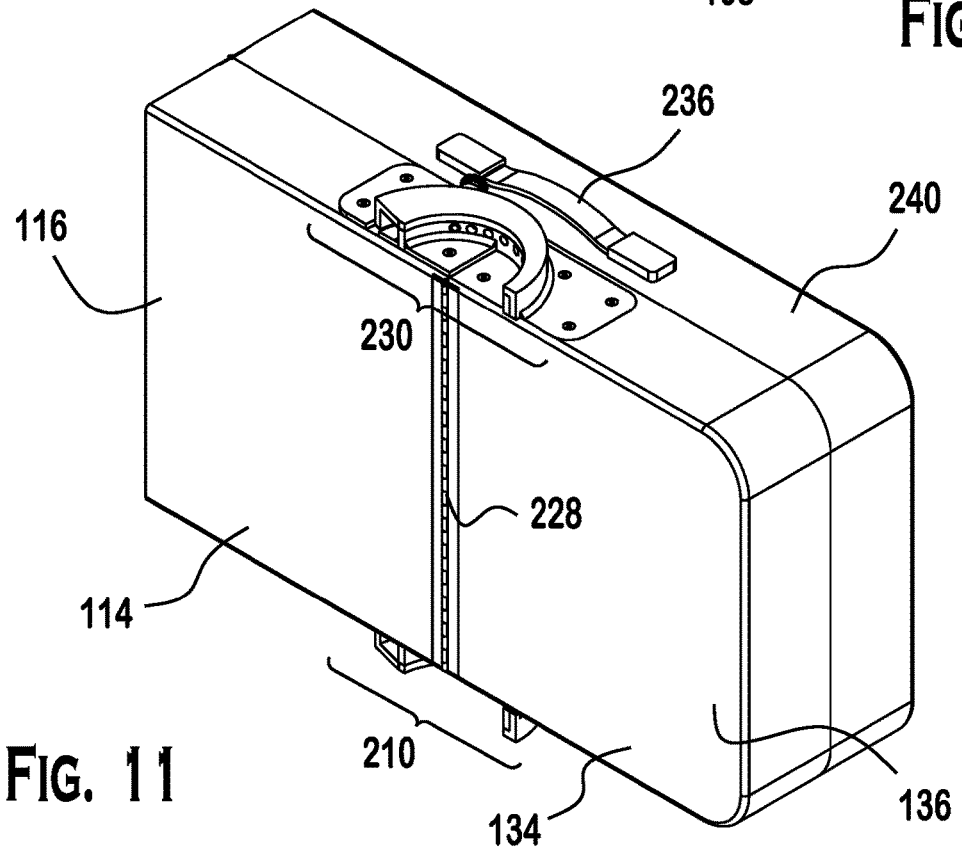
FIG. 11 is a perspective view of the boat chair 110 of FIG. 10 fully in the first compact configuration. In such a configuration, it is preferred that the inner seat face 116, inner back face 136, and inner leg face 242 form the sides of the boat chair 110, with the second elliptical hinge 230 and a slip handle 236 (for carrying) on top. Preferably, a latch mechanism 150 may be provided to keep the boat chair 110 in the first compact configuration.
Figure 12:
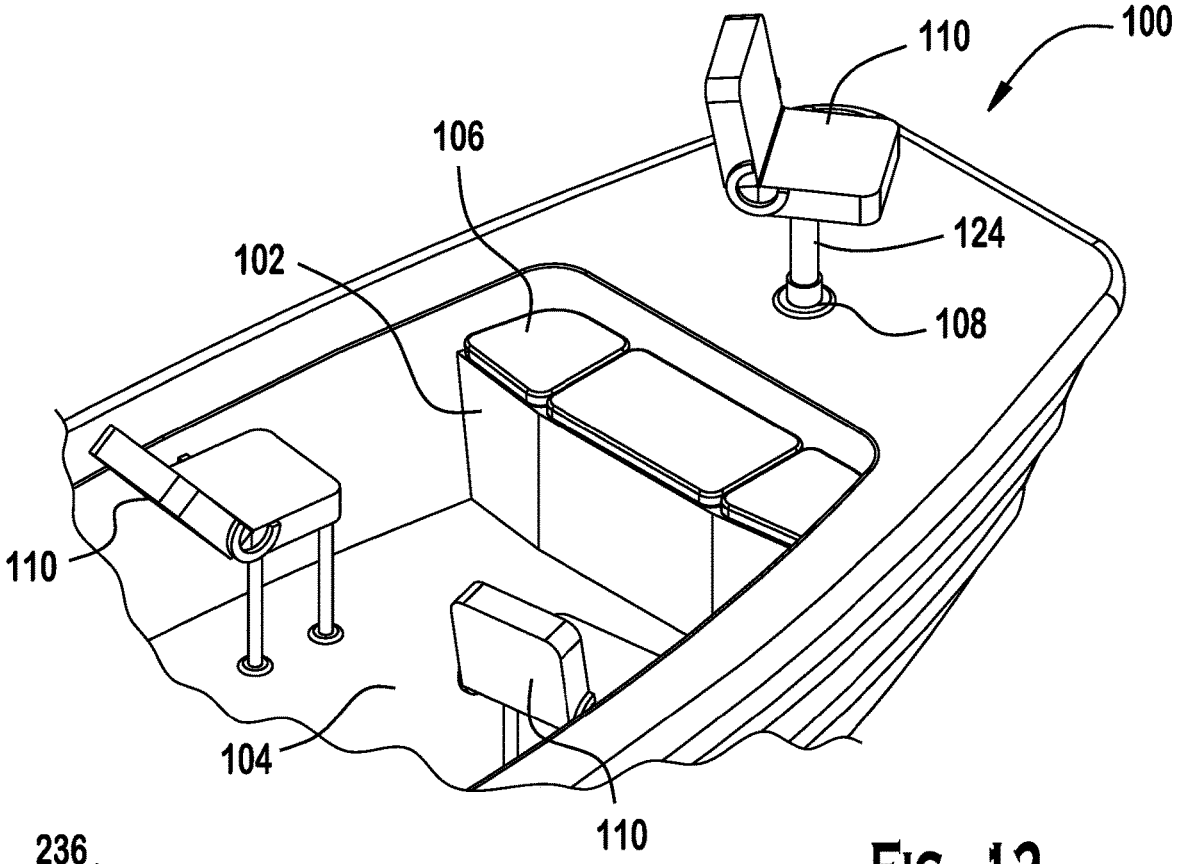
FIG. 12 is a partial front perspective view of a boat 100 with a preferred embodiment of the boat chair 110 attached. In such an embodiment, the chair body 112 does not include a second hinge nor a leg support structure, but rather includes a seat support structure 114 and a back support structure 134 attached by a first hinge 228, a first elliptical hinge 210, and a second elliptical hinge 230. Such a configuration may be desirable for fishing.
Figure 13:
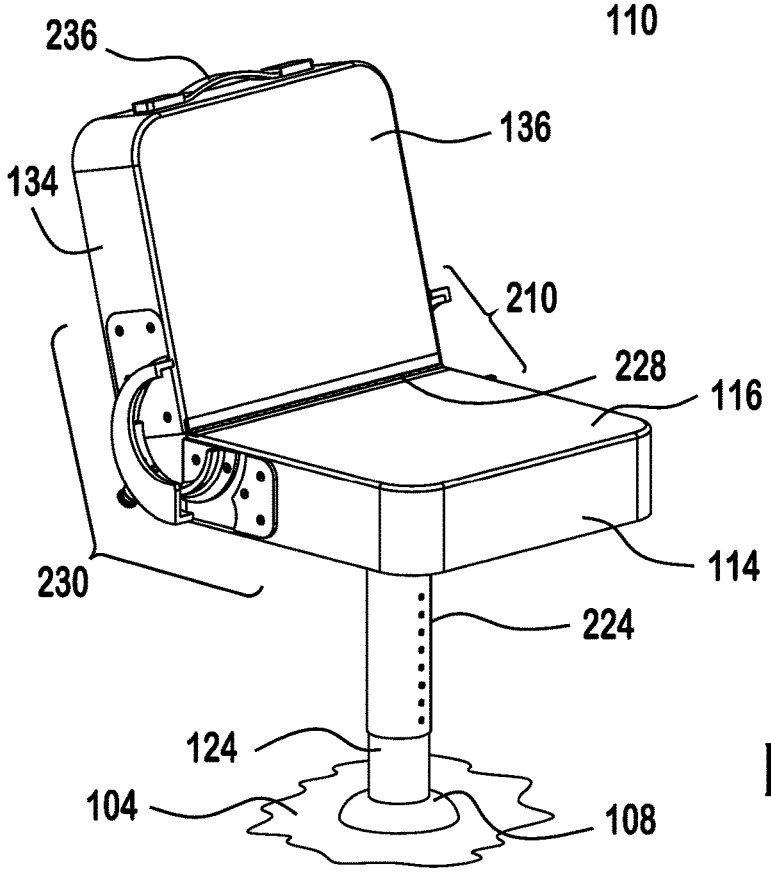
FIG. 13 is a partial perspective view of the boat chair 110 of FIG. 12 attached to a boat 100, demonstrating that this preferred embodiment may include a post 124 which includes a post adjustment tab 226 and a post adjustment sleeve 224 into which the post 124 may be inserted. These elements may allow the height of the boat chair 110, relative to the boat decking 104 or bulkhead structure 102, to be adjusted.
Figure 14:
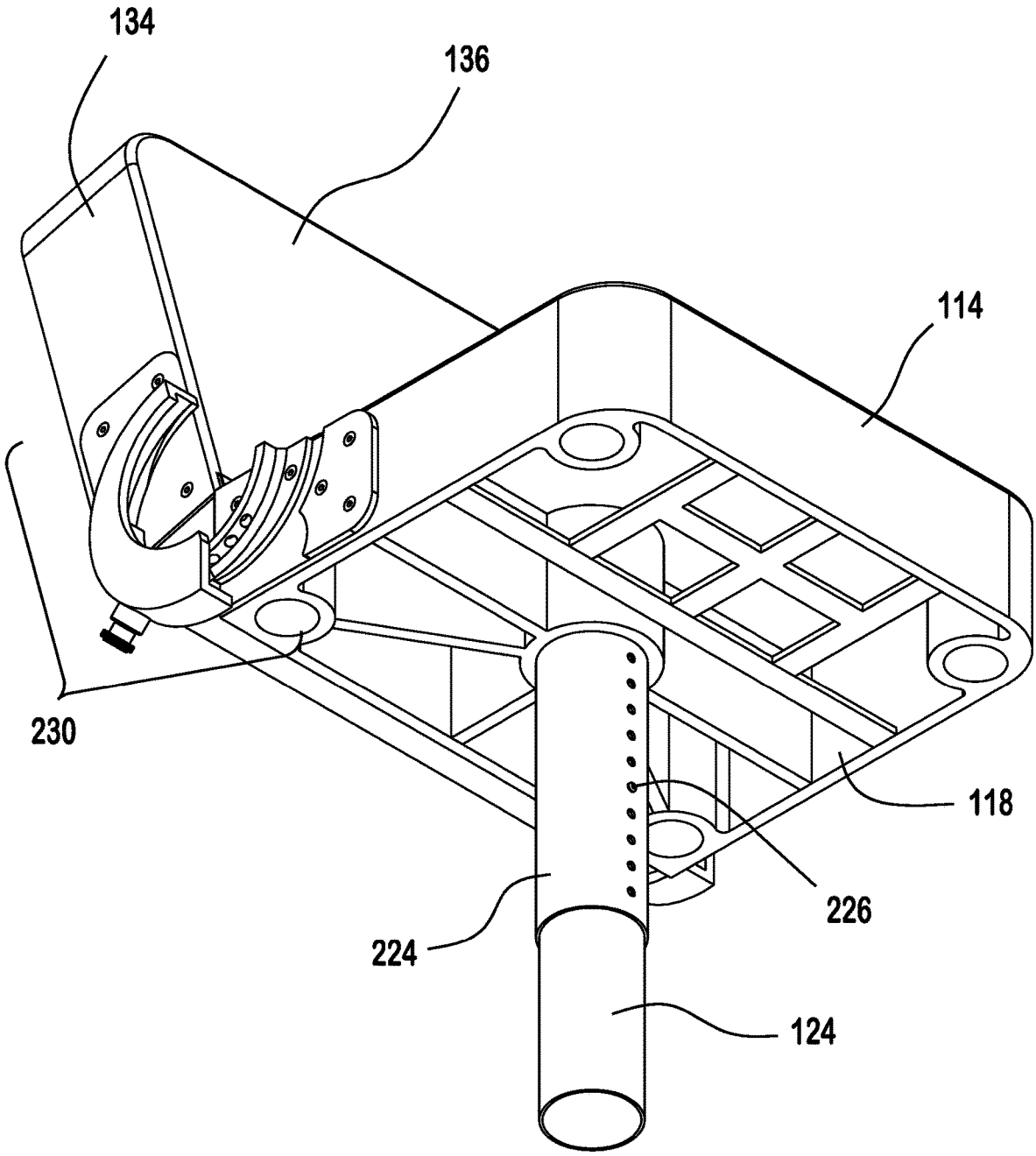
FIG. 14 is a bottom perspective view of the boat chair 110 of FIG. 13 when not attached to a boat 100, showing that it is preferred that the post adjustment sleeve 224 be fitted directly to the outer seat face 118 rather than the post 124 directly.
Figure 15:
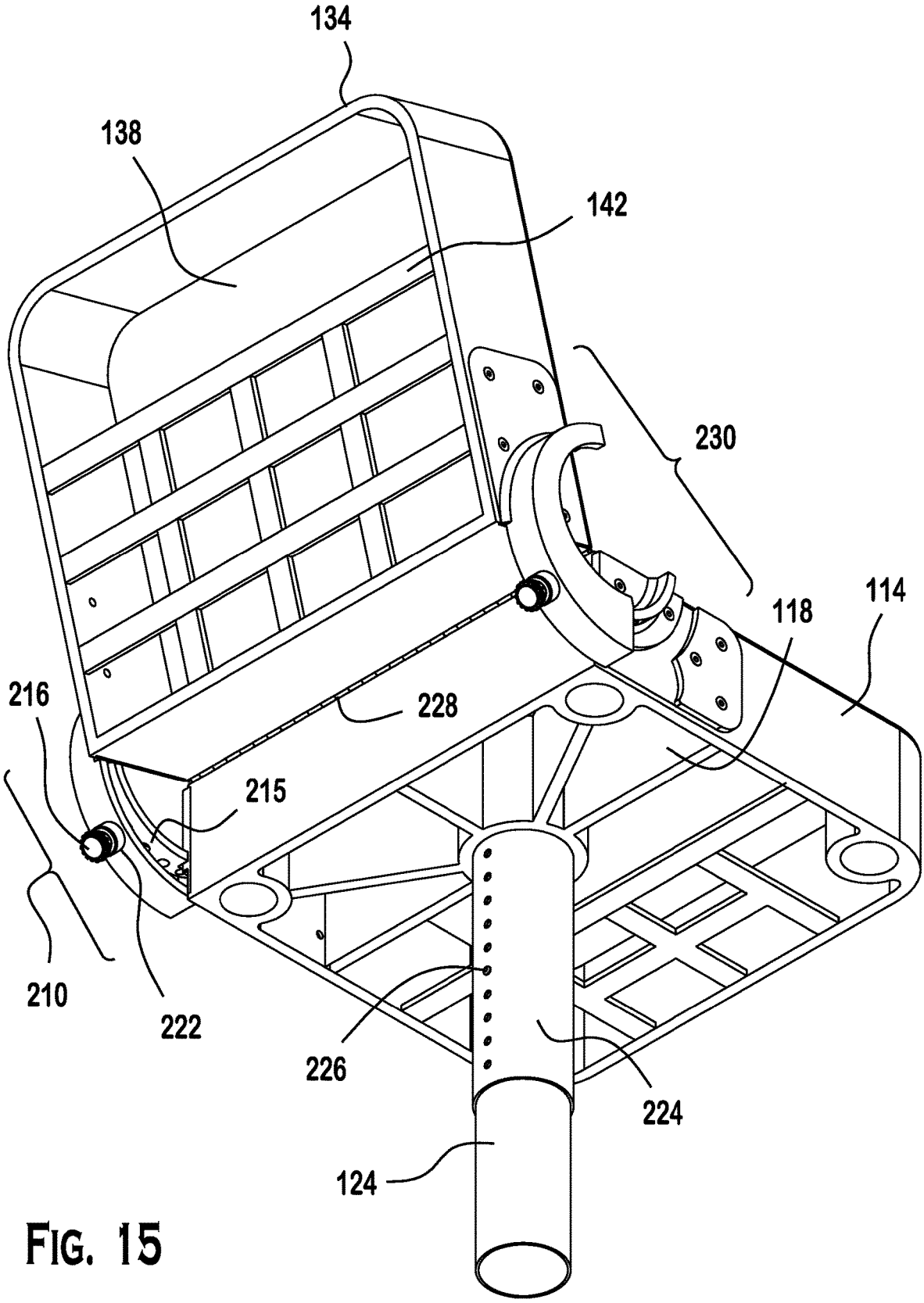
FIG. 15 is a bottom rear perspective view of the boat chair 110 of FIG. 14, better demonstrating that the first elliptical hinge 210 may be a mirror image of the second elliptical hinge 230. The first elliptical hinge 210 includes a first outer elliptical hinge 212 mounted on the back support structure 134 and provided with a first screw bore 220, and a first inner elliptical hinge 214 mounted on the seat support structure 114 and provided with a first plurality of adjustment holes 215. The first adjustment screw 216 may extend through the first screw bore 220 and one of the first plurality of adjustment holes 215 to lock the position of the back support structure 134, in relation to the seat support structure 114, in place.
Figure 16:
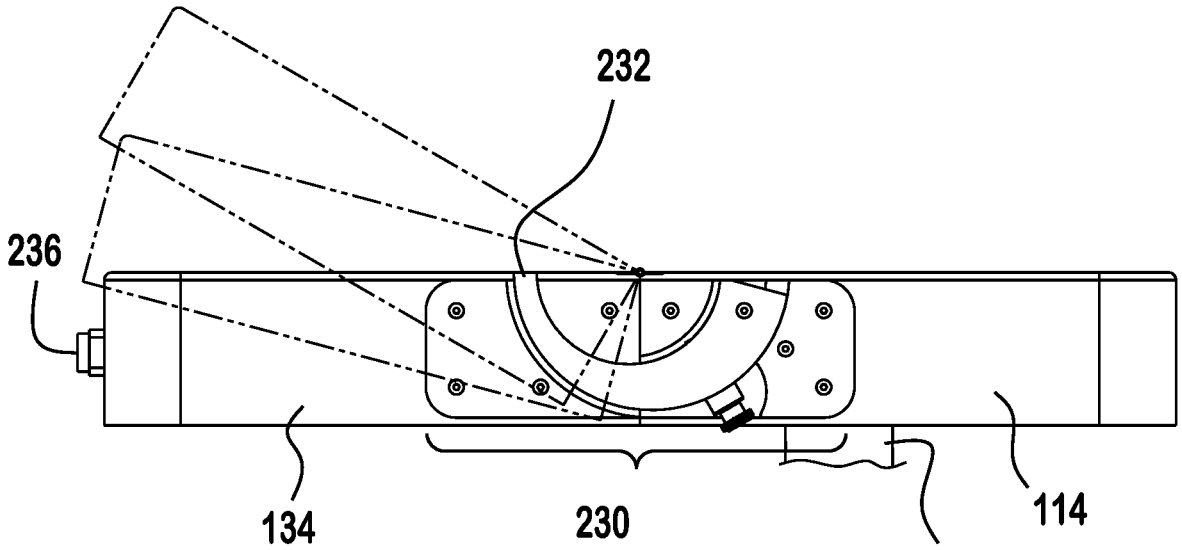
FIG. 16 is a partial right side view of the boat chair 110 of FIG. 15, with the back support structure 134 in the 180 degree position in relation to the seat support structure 114, with the dashed lines demonstrating how back support structure 134 may be raised to an angular position.
Figure 17:
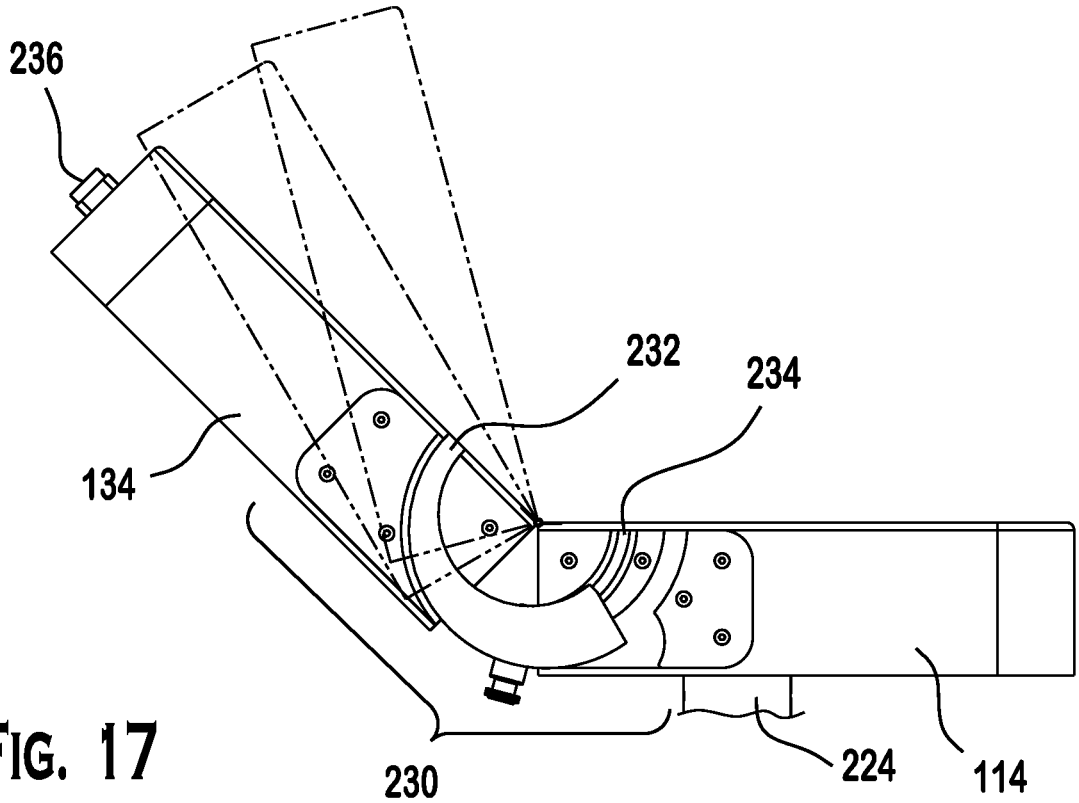
FIG. 17 is an alternate view of FIG. 16, with the back support structure 134 in the raised position of FIG. 16, with the dashed lines demonstrating how back support structure 134 may be raised to a higher angular position.
Figure 18:
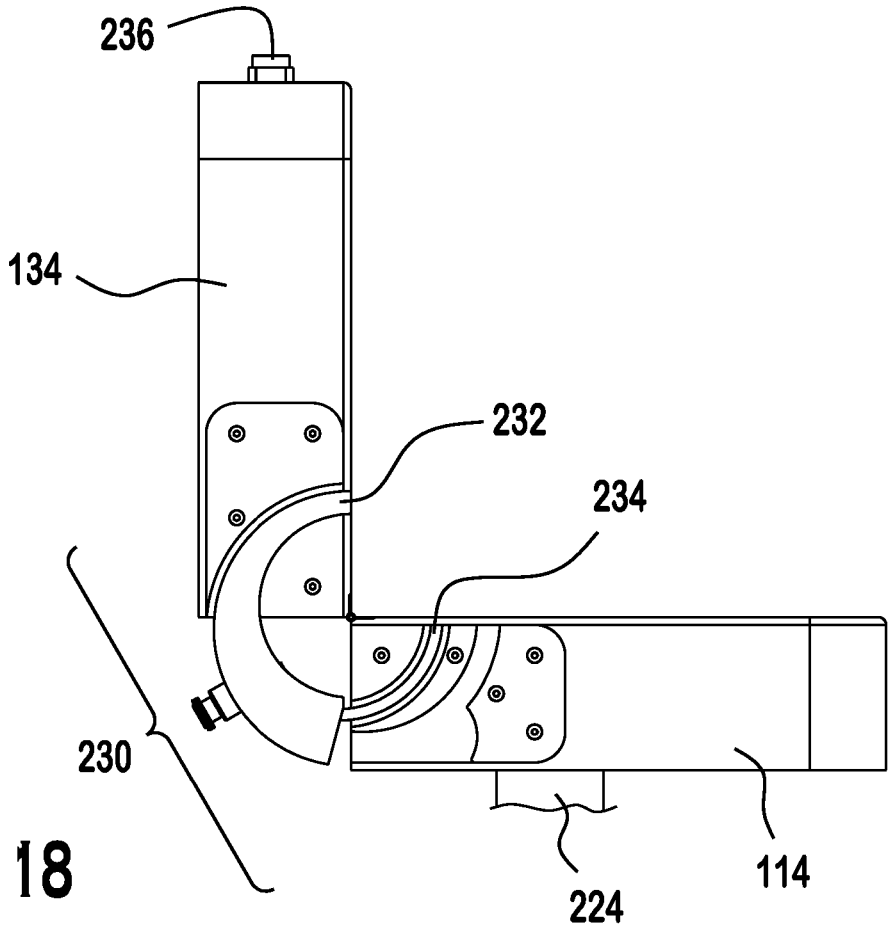
FIG. 18 is an alternate view of FIG. 17, with the back support structure 134 raised into a 90 degree position in relation to the seat support structure 114. The figure better demonstrates the preferred positioning of the second outer elliptical hinge body 232 and second inner elliptical hinge body 234. The first outer elliptical hinge body 212 and first inner elliptical hinge body 214 are preferably in a similar, mirror image configuration.
Figure 19:
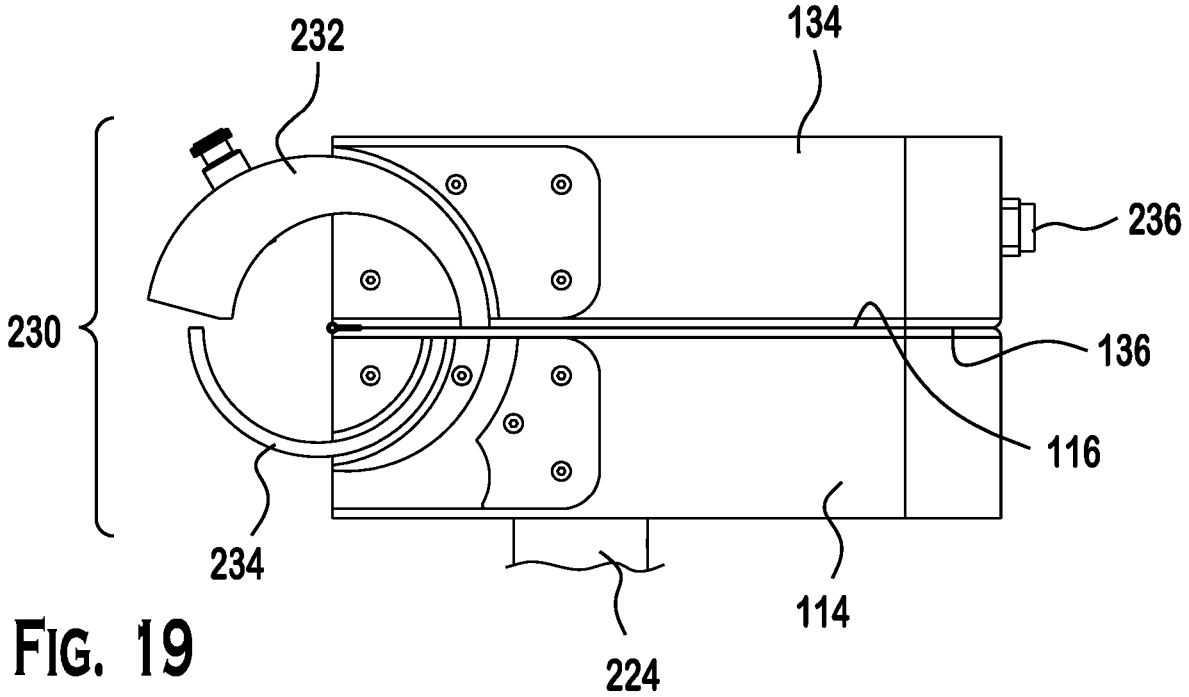
FIG. 19 is an alternate view of FIG. 18, wherein the back support structure 134 is fully forward toward the seat support structure 114 such that the inner back face 136 is positioned against the inner seat face 116. In such a positioned, the chamber 140 may face generally upward, and the second inner elliptical hinge body 234 may be fully removed from the second outer elliptical hinge body 232 (and similarly, the first inner elliptical hinge body 214 may be fully removed from the first outer elliptical hinge body 212). A space can be seen between these parts in the figure, showing that the second inner elliptical hinge body 234 has been fully removed.
Figure 20:
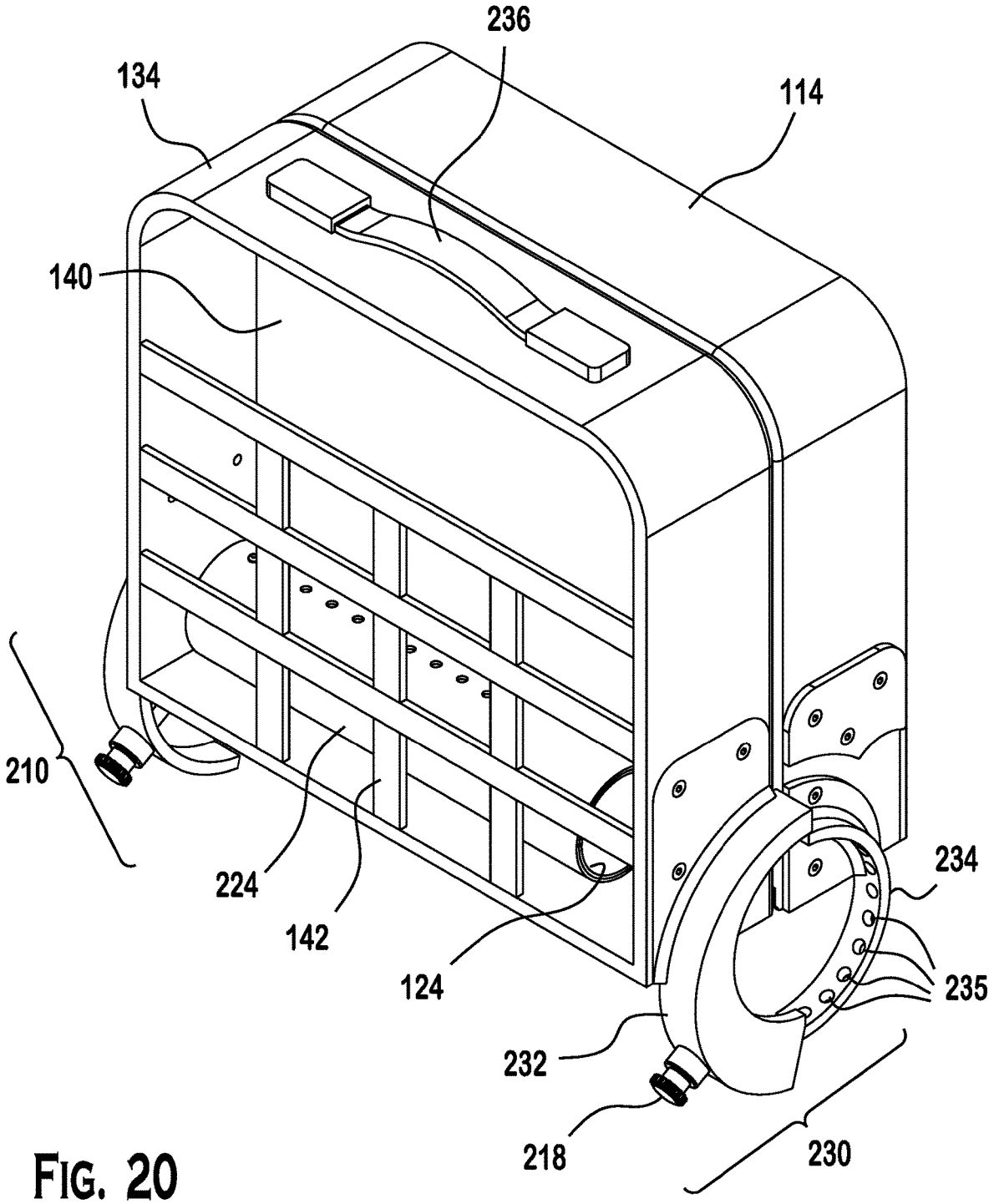
FIG. 20 is a perspective view of the boat chair 110 of FIG. 19 in the first compact configuration, with the boat chair 110 having been turned to allow the slip handle 236 to face upward to allow for easy carrying. The figure provides a better view of the first plurality of adjustment holes 215 in the first elliptical hinge 210. The figure also demonstrates that the post 124 may be fully inserted into the post adjustment sleeve 224 and stored in the chamber 140 in the outer back face 138 for storage. The storage compartment 142 may be included to retain the post 124 and post adjustment sleeve 224 therein.
Figure 21:
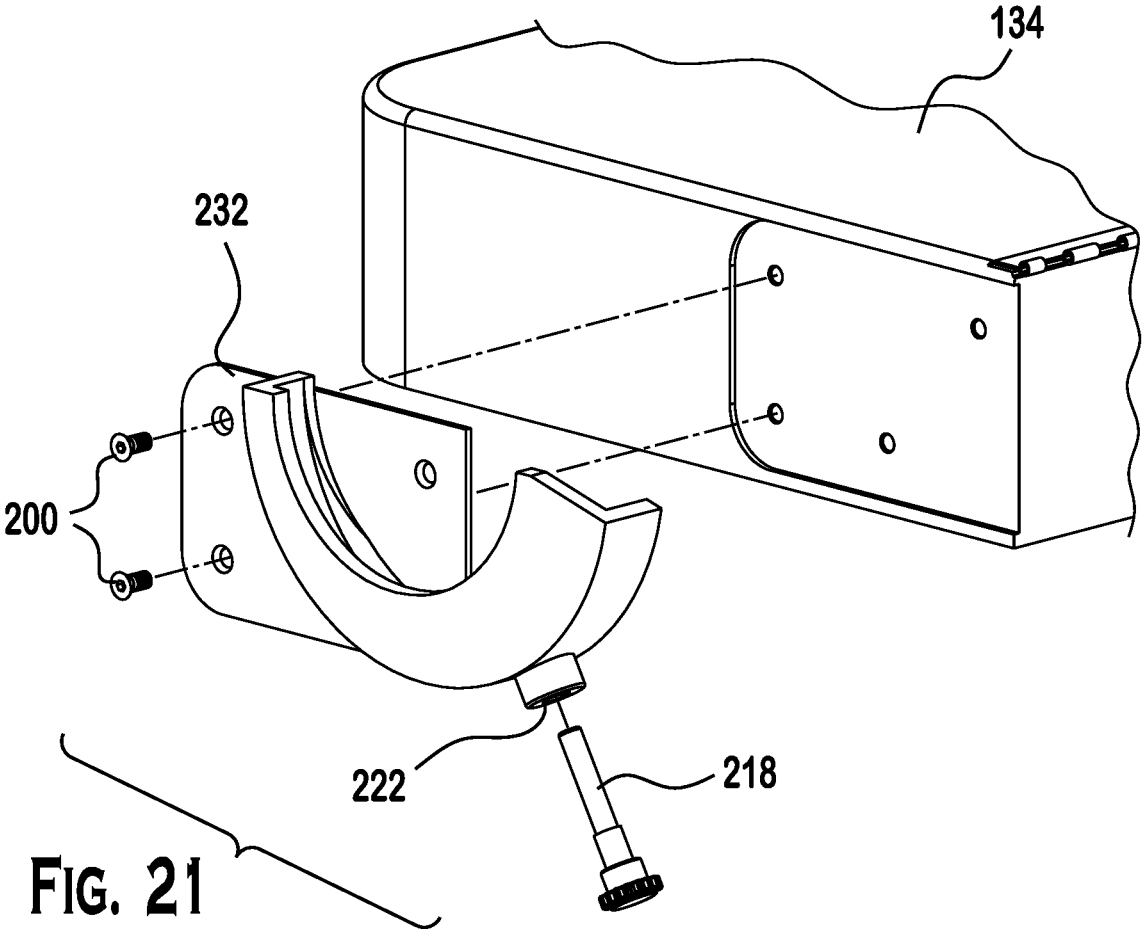
FIG. 21 is a partial exploded view of the boat chair 110 of a preferred embodiment, demonstrating that the second outer elliptical hinge body 232 may be affixed to the back support structure 134 by a plurality of fasteners 200. The second adjustment screw 218 may be partially inserted into the second screw bore 222, and if threaded, may be screwed into the second screw bore 222 and retained therein. The first outer elliptical hinge body 212 and its component parts may be mounted on the back support structure 134 in a similar fashion.
Figure 22:
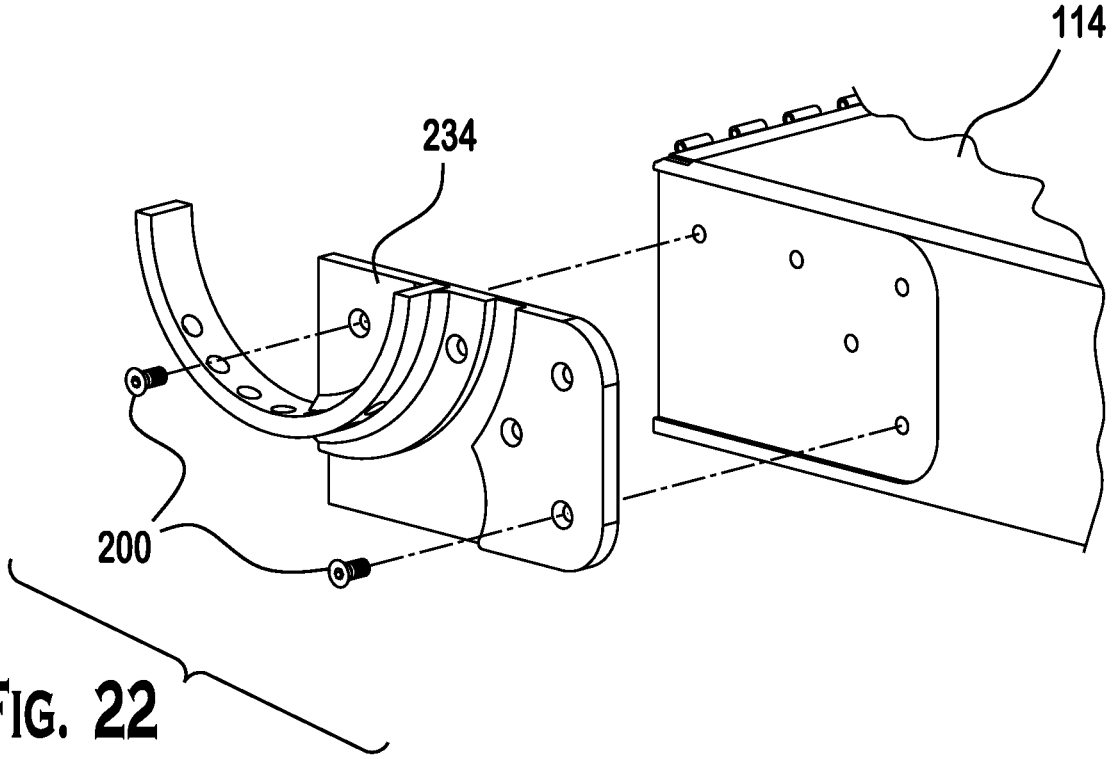
FIG. 22 is a partial exploded view of the boat chair 110 of a preferred embodiment, demonstrating that the second inner elliptical hinge body 234 may be affixed to the back support structure 134 by a plurality of fasteners 200. The first inner elliptical hinge body 214 and its component parts may be mounted on the back support structure 134 in a similar fashion.
Figure 23:
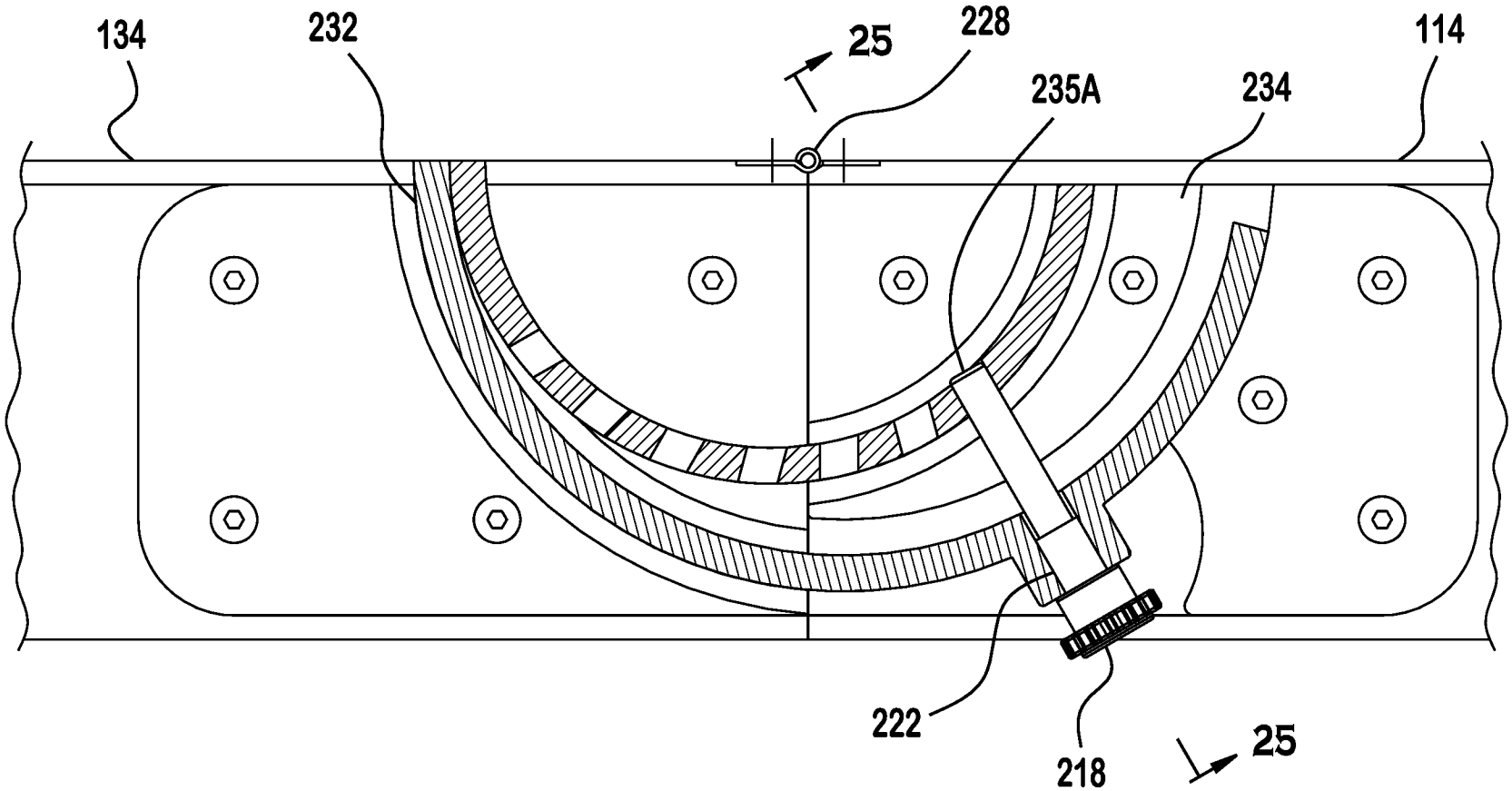
FIG. 23 is a partial cross sectional view of the second elliptical hinge 230 demonstrating the positioning of the second outer elliptical hinge body 232 and second inner elliptical hinge body 234 when the back support structure 134 is in a 180 degree configuration in relation to the seat support structure 114. The second adjustment screw 218 may be placed into the second screw bore 222 and through one of the second plurality of adjustment holes 235A to hold the boat chair 110 in such a configuration. The component parts of the first elliptical hinge 210 are preferably held in a similar configuration to lock both sides of the boat chair 110 in position.
Figure 24:
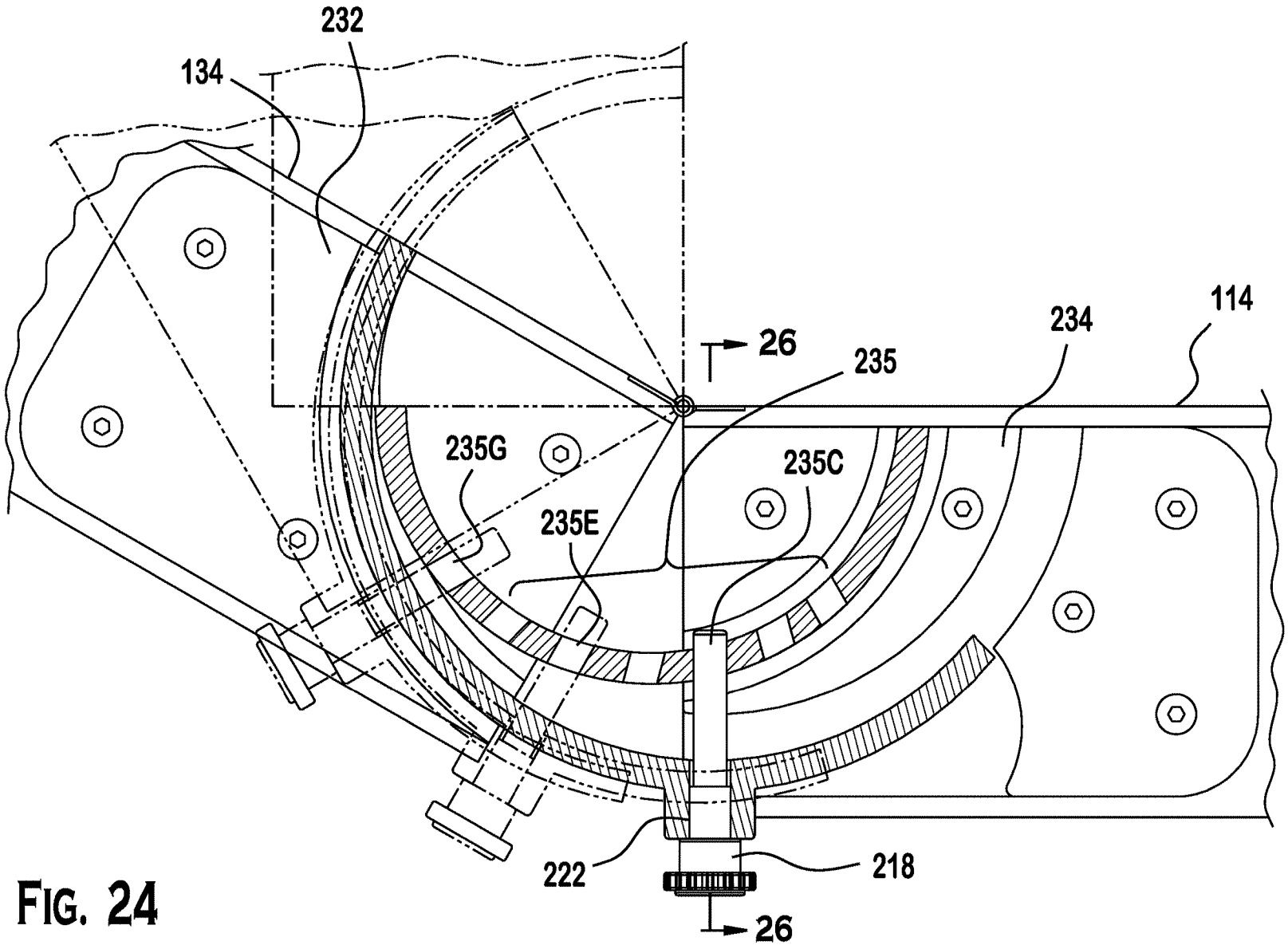
FIG. 24 is a partial cross sectional view of the second elliptical hinge 230 demonstrating the positioning of the second outer elliptical hinge body 232 and second inner elliptical hinge body 234 when the back support structure 134 is in a variety of angular configurations in relation to the seat support structure 114. As examples, the figure shows various positions in dashed lines if the second adjustment screw 218 is placed into the second screw bore 222 and through one of the second plurality of adjustment holes, such as 235A, 235C, 235E, and 235G. The components parts of the first elliptical hinge 210 are preferably held in a similar configuration to lock both sides of the boat chair 110 in position.
Figure 25:
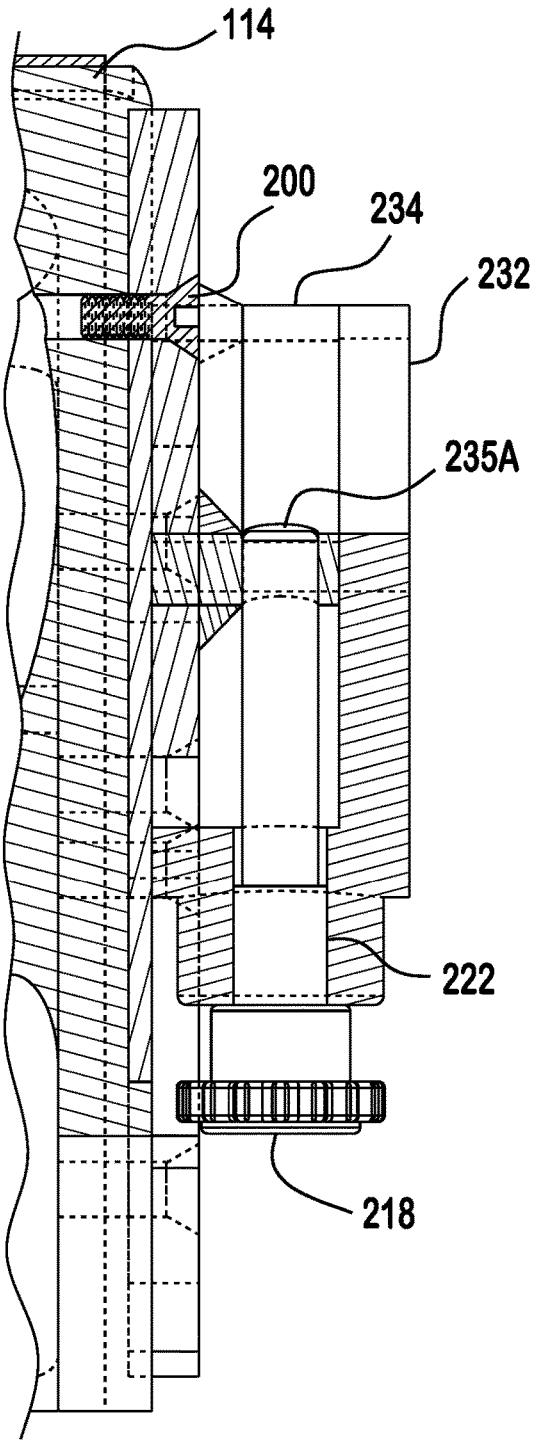
FIG. 25 is a partial cross sectional view of the second elliptical hinge 230 as taken along lines 25-25 of FIG. 23. The figure shows the preferred widths of fasteners 200, second adjustment screw 218, the second outer elliptical hinge body 232, and second inner elliptical hinge body 234. The components parts of the first elliptical hinge 210 are preferably of a similar size and width.
Figure 26:
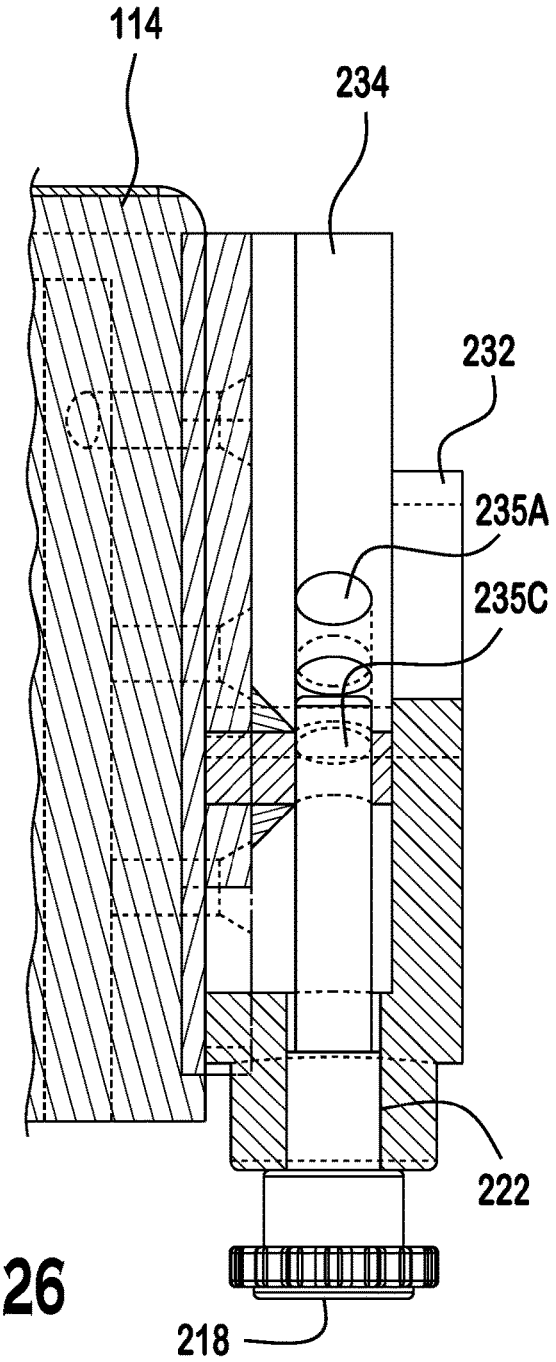
FIG. 26 is a partial cross sectional view of the second elliptical hinge 230 as taken along lines 26-26 of FIG. 24. The figure shows the preferred widths of fasteners 200, second adjustment screw 218, the second outer elliptical hinge body 232, and second inner elliptical hinge body 234. The figure also shows the preferred width and shape of the second plurality of adjustment holes 235. The components parts of the first elliptical hinge 210 are preferably of a similar size and width.

The mounting mechanism 108 may be a permanent fixture on the boat 100, or may be a temporary addition. For example, in FIG. 34, it can be seen that in some embodiments it is preferred that the post 124 be inserted through a hole in the boat decking 104. The mounting mechanism 108 may comprise a stainless steel or molded plastic ring or cup, which may protect the boat decking 104 from being damaged by the post 124. Alternatively, in FIG. 3, for example, the mounting mechanism 108 may be a metal footer which may be affixed directly onto the boat decking 104 without requiring a hole be cut out of the boat decking 104.

Referring to FIGS. 1-3 and 15, in still other embodiments, the boat chair 110 may not be attached to the boat 100 at all, and may instead be placed on the boat decking 104. For example, boat chair 110D in FIG. 2 includes post foot attachments 248 which cap the ends of the post 124. In this embodiment, the boat chair 110 may be further held to the boat 100 by gravity if the post foot attachments 248 are formed of heavy metal such as cast iron or lead. Those of ordinary skill in the art will appreciate from this disclosure that any suitable material may be used to form the post foot attachments 248 without exceeding the scope of this disclosure.

In other preferred embodiments, a boat 100 may be provided having a detachably installable boat chair 110. The boat 100 may have boat decking 104 and bulkhead structure 102 elevated above the boat decking 104. The boat 100 may further include the boat chair 110 and a mounting mechanism 108 positioned on the boat decking 104 and configured to receive the post 124. When the boat chair 110 is in the second open position and connected to the boat decking 104 via the post 124, the inner seat face 116 may be aligned with the bulkhead structure 102. The boat 100 preferably also includes fixed connectors 202 located on the bulkhead structure 102 and seat connectors 204 disposed on the seat support structure 114. The fixed connectors 202 and seat connectors 204 would preferably be configured to engage one another to further secure the position of the boat chair 110 on the boat 100. In some embodiments, the mounting mechanisms 108 or posts 124 may be built into the boat 100. The boat 100 may include portions of the bulkhead structure 102 built specifically to house one or more boat chairs 110 in the first compact configuration. The storage structure may be formed to fit the shape and size of the boat chairs 110 to help emphasize the customizability and modifiability of the boat 100 when showing a boat to customers.

Referring to FIGS. 27-34 and 40-41 the chair body 112 of the boat chair 110 is preferably moveable between a first compact configuration and a second open configuration. The first compact configuration is optimal for transportation, while the second open configuration includes several positions to convert the boat chair 110 for various preferred uses. These configurations are best understood through the movement of the back support structure 134 in relation to the seat support structure 114.

The chair body 112 includes a back support structure 134 and a seat support structure 114 which are pivotally connected about a central axis. The back support structure 134 is preferably configured to support a user's back and torso, while the seat support structure 114 is preferably configured to support a user's hips, lower back, and upper legs.

In this preferred embodiment, the seat support structure 114 preferably has an inner seat face 116 and an outer seat face 118 and the back support structure 134 has an inner back face 136 and an outer back face 138. When the chair body 112 is in the first compact configuration, the inner seat face 118 and the inner back face 138 are in contact with one another, the back support structure 134 having pivoted such that the inner back face 138 reaches the inner seat face 116. In such a configuration, the outer seat face 118 and outer back face 138 face in roughly opposite directions. When the chair 112 body is in the second open configuration the inner seat face 118 and the inner back face 138 are not in contact with each other. Instead, these form the surfaces upon which a user might sit. The back support structure 134 and seat support structure 114 are preferably formed of light but durable materials, such as molded plastic or metal. However, those of ordinary skill in the art will appreciate from this disclosure that any suitable materials or combinations thereof may be used, such as wood, fiber glass, polymer, hard rubber, and the like, without exceeding the scope of this disclosure.

In a preferred embodiment, the boat chair 110 includes a cavity 120 defined by the outer seat face 118. A pedestal 122 may be located within the cavity 120 and may be configured to engage the post 124. The inclusion of the pedestal 122 may be preferred, as the pedestal 122 may ensure that the weight of the user may be better distributed onto the post 124. Thus it is preferred that the pedestal be formed of a hard metal, such a stainless steel. However, the pedestal may be formed of other material, such as molded plastic, or may be a single piece formed with the seat support structure 114. The pedestal 122 may also include mechanisms for adjusting the length of the post 124, such as pneumatics. The seat support structure 114 may also be configured to include a bore 128 such that the post 124 may be inserted through the bore 128 to be placed generally within the cavity 120. In some embodiments, the post 124 may be inserted into a post adjustment sleeve 224, and both may be inserted through the bore 128 into the cavity 120. The seat support structure 114 may also form a post-holder extension 132, a cylindrical extension protruding into the cavity 120 and preferably formed of the same piece as the seat support structure 114. The width of the post-holder extension 132 is preferably just under that of the diameter of the post 124 to allow the post 124 to slip over the post-holder extension 132 and to be held over it by friction. Such a configuration may allow the post 124 to be retained within the cavity 120.

The chair body 112 preferably also includes a seat cushion 126 large enough to fully cover the cavity 120. The seat cushion 126 is preferably is detachably engageable with the outer seat face 118 such that the seat cushion 126 covers the cavity 120 when engaged with the outer seat face 118. It is preferred that the seat cushion 126 be detachably engaged to the seat support structure 114 via a plurality of snaps 206. Those of ordinary skill in the art will appreciate from this disclosure that any suitable engagement means, such as hook-and-loop fastener or zippers may be used without exceeding the scope of this disclosure. The seat cushion 126 may be formed of padding covered with a weather resistant material, such as vinyl, polyester, or the like. Those of ordinary skill in the art will appreciate from this disclosure that any suitable material may be used without exceeding the scope of this disclosure.

In some preferred embodiments, the chair body 112 may also include a handle 148 defined in the back support structure 134. It is preferred that the handle 148 be formed by the back support structure 134 when the back support structure 134 is molded. However, the handle 148 may be a separate piece and added after the fact, so long as the handle 148 is placed proximate to the top of the back support structure 134.

The back support structure 134 preferably further includes a shelf 144 defined by the inner back face 136 and a chamber 140 defined by the outer back face 138. The chamber 140 and shelf 144 are each preferably configured to hold a back rest cushion 146 which may be detachably positioned within the chamber 140 or on the shelf 144. The chamber 140 is preferably suitably small so as to retain the back rest cushion 146 therein without any fastener. However, any suitable fastener such as hook-and-loop fastener or snaps may be used to retain the back rest cushion 146 therein. As with the seat cushion 126, the back rest cushion 146 is preferably formed of padding covered with a weather resistant material, such as vinyl, polyester, or the like. Those of ordinary skill in the art will appreciate from this disclosure that any suitable material may be used without exceeding the scope of this disclosure.

The back rest cushion 146 preferably includes hook-and-loop fastener 208 on it rear side, which may allow it to be affixed to the hook-and-loop fastener 208 on the inner back face 136 above the shelf 144. The back rest cushion 146 preferably also has a flat side, which may rest upon the shelf 144, thus the shelf 144 may provide support to the back rest cushion 146. The back rest cushion 146 may also include snaps 206 on snap extensions 207. The snap extension 207 may pass over the top of the back support structure 134 and allow the snaps 206 to fasten to the snaps 206 on the outer back face 138. These multiple connections may provide sufficient retention to the back rest cushion 146 which may allow users to more comfortable move while sitting in the boat chair.

The chamber 140 may also include a storage compartment 142 for storing personal objects regardless of the configuration of the boat chair 110. The storage compartment 142 may be a mesh or polyesters pouch, a fabric bag, or some other container. The storage compartment 142 might be small enough such that it does not impede the placement of the back rest cushion 146 into the chamber 140. The storage compartment 142 may include space to store mounting mechanisms 108 and/or post foot attachments 248.

The first compact configuration refers to the configuration in which the boat chair 110 has been collapsed to its smallest shape in one preferred embodiment, the first compact configuration is when the inner seat face 116 is in contact with the inner back face 136. In a preferred embodiment of the first compact configuration, it is preferred that the back rest cushion 146 is located in the chamber 140 in the outer back face 138, that the seat cushion 126 is attached to the outer seat face 118 to cover the cavity 120, and the post 124 is positioned within the cavity. Such a configuration should ensure that the handle 148 is accessible and configured to allow the boat chair 110 to be easily carried. However, those of ordinary skill in the art will appreciate that the first compact configuration may include any of the elements above or only some in any combinations, without exceeding the scope of this disclosure. The boat chair may also include a pair of straps 149 which may secure the boat chair 110 in the first compact configuration. The strap 149 are preferably each connected on one end to the seat support structure 114 within the cavity 120 and each having another end that is detachably connectable to the outer back face 138 of the back support structure 134. These straps 149 are preferably connected to the back support structure via snaps 206 located on the outer back face 138.

The second open position refers to set positions in which the boat chair 110 may be used by a user. When the boat chair 110 is in the second open position, the seat cushion 126 can be detachably attached to the inner seat face 116 and the back rest cushion 146 can be detachably attached to the inner back face 136 and positioned on the shelf 144. Both the seat cushion 126 and back rest cushion 146 are preferably secured to the inner seat face 116 and inner back face 136, respectively, via hook-and-loop material 208 and snaps 206. Those of ordinary skill in the art will appreciate from this disclosure that any suitable attachment means may be used without exceeding the scope of this disclosure.

Referring to FIGS. 15-20, a separate preferred embodiment of the boat chair 110 may include a boat chair 110 which does not include cushions, the storage compartment 142 may be larger so as to cover a substantial portion of the chamber 140. When the boat chair 110 of this preferred embodiment is in the first compact configuration, the post 124 (and, if included, the post-adjustment sleeve 224) are stored in the chamber 140 and retained therein in the storage compartment 142. In this embodiment, the handle 148 may be replaced by a slip handle 236.

Referring to FIGS. 3-11, another separate preferred embodiment of the boat chair 110 may include a leg support structure 240 connected to the seat support structure 114 by the second hinge 238. The leg support structure 240 may have a compartment 246 in the outer leg face 244. In moving such an embodiment into the first compact configuration, it is preferred that the back support structure 134 be moved into a 180 degree angle in relation to the seat support structure 114, and the post 124, or posts 124, may be placed in the compartment 246. The second hinge 238 may allow the leg support structure 240 to pivot toward the seat support structure 114 and back support structure 134 and allow the outer seat face 118, outer back face 138, and outer leg face 244 to close against one another and create a sealed compartment. In his preferred embodiment, the inner seat face 116, inner back face 136, and inner leg face 242 form the outer sides of the boat chair 110 in the second compact configuration. A latch mechanism 150 may also be provided to keep the boat chair 110 in the first compact configuration.

Referring to FIGS. 3-20 and 26-52, the chair body 112 preferably also includes a locking mechanism 130 configured to secure an angular position of the back support structure 134 relative to the seat support structure 114. This locking mechanism 130 may be configured to keep the chair body 112 in multiple positions within the second open configuration. In some embodiments, the locking mechanism 130 may also be configured to secure the chair body 112 in the first compact position.

The locking mechanism 130 may also function as a hinge between the seat support structure 114 and back support structure 134, being the only pivot point between these bodies if no hinge is present. In other embodiments, the chair body 112 may include a first hinge 228 forming a pivot axis about which the back support structure 134 might pivot.

Referring to FIGS. 39A, 29B, and 42-49, one preferred embodiment of the locking mechanism 130 may include a first indexing disc 160 attached to the back support structure 114. The first indexing disc 160 may include a first plurality of notches 215 along a circumference thereof. The locking mechanism 130 of this preferred embodiment preferably further includes an actuating rod 152 positioned on and/or through at least a portion of the seat support structure 114, with a first catch arm 164 positioned on the actuating rod 152 and configured to detachably engage one of the first plurality of notches 215. By engaging a selected one of the first plurality of notches 215, the first catch arm 164 may secure a preferred angular position of the back support structure 134 relative to the seat support structure 114. A first lever 150 may also be provided and configured to rotate with the first catch arm 164 such that rotation of the first lever 150 one of engages and disengages the first catch arm 164 from the first indexing disc 160. The structural elements of the first indexing disc 160, first plurality of notches 215, first catch arm 164, and first lever 150 along with the various attachment elements may be considered a collective lever mechanism.

In some preferred embodiments, the locking mechanism 130 may include only a single lever mechanism, either on the left or right side of the chair body 112. On the opposite side, the actuating rod 152 may only engage the seat support structure 114 to allow the actuating rod 152 to rotate. The actuating rod 152 may merely rest in a hole in the seat support structure 114, or may engage a rivet and/or washer to allow it to rotate while maintaining a preferred position. Those of ordinary skill in the art will appreciate from this disclosure that any suitable means for engaging the actuation rod 152 may be provided without exceeding the scope of this disclosure.

In other preferred embodiments, a second lever mechanism may be provided on the opposite lateral of the seat support structure 114 of the first lever mechanism. Thus, the locking mechanism 130 may further comprise a second indexing disc 170 attached to the back support structure 114, with the second indexing disc 170 including a second plurality of notches 172 along a circumference thereof. The first indexing disc 160 and the second indexing disc 170 would preferably be positioned on opposite lateral sides of the back support structure 114. The actuating rod 152 which extends through the seat support structure 114 preferably also has a second catch arm 174 positioned on the actuating rod 152. The second catch arm 174 is preferably configured to detachably engage one of the second plurality of notches 172 in the second indexing disc 170 to secure the angular position of the back support structure 134 relative to the seat support structure 114. The second lever mechanism may also include a second lever 151, with the back support structure 134 being adjustable through the use of either lever. It is preferred that when at least one of the first lever 150 or second lever 151 is used, both the first catch arm 164 and the second catch arm 174 rotate with the first lever 150 or second lever 151 such that rotation of either lever one of engages and disengages the first and second catch arms 164 and 174, respectively, from the first and second indexing discs, 160 and 170, respectively. Such a preferred configuration may provide support to both lateral sides of the back support structure 134, with the first and second pluralities of notches 162 and 172, respectively, allowing the back support structure 134 to be supported in one of many angular positions relative to the seat support structure 114 when the chair body 112 is in the second open position.

As can best be seen in FIG. 39A, a preferred embodiment of the locking mechanism 130 may include the depicted components along the left side of the back support structure 134. The locking mechanism 130 may include a first mounting brace 166 affixed to the back support structure 134 using a plurality of fasteners 200. Preferably, the fasteners 200 are formed of metal screws or rivets. Fasteners 200 may also affix the first indexing disc 160 to the first mounting brace 166. The first indexing disc 160 preferably forms a first plurality of notches 162 and a first boss 180, a raised portion of the first indexing disc 160. A first hinge plate 168 may be placed against the first indexing disc 160 such that the first boss 180 may be fit into the first plate aperture 186 and held therein, while still being allowed to rotate, by a first retaining washer 188 and a first rivet 187. A portion of the actuating rod 152 preferably extends out of the seat support structure 114. This portion of the actuating rod 152 may be inserted through a first catch arm aperture 165 in the first catch arm 164 and held therein by a first pin 183, which may be inserted through both the first catch arm pin hole 185 and first actuating rod pin hole 184. The first pin 183 ensures that the first catch arm 164 rotates within the actuating rod 153. The first catch arm 164 is configured to lock into anyone of the first plurality of notches 162 in the first indexing disc 160.

Those of ordinary skill in the art will appreciate from this disclosure that the first catch arm 164 can be 'flipped' and rotated about the actuating rod 152 relative to the lever such that the first catch arm 164 engages a lower side of the indexing disk 160 instead of an upper side as shown in the figure. If that change is made then the location of the notches on the indexing disk would preferably be moved to accommodate the new engagement positions between the catch arm 164 and the first disk 160. This would result in the catch arm 160 being in compression rather than tension when someone leans back in the boat chair. This alternate configuration is within the scope of the present invention.

The actuating rod 152 preferably extends through the first catch arm aperture 165 to allow it to also pass through the first hinge plate 168 and end within the first lever 150. The first lever 150 may be held in a fixed position on the actuating rod 152 by a first lever locating pin 189, allowing rotating of the first lever 150 to rotate both the actuating rod 152 and the first catch arm 164 at the same time. This allows the locking action to be controlled via the lever. The first hinge plate 168 can be affixed to a first mounting boss 182 on the seat support structure 114, holding the first hinge plate 168 thereto and enclosing the locking mechanism. The first mounting boss 182 is preferably a raised piece of hardware designed to provide space for the first indexing disc 160 to rotate. It is preferred that the hardware and elements described in this paragraph are formed of hard metal such as stainless steel, to provide durability and strength to the locking mechanism 130. Those of ordinary skill in the art will appreciate from this disclosure that the hardware and elements may be formed of any materials, and need not be formed of the same materials, without exceeding the scope of this disclosure.

Similarly, as can best be seen in FIG. 39B, a preferred embodiment of the locking mechanism 130 may include the depicted components along the right side of the back support structure 134. The locking mechanism 130 may include a second mounting brace 176 affixed to the back support structure 134 using a plurality of fasteners 200. Fasteners 200 may also affix the second indexing disc 170 to the second mounting brace 176. The second indexing disc 170 preferably forms a second plurality of notches 172 and a second boss 190, a raised portion of the second indexing disc 170. A second hinge plate 178 may be placed against the second indexing disc 170 such that the second boss 190 may be fit into the second plate aperture 196 and held therein, while still being allowed to rotate, by a second retaining washer 198 and a second rivet 199. A portion of the actuating rod 152 preferably extends out of the seat support structure 114. This portion of the actuating rod 152 may be inserted through a second catch arm aperture 175 in the second catch arm 174 and held therein by a second pin 193, which may be inserted through both the second catch arm pin hole 195 and second actuating rod pin hole 194. The second pin 193 ensures that the second catch arm 174 rotates within the actuating rod 153. The second catch arm 174 is configured to lock into any one of the second plurality of notches 172 in the second indexing disc 170. The actuating rod 152 preferably extends through the second catch arm aperture 175 to allow it to also pass through the second hinge plate 178 and end within the second lever 151. The second lever 151 may be held in a fixed position on the actuating rod 152 by a second lever locating pin 191, allowing rotation of the second lever 151 to rotate both the actuating rod 152 and the second catch arm 174 at the same time. This allows the locking action to be controlled via the second lever 151. The second hinge plate 178 can be affixed to a second mounting boss 192 on the seat support structure 114, holding the second hinge plate 178 thereto and enclosing the locking mechanism 130. As with the first lever mechanism, it is preferred that the hardware and elements described in this paragraph are formed of hard metal such as stainless steel, to provide durability and strength to the locking mechanism 130. Those of ordinary skill in the art will appreciate from this disclosure that the hardware and elements may be formed of any materials, and need not be formed of the same materials, without exceeding the scope of this disclosure.

Referring to FIGS. 42-49, the first indexing disc 160 preferably includes a first plurality of notches 162. In the preferred embodiment, the first indexing disc includes 5 notches for the first catch arm 164 to catch: 162A, 162B, 162C, 162D, and 162E. This plurality of notches 162 may hold the back support structure 134 in five pre-set angular positions (or any number of positions) in relation to the seat support structure 114. When the first catch arm 164 sits in the first notch of the first plurality of notches 162A, the boat chair 110 is preferably held in the first compact configuration. When the first catch arm 164 is in the second of the first plurality of notches 162B, the back support structure 134 is preferably held in roughly a ninety (90) degree position in relation to the seat support structure 114. When the first catch arm 164 is in the third of the first plurality of notches 162C, the back support structure 134 is preferably held in roughly a one hundred eighteen (118) degree position in relation to the seat support structure 114. When the first catch arm 164 is in the fourth of the first plurality of notches 162D, the back support structure 134 is preferably held in roughly a one hundred forty six (146) degree position in relation to the seat support structure 114. When the first catch arm 164 is in the fifth of the first plurality of notches 162E, the back support structure 134 is preferably held in roughly a one hundred seventy four (174) degree position in relation to the seat support structure 114. This may leave a slight angle between the back support structure 134 and the seat support structure 114, which may serve to make the boat seat 110 more durable by preventing excess pressure being imparted onto the seat support structure 114. In some preferred embodiments, the first catch arm 164 may be allowed to be pushed past the fifth of the first plurality of notches 162E. This may allow the back support structure 134 to be positioned in a full 180 degree position in relation to the seat support structure 114, yet the back support structure 134 would not be locked into such a position. It is preferred that the second indexing disc 170 be provided with the second plurality of notches 172 being identical to the first plurality of notches 162. This will allow the locking mechanism 130 to lock in the same position on both lateral sides of the seat support structure 114. Those of ordinary skill in the art will appreciate from this disclosure that any number of notches and any angular position of the notches may be provided without exceeding the scope of this disclosure.

Referring to FIGS. 50-54, the locking mechanism 130 preferably includes an actuating rod 152 which extends through the cavity 120. A pivot arm 158 may be positioned on a portion of the actuating rod 152 located within the seat support structure 114 and the cavity therein 120. The pivot arm 158 is preferably permanently and non-rotatably attached to the actuating rod 152, such that the pivot arm 158 maintains a fixed position on the actuating rod 152 at all times. The pivot arm 158 may be in contact with a biasing member 154 positioned on the seat support structure 114, preferably in the cavity 120 therein. The biasing member 154 may be configured to bias the pivot arm 158, and in turn the actuating rod 152, so that the default position of the first and second catch arms 164 and 174, respectively, is to contact the first and second indexing discs 160 and 170, respectively. The biasing member 154 is preferably formed of a metal spring, although any suitable material to provide a springing action may be included. The cavity 120 may also include a pivot stop 156 on the opposite side of the pivot arm 158 from the biasing member 154, to ensure the actuating rod 152 does not over-rotate. The pivot stop 158 is preferably formed of the same piece of molded plastic as the seat support structure 114. However, any suitable material may be used, such as rubber. In some alternate preferred embodiments, a biasing member housing 252 may also be provided in the cavity 120 and partially retaining the biasing member 154. The biasing member housing 252 may prevent the biasing member 154 from bending in either lateral direction. However, the biasing member housing 252 may only surround a portion of the biasing member 154, to allow the pivot arm 158 to contact the biasing member 154 when the actuating rod 152 is turned. In such embodiments, the biasing member 154 may be positioned on the outer seat face 118 within the cavity 120, rather than on a wall of the cavity 120.

Referring to FIGS. 3-26, other preferred embodiment of the locking mechanism 130 may include first elliptical hinge 210 and a second elliptical hinge 230 positioned on opposite lateral sides of the back support structure and 134 and seat support structures 114.

The first elliptical hinge 210 preferably includes a first outer elliptical hinge body 212 attached to the left side of the back support structure 134 via a plurality of fasteners 200. The first elliptical hinge 210 may also include a first screw bore 220 into which a first adjustment screw 216 may be inserted and screwed, to remain therein. Those of ordinary skill in the art will appreciate from this disclosure that the adjustment screws 216, 218 need not be threaded, as pins, nails, or other elongated objects may be substituted without exceeding the scope of this disclosure. The first elliptical hinge 210 preferably further includes a first inner elliptical hinge body 214 attached to the left side of the seat support structure 114 via a plurality of fasteners 200. The first inner elliptical hinge body 214 may also include a first plurality of adjustment holes 215. The first outer elliptical hinge body 212 and first inner elliptical hinge body 214 are preferably curved in a similar shape, with the first inner elliptical hinge body 214 being slightly smaller in width than the first outer elliptical hinge body 212. Such a configuration may allow the first inner elliptical hinge body 214 to slide below the first outer elliptical hinge body 212 and be partially or fully hidden from view. When the boat chair 110 is in the first compact configuration, the first inner elliptical hinge body 214 may be fully removed from the first outer elliptical hinge body 212. When one of the first plurality of adjustment holes 215 is aligned with the first screw bore 220, the first adjustment screw 216 may be inserted and secured into the first screw bore 220, such that the first adjustment screw 216 may pass through both the first screw bore 220 and one of the first plurality of adjustment holes 215. Those of ordinary skill in the art will appreciate from this disclosure that any number of adjustment holes 215 and any angular position of said adjustment holes 215 may be provided without exceeding the scope of this disclosure. It is preferred that the hardware and elements described in this paragraph be formed of hard metal such as stainless steel, to provide durability and strength to the locking mechanism 130. Those of ordinary skill in the art will appreciate from this disclosure that the hardware and elements may be formed of any materials, and need not be formed of the same materials as one another, without exceeding the scope of this disclosure.

Similarly, the second elliptical hinge 230 preferably includes a second outer elliptical hinge body 232 attached to the right side of the back support structure 134 via a plurality of fasteners 200. The second elliptical hinge 230 may also include a second screw bore 222 into which a second adjustment screw 218 may be inserted and screwed, to remain therein. Those of ordinary skill in the art will appreciate from this disclosure that the adjustment screws 216, 218 need not be threaded, as pins, nails, or other elongated objects may be substituted without exceeding the scope of this disclosure. The second elliptical hinge 230 preferably further includes a second inner elliptical hinge body 234 attached to the right side of the seat support structure 114 via a plurality of fasteners 200. The second inner elliptical hinge body 234 may also include a second plurality of adjustment holes 235. The second outer elliptical hinge body 232 and second inner elliptical hinge body 234 are preferably curved in a similar shape, with the second inner elliptical hinge body 234 being slightly smaller in width than the second outer elliptical hinge body 232. Such a configuration may allow the second inner elliptical hinge body 234 to slide below the second outer elliptical hinge body 232 and be partially or fully hidden from view. When the boat chair 110 is in the second compact configuration, the second inner elliptical hinge body 234 may be fully removed from the second outer elliptical hinge body 232. When one of the second plurality of adjustment holes 235 is aligned with the second screw bore 222, the second adjustment screw 218 may be inserted and secured into the second screw bore 222, such that the second adjustment screw 218 may pass through both the second screw bore 222 and one of the second plurality of adjustment holes 235. Those of ordinary skill in the art will appreciate from this disclosure that any number of adjustment holes 235 and any angular position of said adjustment holes 235 may be provided without exceeding the scope of this disclosure. It is preferred that the hardware and elements described in this paragraph be formed of hard metal such as stainless steel, to provide durability and strength to the locking mechanism 130. Those of ordinary skill in the art will appreciate from this disclosure that the hardware and elements may be formed of any materials, and need not be formed of the same materials as one another, without exceeding the scope of this disclosure.

A preferred embodiment of the present invention operates as follows. A user first provides a boat chair 110 in the second compact position, with the inner back face 136 of the back support structure 134 against the inner seat face 116 of the seat support structure 114. The seat cushion 126 may cover the cavity 120 and a portion of the outer seat face 118, and the post 124 may have already been inserted through the bore 128. The back rest cushion 146 may be in the chamber 140 in the outer back face 138. The straps 149 may extend from the cavity 120 to connect to the outer back face 138. The locking mechanism 130 may also hold the boat chair 110 in the first compact configuration. A user then removes the back support cushion 146 from the chamber 140 and the seat cushion from the outer seat face 118. The user then removes the post 124 from the bore 128 and the straps 149 from the outer back face 138. The user then fastens the straps 149 in the cavity 120. The user then places the post 124 in the mounting mechanism 108. Next, the user activates the first lever 150, turning the actuating rod 152 and the first catch arm 164, moving the first catch arm 164 into the second of the first plurality of notches 162A. The user then places the back rest cushion 146 on the shelf 144 and connects it to the inner back face 136, then connects the seat cushion 126 to the inner seat face 116. The user then places the chair body 112 onto the post 124 so that the post 124 engages the pedestal 122, then turns the chair until the seat connectors 204 engages the fixed connectors 202. The user may then activate the first lever 150 to move the back support structure 134 into a preferred angular configuration. Those of ordinary skill in the art will appreciate from this disclosure that the steps may be performed or omitted in any order without exceeding the scope of this disclosure.

In an alternative preferred embodiment of the present invention, the present invention operates as follows. The user first provides a boat chair 110 in the second compact position, with the inner back face 136 of the back support structure 134 against the inner seat face 116 of the seat support structure 114. The user then removes the first adjustment screw 216 and second adjustment screw 218 from the first elliptical hinge 210 and second elliptical hinge 230, respectively. The user may then pivot the seat support structure 114 about the first hinge 228, aligning the first screw bore 220 with a preferred one of the first plurality of adjustment holes 215, then inserting the first adjustment screw 216 through both to lock the first elliptical hinge 212 in place. The user then inserts the second adjustment screw 218 into the second screw bore 222 and one of the second plurality of adjustment holes 235 in the second inner elliptical hinge body 234, locking the second elliptical hinge 230 in place. The user may then remove the post 124 and post adjustment sleeve 224 from the storage compartment 142 in the chamber 140, and set the desired length of the post 124 using the post adjustment tab 226. The post 124 may then be engaged with the seat support structure 114. The post 124 may then be inserted into the mounting mechanism 108 on the boat 100. Those of ordinary skill in the art will appreciate from this disclosure that the steps may be performed or omitted in any order without exceeding the scope of this disclosure.

In an additional alternative preferred embodiment of the present invention, the present invention operates as follows. The user first provides a boat chair 110 with the back support structure 134 locked in a one hundred eighty (180) degree configuration with the seat support structure 114, and the outer back face 138, outer seat face 118, and outer leg face 244 forming a container. A latch mechanism 250 may secure the boat chair 110 in the first compact position. The user may then deactivate the latching mechanism 250 and open the seat chair 110, by pivoting the leg support structure 240 about the second hinge 238, until the leg support structure 240 is a one hundred eighty (180) degree configuration with the seat support structure 114. One or more posts 124 may be removed from the compartment 246 and placed in corresponding mounting mechanisms 108 in the boat 100. The chair body 112 may then be lifted and placed over the posts 124 such that the posts 124 engage chair body 112. The user may then remove the first adjustment screw 216 and second adjustment screw 218 from the first elliptical hinge 210 and second elliptical hinge 230, respectively. The user may then pivot the seat support structure 114 about the first hinge 228, aligning the first screw bore 220 with a preferred one of the first plurality of adjustment holes 215, then inserting the first adjustment screw 216 through both to lock the first elliptical hinge 212 in place. The user then inserts the second adjustment screw 218 into the second screw bore 222 and one of the second plurality of adjustment holes 235 in the second inner elliptical hinge body 234, locking the second elliptical hinge 230 in place. Those of ordinary skill in the art will appreciate from this disclosure that the steps may be performed or omitted in any order without exceeding the scope of this disclosure.

It is recognized by those skilled in the art that changes may be made to the above described methods and structures without departing from the broad inventive concept thereof. It is understood, therefore, that this invention is not limited to the particular embodiments disclosed, but is intended to cover all modifications which are within the spirit and scope of the invention as defined by the above specification, the appended claims and/or shown in the attached drawings.

What is claimed is:

1. A boat chair that is detachably installable on a boat, comprising:

a chair body which is moveable between a first compact configuration and a second open configuration;

the chair body comprising a back support structure and a seat support structure which are pivotally connected together about at least one of a hinge or a locking mechanism;

the locking mechanism configured to secure an angular position of the back support structure relative to the seat support structure such that the chair body can be secured in either of the first compact configuration and the second open configuration;

a post that is detachably engageable with the seat support structure such that the chair body can be detachably installed on the boat;

wherein no part of the chair body is formed by a bulkhead structure of the boat nor boat decking; and wherein the boat chair further comprises a seat connector disposed on the seat support structure and configured to engage at least one of (1) the bulkhead structure of the boat, and (2) a fixed connector located on the bulkhead structure of the boat.

2. A boat chair that is detachably installable on a boat, comprising:

a chair body which is moveable between a first compact configuration and a second open configuration;

the chair body comprising a back support structure and a seat support structure which are pivotally connected together about at least one of a hinge or a locking mechanism;

the locking mechanism configured to secure an angular position of the back support structure relative to the seat support structure such that the chair body can be secured in either of the first compact configuration and the second open configuration, the locking mechanism further comprising a first indexing disc attached to the back support structure, the first indexing disc including a first plurality of notches along a circumference thereof;

an actuating rod positioned on and/or through at least a portion of the seat support structure;

a first catch arm is positioned on the actuating rod and is configured to detachably engage one of the first plurality of notches in the first indexing disc to secure the angular position of the back support structure relative to the seat support structure; and a lever configured to rotate with the first catch arm such that rotation of the lever one of engages and disengages the first catch arm from the first indexing disc a post that is detachably engageable with the seat support structure such that the chair body can be detachably installed on the boat; and wherein no part of the chair body is formed by a bulkhead structure of the boat nor boat decking.

3. The boat chair of claim 2, wherein the locking mechanism further comprises:

a second indexing disc attached to the back support structure, the second indexing disc including a second plurality of notches along a circumference thereof, wherein the first indexing disc and the second indexing disc are on opposite lateral sides of the back support structure;

the actuating rod extending through the seat support structure;

a second catch arm is positioned on the actuating rod and is configured to detachably engage one of the second plurality of notches in the second indexing disc to secure the angular position of the back support structure relative to the seat support structure;

wherein both the first catch arm and the second catch arm rotate with the lever such that rotation of the lever one of engages and disengages the first and second catch arms from the first and second indexing discs; and a biasing member positioned on the seat support structure and configured to bias the actuating rod so that the default position of the first and second catch arms is to contact the first and second indexing discs, respectively.

4. The boat chair of claim 3, wherein the first and second pluralities of notches allow the back support structure to be supported in one of many angular positions relative to the seat support structure when the chair body is in the second open position.

5. The boat chair of claim 4, wherein the locking mechanism can secure the seat support structure and the back support structure in the first compact position.

6. The boat chair of claim 4, wherein a pivot arm is positioned on a portion of the actuating rod located within the seat support structure, the biasing member being in contact with the pivot arm.

7. The boat chair of claim 1, wherein the seat support structure has an inner seat face and an outer seat face and the back support structure has an inner back face and an outer back face; when the chair body is in the first compact configuration, the inner seat face and the inner back face are in contact; when the chair body is in the second open configuration the inner seat face and the inner back face are not in contact with each other.

8. A boat chair that is detachably installable on a boat, comprising:

a chair body which is moveable between a first compact configuration and a second open configuration;

the chair body comprising a back support structure and a seat support structure which are pivotally connected together about at least one of a hinge or a locking mechanism;

the locking mechanism configured to secure an angular position of the back support structure relative to the seat support structure such that the chair body can be secured in either of the first compact configuration and the second open configuration;

a post that is detachably engageable with the seat support structure such that the chair body can be detachably installed on the boat;

wherein no part of the chair body is formed by a bulkhead structure of the boat nor boat decking;

wherein the seat support structure has an inner seat face and an outer seat face and the back support structure has an inner back face and an outer back face; when the chair body is in the first compact configuration, the inner seat face and the inner back face are in contact; when the chair body is in the second open configuration the inner seat face and the inner back face are not in contact with each other;

wherein the outer seat face defines a cavity;

wherein a pedestal is located within the cavity and configured to engage the post;

wherein the seat support structure is configured such that the post can be stored within the cavity; and wherein the boat chair further comprises a seat cushion that is detachably engageable with the outer seat face such that the seat cushion covers the cavity when engaged with the outer seat face.

9. The boat chair of claim 8, wherein the boat chair further comprises:

the back support structure defining a handle;

the inner back face defining a shelf therealong;

the outer back face defining a chamber; and a back rest cushion is detachably positioned within the chamber.

10. The boat chair of claim 9, wherein when the boat chair is in the second open position, the seat cushion can be detachably attached to the inner seat face and the back rest cushion can be detachably attached to the inner back face and positioned on the shelf.

11. The boat chair of claim 10, wherein when the boat chair is in the first compact configuration: (1) the inner seat face is in contact with the inner back face; (2) the back rest cushion is located in the chamber in the outer back face; (3) the seat cushion is attached to the outer seat face to cover the cavity; and (4) the post is positioned within the cavity; and wherein the handle is accessible and configured to allow the boat chair to be carried.

12. The boat chair of claim 11, further providing a seat connector disposed on the seat support structure and configured to engage at least one of (1) the bulkhead structure of the boat, and (2) a fixed connector located on the bulkhead structure of the boat.

13. A boat having a detachably installable boat chair, comprising:

a boat having a deck and having bulkhead structure elevated therefrom:

a boat chair that is detachably installable on a boat, comprising:

a chair body which is moveable between a first compact configuration and a second open configuration;

the chair body comprising a back support structure and a seat support structure which are pivotally connected together about at least one of a hinge or a locking mechanism;

wherein the seat support structure has an inner seat face and an outer seat face and the back support structure has an inner back face and an outer back face;

the locking mechanism configured to secure an angular position of the back support structure relative to the seat support structure such that the chair body can be secured in either of the first compact configuration and the second open configuration:

a post that is detachably engageable with the seat support structure such that the chair body can be detachably installed on the boat;

wherein no part of the chair body is formed by a bulkhead structure of the boat nor boat decking:

a mounting mechanism positioned on the deck and configured to receive the post such that when the boat chair is in the second open position and connected to the deck via the post, the inner seat face is aligned with the bulkhead structure; and a seat connector disposed on the seat support structure and configured to engage at least one of (1) the bulkhead structure of the boat, and (2) a fixed connector located on the bulkhead structure of the boat.

14. The boat of claim 13, wherein the locking mechanism further comprises:

a first indexing disc attached to the back support structure, the first indexing disc including a first plurality of notches along a circumference thereof;

an actuating rod positioned on and/or through at least a portion of the seat support structure;

a first catch arm is positioned on the actuating rod and is configured to detachably engage one of the first plurality of notches in the first indexing disc to secure the angular position of the back support structure relative to the seat support structure;

a lever configured to rotate with the first catch arm such that rotation of the lever one of engages and disengages the first catch arm from the first indexing disc;

a second indexing disc attached to the back support structure, the second indexing disc including a second plurality of notches along a circumference thereof, wherein the first indexing disc and the second indexing disc are on opposite lateral sides of the back support structure;

the actuating rod extending through the seat support structure;

a second catch arm positioned on the actuating rod and configured to detachably engage one of the second plurality of notches in the second indexing disc to secure the angular position of the back support structure relative to the seat support structure;

wherein both the first catch arm and the second catch arm rotate with the lever such that rotation of the lever one of engages and disengages the first and second catch arms from the first and second indexing discs;

a biasing member positioned on the seat support structure and configured to bias the actuating rod so that the default position of the first and second catch arms is to contact the first and second indexing discs, respectively; and wherein the first and second pluralities of notches allow the back support structure to be supported in one of many angular positions relative to the seat support structure when the chair body is in the second open position.

15. The boat of claim 14, wherein the boat chair further comprises:

the outer seat face defines a cavity;

a pedestal located within the cavity and configured to engage the post;

wherein the seat support structure is configured such that the post can be stored within the cavity;

a seat cushion that is detachably engageable with the outer seat face such that the seat cushion covers the cavity when engaged with the outer seat face;

the back support structure defining a handle;

the inner back face defining a shelf therealong;

the outer back face defining a chamber;

a back rest cushion that is detachably positioned within the chamber;

wherein when the boat chair is in the second open position, the seat cushion can be detachably attached to the inner seat face and the back rest cushion can be detachably attached to the inner back face and positioned on the shelf; and wherein when the boat chair is in the first compact configuration: (1) the inner seat face is in contact with the inner back face; (2) the back rest cushion is located in the chamber in the rear back face; (3) the seat cushion is attached to the rear seat face to cover the cavity; and (4) the post is positioned within the cavity; and wherein the handle is accessible and configured to allow the boat chair to be carried.

16. The boat of claim 15, further comprising a pair of straps each connected on one end to the seat support structure within the cavity and each having another end that is detachably connectable to the outer back face of the back support structure.

17. The boat of claim 16, wherein the locking mechanism is configured to secure the boat chair in the first compact position.

* * * * *